US011725546B2

(12) United States Patent
Kenyon

(10) Patent No.: US 11,725,546 B2
(45) Date of Patent: Aug. 15, 2023

(54) HYBRID PHASER WITH HYDRAULIC LOCK IN AN INTERMEDIATE POSITION

(71) Applicant: BORGWARNER INC., Auburn Hills, MI (US)

(72) Inventor: Brian Kenyon, McGraw, NY (US)

(73) Assignee: BORGWARNER INC., Auburn Hills, MI (US)

( * ) Notice: Subject to any disclaimer, the term of this patent is extended or adjusted under 35 U.S.C. 154(b) by 143 days.

(21) Appl. No.: 17/273,909

(22) PCT Filed: Sep. 13, 2019

(86) PCT No.: PCT/US2019/051016
§ 371 (c)(1),
(2) Date: Mar. 5, 2021

(87) PCT Pub. No.: WO2020/056256
PCT Pub. Date: Mar. 19, 2020

(65) Prior Publication Data

US 2021/0277808 A1 Sep. 9, 2021

Related U.S. Application Data

(60) Provisional application No. 62/730,842, filed on Sep. 13, 2018.

(51) Int. Cl.
*F01L 1/344* (2006.01)

(52) U.S. Cl.
CPC ..... *F01L 1/3442* (2013.01); *F01L 2001/3443* (2013.01); *F01L 2001/34433* (2013.01); *F01L 2001/34469* (2013.01); *F01L 2250/02* (2013.01); *F01L 2250/04* (2013.01); *F01L 2250/06* (2013.01); *F01L 2800/01* (2013.01)

(58) Field of Classification Search
CPC ..... F01L 1/3442; F01L 2001/3443; F01L 2001/34433; F01L 2001/34469; F01L 1/34409; F01L 2001/34426
USPC ..... 123/90.15, 90.17
See application file for complete search history.

(56) References Cited

U.S. PATENT DOCUMENTS

| | | | | |
|---|---|---|---|---|
| 2005/0103297 | A1 | 5/2005 | Simpson | |
| 2007/0215084 | A1* | 9/2007 | Pluta | F01L 1/3442 123/90.15 |
| 2011/0017156 | A1 | 1/2011 | Smith | |
| 2013/0092113 | A1 | 4/2013 | Bohner et al. | |
| 2013/0180486 | A1* | 7/2013 | Smith | F01M 9/10 123/90.17 |
| 2013/0220253 | A1* | 8/2013 | Pluta | F01L 1/3442 123/90.17 |
| 2014/0244141 | A1 | 8/2014 | Strehlau et al. | |
| 2016/0130988 | A1* | 5/2016 | Smith | F01L 1/34409 123/90.17 |

* cited by examiner

*Primary Examiner* — Devon C Kramer
*Assistant Examiner* — Wesley G Harris
(74) *Attorney, Agent, or Firm* — Brown & Michaels, PC

(57) ABSTRACT

A phaser which has an offset or remote pilot valve added to the hydraulic circuit to manage a hydraulic detent switching function, in order to provide a mid-position lock for cold starts of the engine, either during cranking or prior to complete engine shutdown. The mid-position locking of the phaser positions the cam at an optimum position for cold restarts of the engine.

24 Claims, 42 Drawing Sheets

HYBRID PHASER WITH HYDRAULIC LOCK IN AN INTERMEDIATE POSITION

BACKGROUND OF THE INVENTION

Field of the Invention

The invention pertains to the field of variable cam timing. More particularly, the invention pertains to a hybrid phaser with a hydraulic lock in an intermediate position.

Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). Vane phasers have a rotor assembly with one or more vanes, mounted to the end of the camshaft, surrounded by a housing assembly defining the vane chambers into which the vanes fit. It is possible to have the vanes mounted to the housing assembly, and the chambers in the rotor assembly, as well. The housing assembly's outer circumference forms the sprocket, pulley or gear accepting drive force through a chain, belt, or gears, usually from the crankshaft, or possible from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the oil control valve to a null position puts equal pressure on opposite sides of the vane and holds the phaser in any intermediate position. If the phaser is moving in a direction such that engine valves will open or close sooner, the phaser is said to be advancing and if the phaser is moving in a direction such that engine valves will open or close later, the phaser is said to be retarding.

The torsional assist (TA) systems operates under a similar principle with the exception that it has one or more check valves to prevent the VCT phaser from moving in a direction opposite than being commanded, should it incur an opposing force such as torque.

The problem with OPA or TA systems is that the oil control valve defaults to a position that exhausts all the oil from either the advance or retard working chambers and fills the opposing chamber. In this mode, the phaser defaults to moving in one direction to an extreme stop where a lock pin engages. The OPA or TA systems are unable to direct the VCT phaser to any other position during the engine start cycle when the engine is not developing any oil pressure. This limits the phaser to being able to move in one direction only in the engine shut down mode. In the past this was acceptable because at engine shut down and during engine start, the VCT phaser would be commanded to lock at one of the extreme travel limits (either full advance or full retard).

Furthermore, by reducing the idling time of an internal combustion engine in a vehicle, the fuel efficiency is increased and emissions are reduced. Therefore, vehicles can use a "stop-start mode" which automatically stops and automatically restarts the internal combustion engine to reduce the amount of time the engine spends idling when the vehicle is stopped, for example at a stop light or in traffic. This stopping of the engine is different than a "key-off" position or manual stop via deactivation of the ignition switch in which the user of the vehicle shuts the engine down or puts the vehicle in park and shuts the vehicle off. In "stop-start mode", the engine stops as the vehicle is stopped, then automatically restarts in a manner that is nearly undetectable to the user of the vehicle. In the past, vehicles have been designed primarily with cold starts in mind, since that is the most common situation. In a stop-start system, because the engine had been running until the automatic shutdown, the automatic restart occurs when the engine is in a hot state. It has long been known that "hot starts" are sometimes a problem because the engine settings necessary for the usual cold start—for example, a particular valve timing position—are inappropriate to a warm engine.

Most engines with a phaser place the phaser in the retard position on engine shutdown using a lock pin or a series of lock pins, in preparation for the next start.

As an example, U.S. Pat. No. 5,924,395 is a variable cam timing system in a stop-start engine control system. When a stop signal is detected by the ECU, the intake valves are changed to the most retarded position in preparation for an upcoming hot start. In one embodiment in US'395, a lock pin fixes the vane of the phaser in the most retarded position by inserting a lock pin into a retard-side engagement hole.

SUMMARY OF THE INVENTION

A phaser which has an offset or remote pilot valve added to the hydraulic circuit to manage a hydraulic detent switching function, in order to provide a mid-position lock for cold starts of the engine, either during cranking or prior to complete engine shutdown. The mid-position locking of the phaser positions the cam at an optimum position for cold restarts of the engine.

DETAILED DESCRIPTION OF THE INVENTION

Figure 1:
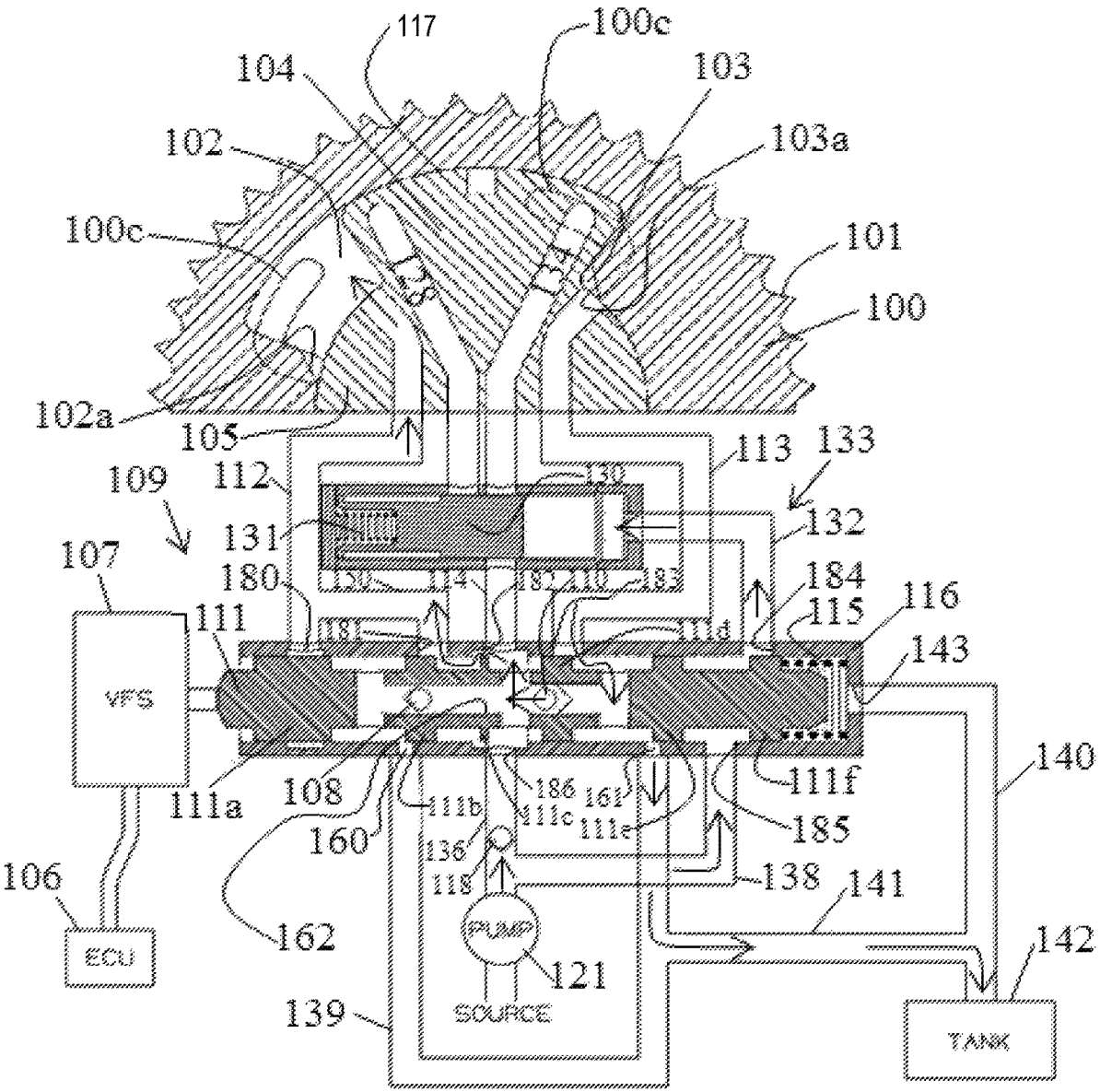
FIG. 1 shows a schematic of a phaser of a first embodiment in an advanced position.

The present invention uses a phaser which has an offset or remote pilot valve added to the hydraulic circuit to manage a hydraulic detent switching function, in order to provide a mid-position lock for cold starts of the engine, either during cranking or prior to complete engine shutdown. The mid-position locking of the phaser positions the cam at an optimum position for cold restarts of the engine.

The pilot valve may be controlled on/off with the same hydraulic circuit that engages or releases the lock pin. This shortens the variable cam timing (VCT) control valve to two hydraulic circuits, a VCT control circuit and a combined lock pin/hydraulic detent control circuit. Movement of the pilot valve to the first position is actively controlled by the remote on/off valve or the control valve of the phaser.

The phaser of the present invention has a hydraulic mid-position lock. Mid-position or intermediate position lock is a position in which a vane of the rotor assembly is prevented from moving and is in between advance and retard chamber walls. The phaser can operate as a torsional assisted phaser with mid-position lock, a cam torque actuated phaser with mid-position lock, or a switchable phaser with mid-position lock. The switchable phaser is a phaser that can switch between using cam torque and oil pressure actuation to actuate the phaser.

In all of the embodiments which include lock pins, the lock pin for locking the phaser in a mid or intermediate position is in communication with a supply which is controlled via the control valve. The lock pin is moveable between a locked position in which the lock pin engages an outer end plate of the housing assembly and an unlocked position.

One of the advantages to using the one or more multiple remote pilot valve(s) is that the pilot valves can have a longer stroke than the control valve, since the pilot valves are not limited by a solenoid. Therefore, the pilot valve can open up a larger flow passage for the hydraulic detent mode and improve actuation rate in the detent mode. In addition, the location of the one or more multiple remote pilot valve(s) shortens and simplifies the hydraulic detent circuit and thereby increases performance of the VCT detent mode or intermediate phase angle position of the phaser.

FIGS. 1-6, 13, 14, and 19-38 show the operating modes the VCT phaser depending on the spool valve position. The positions shown in the figures define the direction the VCT phaser is moving to. It is understood that the oil control valve has an infinite number of intermediate positions, so that the control valve not only controls the direction the VCT phaser moves but, depending on the discrete spool position, controls the rate at which the VCT phaser changes positions. Therefore, it is understood that the oil control valve can also operate in infinite intermediate positions and is not limited to the positions shown in the Figures.

FIGS. 1-6 show the operating modes of a switchable VCT phaser of a first embodiment depending on the spool valve position.

In this embodiment, the TA or OPA VCT phasers can have one or more working chambers which operate in a cam torque actuated (CTA) operating mode. The invention utilizes the control valve in a detent mode and a hydraulic detent circuit to direct the VCT phaser in either direction, advance or retard, to reach the mid lock position. The following description and embodiments are described in terms of a torsion assisted (TA) phaser, which has one or more check valves in oil supply lines, but it will be understood that they are also applicable to an oil pressure actuated phaser which does not contain a check valve in the oil supply line. An offset or remote pilot valve is added to a hydraulic circuit of a torsion assist or oil pressure actuated phaser to manage the hydraulic detent switching function.

Figure 12:
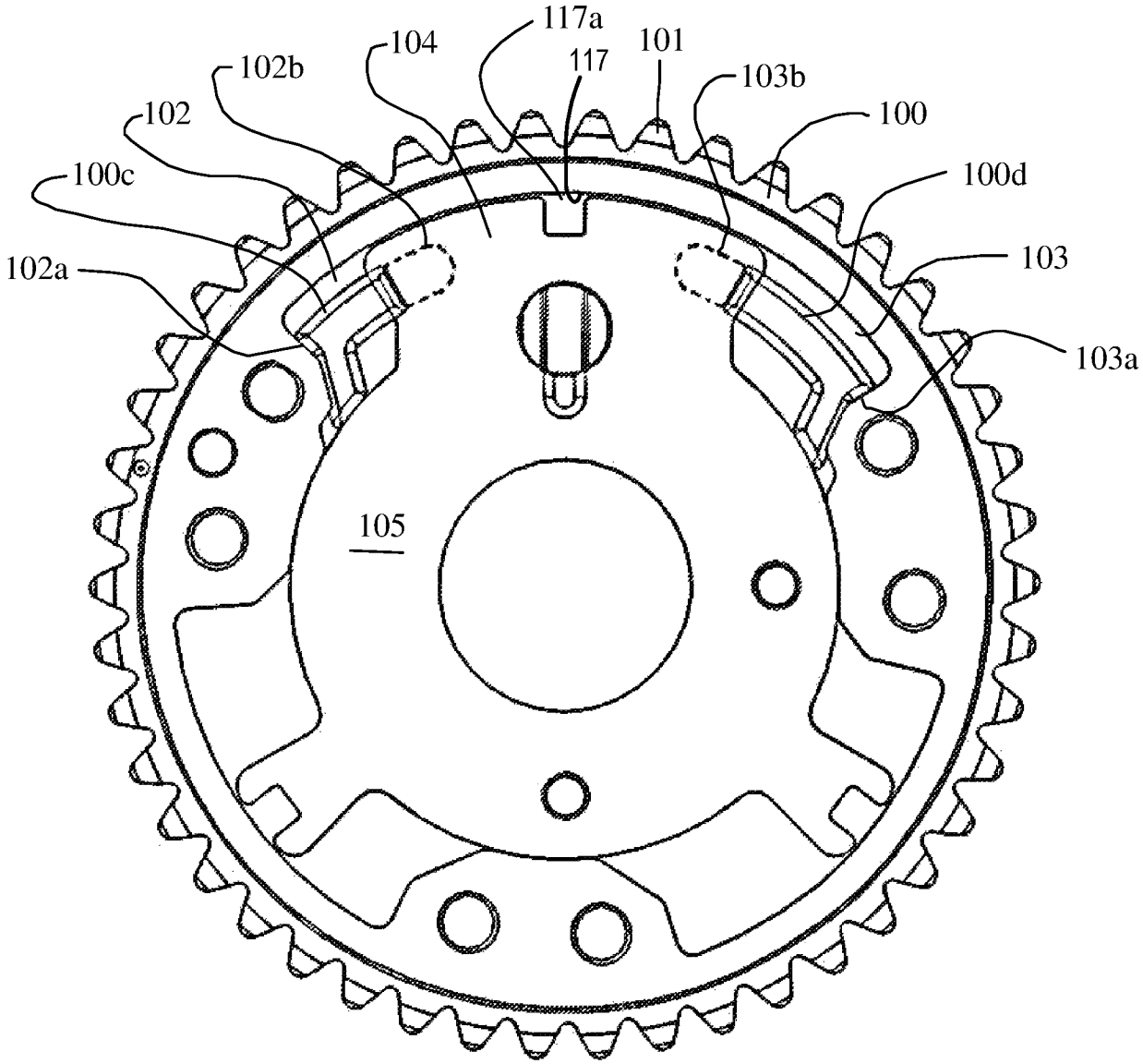
FIG. 12 shows an end view of the phaser of the first embodiment with an end plate removed.
Figure 13:
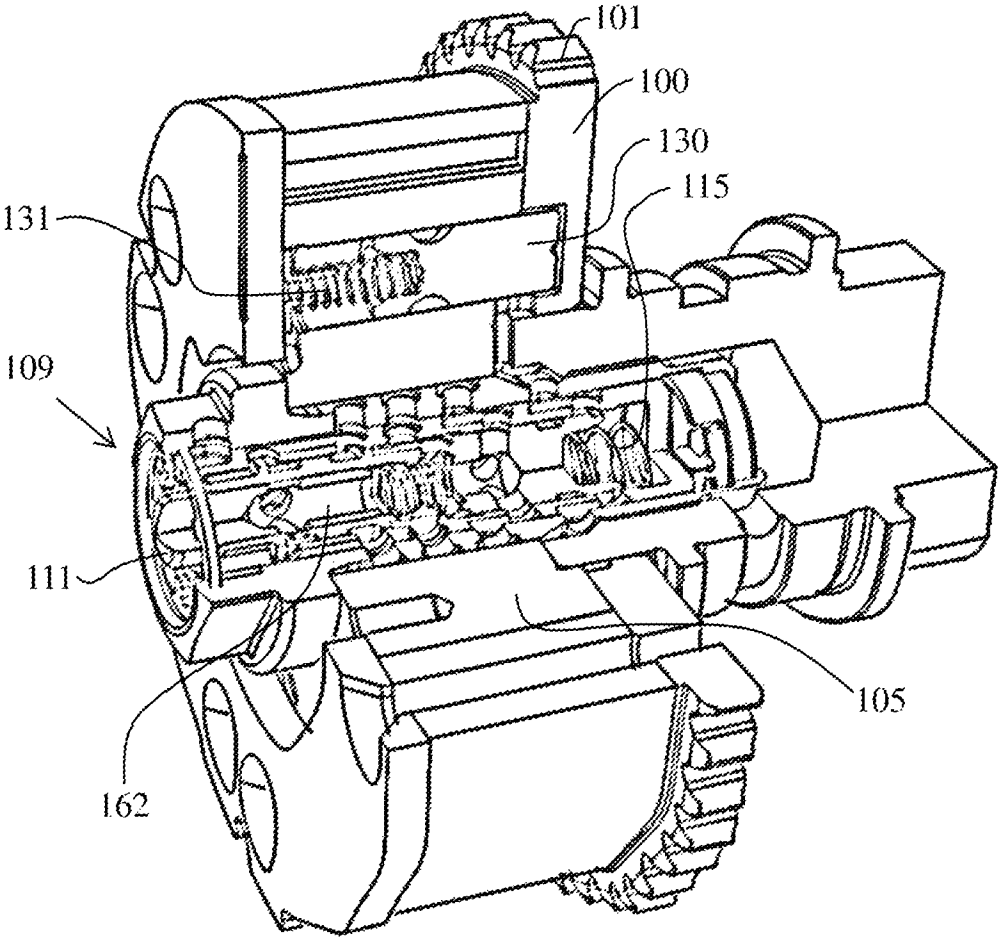
FIG. 13 shows a sectional view of the phaser of the first embodiment at the midlock or intermediate locking position.
Figure 14:
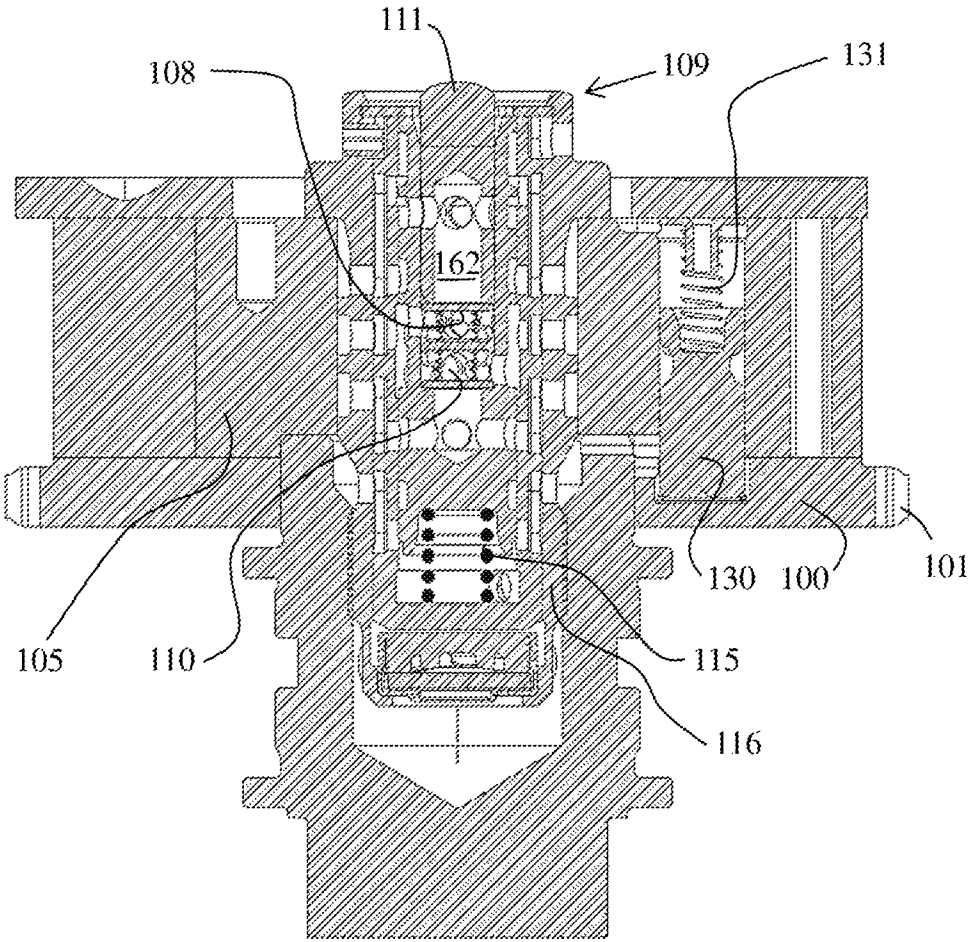
FIG. 14 shows another section view of the phaser of the first embodiment showing the control valve and the pilot valve.

Referring to FIGS. 7-9, 11-14, the housing assembly 100 of the phaser has an outer circumference 101 for accepting drive force as well as a first end plate 100*a* and a second end plate 100*b*. A bias spring 163 may be present on the second end plate 100*b* to bias the rotor assembly 105 towards an advance position. The rotor assembly 105 is connected to the camshaft (not shown) and is coaxially located within the housing assembly 100. The rotor assembly 105 has a vane 104 separating a chamber 117 formed between the housing assembly 100 and the rotor assembly 105 into an advance chamber 102 and a retard chamber 103. The chamber 117 has an advance wall 102*a*, and a retard wall 103*a* which is separated by a distance through an arc 117*a*. Within at least one vane 104 of the rotor assembly 105 are rotor advance metered pocket 102*b* and a rotor retard metered pocket 103*b*. In specific positions of the vane 104 relative to an end plate 100*a* or 100*b* of the housing assembly 100, end plate metered pockets 100*c*, 100*d* align with either of the rotor advance metered pocket 102*b* or the rotor retard metered pocket 103*b* to allow fluid to recirculate between the chambers 102, 103 through a pilot valve 130 in the midlock or intermediate position as shown in FIG. 12. The vane 104 is capable of rotation to shift the relative angular position of the housing assembly 100 and the rotor assembly 105. Additionally, a hydraulic detent circuit 133 is also present.

The hydraulic detent circuit 133 (see FIGS. 1-6, 13-14) includes a spring 131 loaded pilot valve 130, an advance detent line 128 that connects the advance chamber 102 to the pilot valve 130 and the common line 114 via the rotor advance metered pocket 102*b*, and a retard detent line 134 that connects the retard chamber 103 to the pilot valve 130 and the common line 114 via the rotor retard metered pocket 103*b*. The advance detent line 128 and the retard detent line 134 are present within the vane 104.

A control valve 109 (see FIGS. 1-6, 13-14, 15*a*-18*c*), preferably a spool valve, includes a spool 111 with cylindrical lands 111*a*, 111*b*, 111*c*, 111*d*, 111*e* and 111*f* slidably received in a sleeve 116 within a bore in the rotor assembly 105 and pilots in the camshaft (not shown). The spool 111 also includes a retard recirculating check valve 108 and an advance recirculating check valve 110 within a central passage 162 of the spool 111.

The control valve 109 may be located remotely from the phaser, within a bore in the rotor assembly 105 which pilots in the camshaft, or in a center bolt of the phaser. One end of the spool 111 contacts spring 115 and the opposite end of the spool 111 contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-186 and vent orifices 160-161 acting as tunable exhaust ports. The port 180 is in fluid communication with the advance line 112. Port 181 is in fluid communication with line 150. Port 182 is in fluid communication with common line 114. Port 183 is in fluid communication with retard line 113. Port 184 is in fluid communication the pilot valve 130 of the hydraulic detent circuit 133 via line 132. Port 185 is in communication with line 138. Vent orifice 161 is in communication with tank 142 through line 139 and 144. Port 186 is in fluid communication with line 136. Vent orifice 160 is in communication with tank 142 through line 139.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 is open (on) or closed (off). In other words, the position of the spool 111 actively controls the pilot valve 130. The control valve 109 has an advance mode, a retard mode, a null mode (holding position), a detent mode.

In the advance mode, the spool 111 is moved to a position so that fluid may flow from the retard chamber 103 into the spool 111 and through the advance recirculating check valve 110 into advance line 112 and into advance chamber 102 or to sump or tank 142 via a tunable exhaust port or vent orifice 161 and through line 144 and line 141. Fluid is blocked from exiting the advance chamber 102, and the detent valve circuit 133 is off or closed.

In the retard mode, the spool 111 is moved to a position so that fluid may flow from the advance chamber 102 through the spool 111 and through the retard recirculating check valve 108 into retard line 113 and into the retard chamber 103 or to sump or tank 142 via a tunable exhaust port or vent orifice 160 and through line 139 and line 141. Fluid is blocked from exiting the retard chamber 103 and the detent valve circuit 133 is off.

In null mode, the spool 111 is moved to a position that blocks the exit of fluid from the advance and retard chambers 102, 103 to the tank 142, and the detent valve circuit 133 is off.

In the detent mode, three functions occur simultaneously. The first function in the detent mode is that the spool 111 moves to a position in which spool land 111*b* blocks the flow of fluid from advance line 112 to tank 142, spool land 111*e* blocks the flow of fluid from retard line 113 to tank 142, effectively removing control of the phaser from the control valve 109. At the same time, any fluid that does exit the advance chamber 102 can flow through advance line 112 through port 180 to between spool lands 111*a* and 111*b* to central passage 162. Fluid flows through the retard recirculating check valve 108 within the central passage 162 and through port 182 to common line 114. From common line 114, fluid can flow through the pilot valve 130 and enter either the advance detent line 128 or the retard detent line 134. Any fluid that exits the retard chamber 103 can flow through retard line 113 through port 183 to central passage 162 of the spool 111. Fluid flows through the advance recirculating check valve 110 within the central passage 162 and through port 182 to common line 114. From the common line 114 fluid can flow through the pilot valve 130 and enter either the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function is the intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance detent line 128 and end plate metering pocket 100*c* overlap and the retard detent line 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133 and vent the pilot valve 130, since if power or control is lost, the phaser will default to a locked position. It should be noted that the duty cycle percentages listed above are an example and they may be altered. Furthermore, the hydraulic detent circuit 133 may be open and the pilot valve 130 vented at 100% duty cycle, if desired.

In order for the phaser to be in detent position the duty cycle of the VFS 107 is set to 0%. In the example of the figures, the stroke of the spool 111 or position of the spool 111 relative to the sleeve 116.

The detent position is ideal for a cold start of the engine since the vane 104 is in an intermediate position between a full advance position and a full retard position. The "full advance position" is defined as the position at which the vane 104 contacts the advance wall 102*a*, and the "full retard position" is defined as the vane 104 contacting the retard wall 103*a*. The detent position can also provide an ideal or optimized compression ratio at ignition for starting the engine, for example approximately 8:1. When the phaser in a full retard position, when the ignition fires the spark, the compression ratio is too low to start the engine for a cold start, and when the phaser is in an advance position, the compression ratio is too high to start the engine for a cold start.

When the duty cycle of the variable force solenoid 107 is just set to 0%, the force on the VFS on the spool 111 is decreased, and the spring 115 moves the spool 111 to the far left end of the spool's travel to a detent position as shown in the Figures. In this detent position, spool land 111*b* blocks the flow of fluid from advance line 112 in between spool lands 111*a* and 111*b* from exhausting to tank 142 through exhaust line 139 and spool land 111*d* blocks the flow of fluid from retard line 113 from exhausting to tank 142 through exhaust line 139, spool lands 111*c* and 111*d* block fluid from exiting either advance line 112 or retard line 113 to each other, effectively removing control of the phaser from the control valve 109. At the same time, fluid from source may flow through line 136 and inlet check valve 118 to the common line 114 between spool lands 111*c* and 111*d*. Fluid from advance line 112 can however pass through the central passage 162, retard recirculating check valve 108, and flow to the common line 114 between spool lands 111*c* and 111*d*. Fluid from retard line 113 can also pass through the central passage 162 and advance recirculating check valve 110 and flow to the common line 114 between spool lands 111*c* and 111*d*.

Fluid is prevented from flowing through line 132 to the pilot valve 130 by spool land 111*f*. Since fluid cannot flow to line 132, the fluid vents through the spool 111 to exhaust orifice 143 at the end of the sleeve 116, opening passage between the advance detent line 128 and the retard detent line 134 through the pilot valve 130 to the common line 114, in other words opening the hydraulic detent circuit 133.

Figure 4:
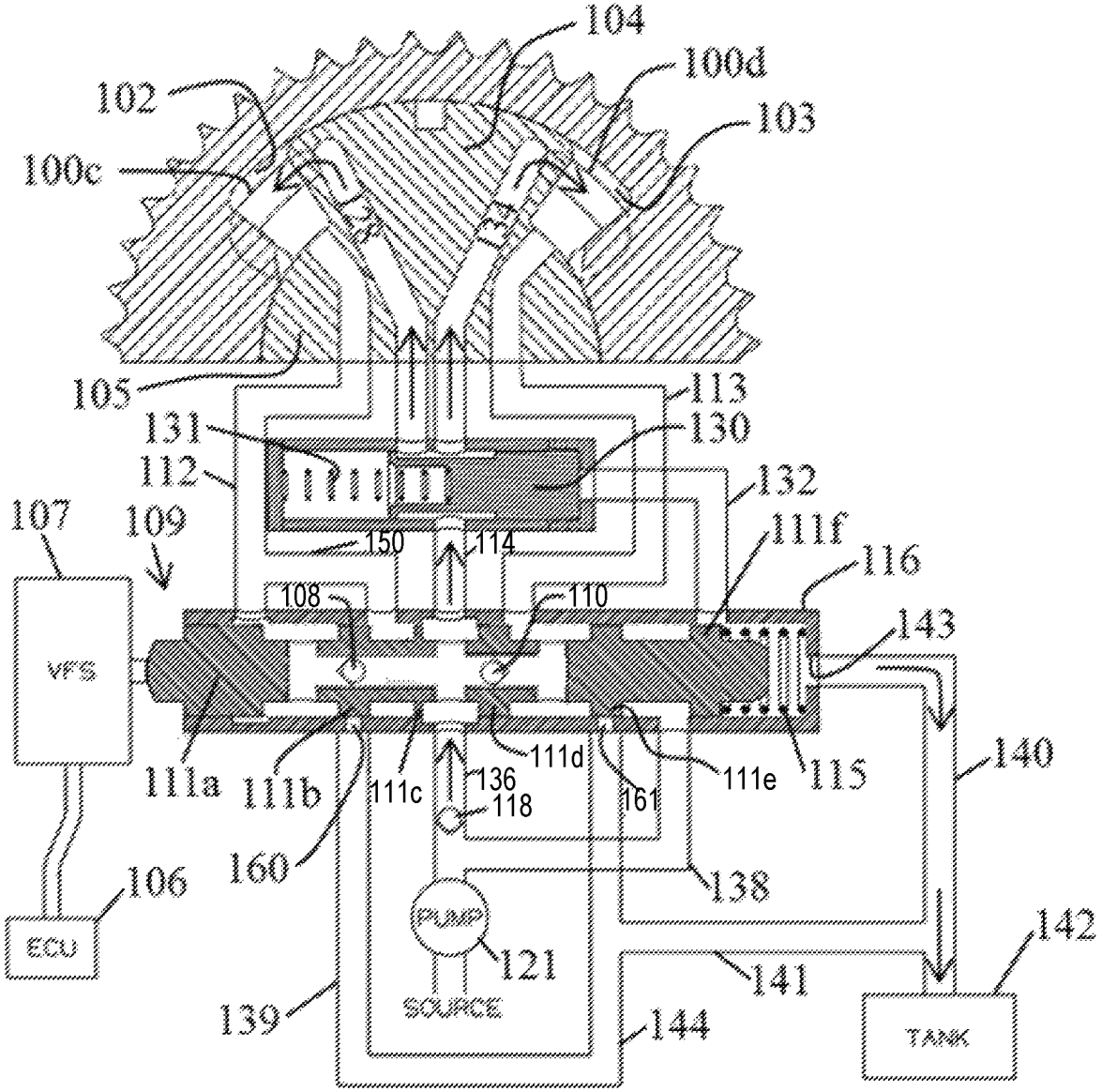
FIG. 4 shows a schematic of the phaser of the first embodiment in a midlock or intermediate locking position.
Figure 5:
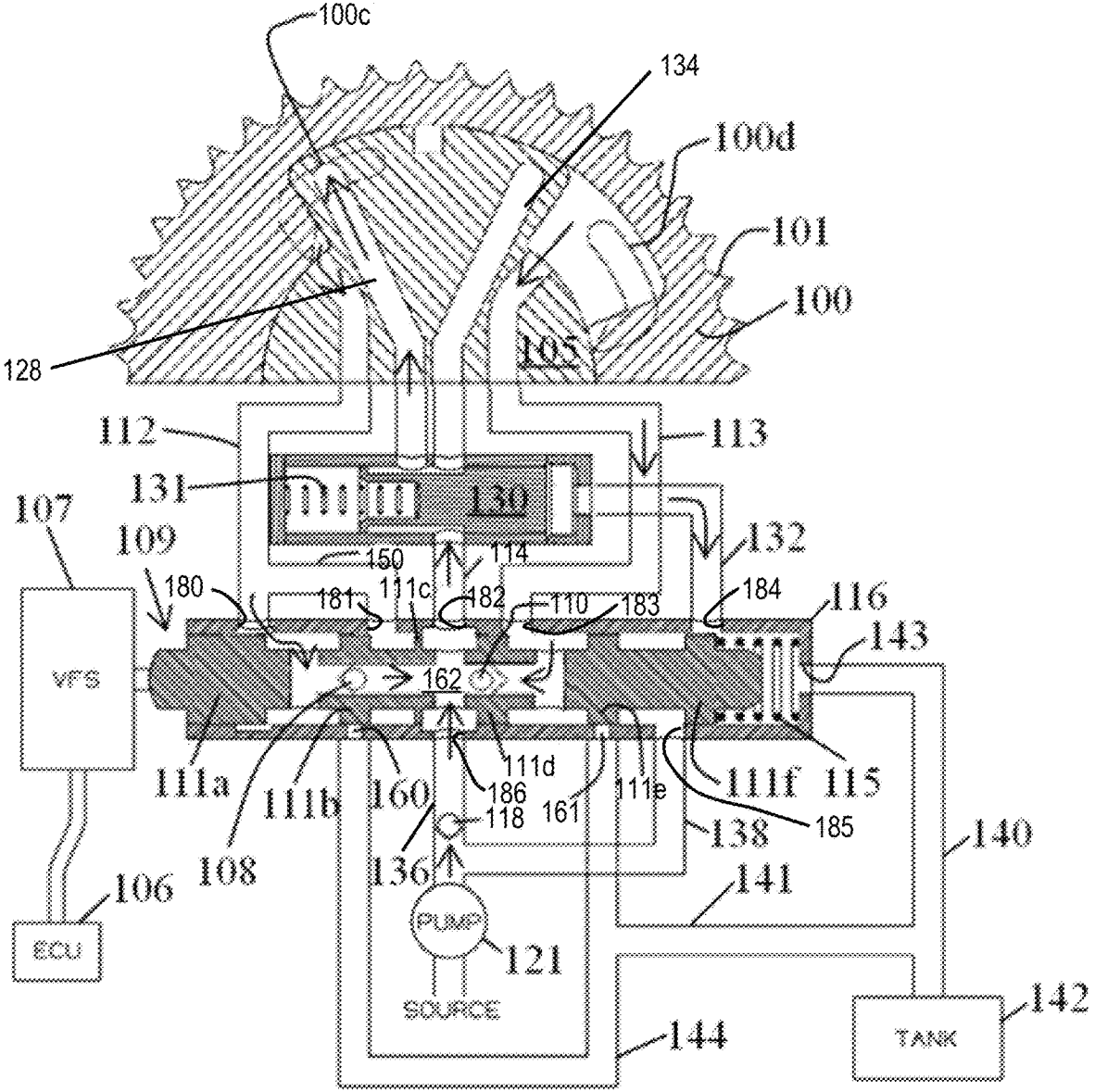
FIG. 5 shows a schematic of the phaser of the first embodiment in a retard position moving towards the midlock or intermediate locking position.
Figure 6:
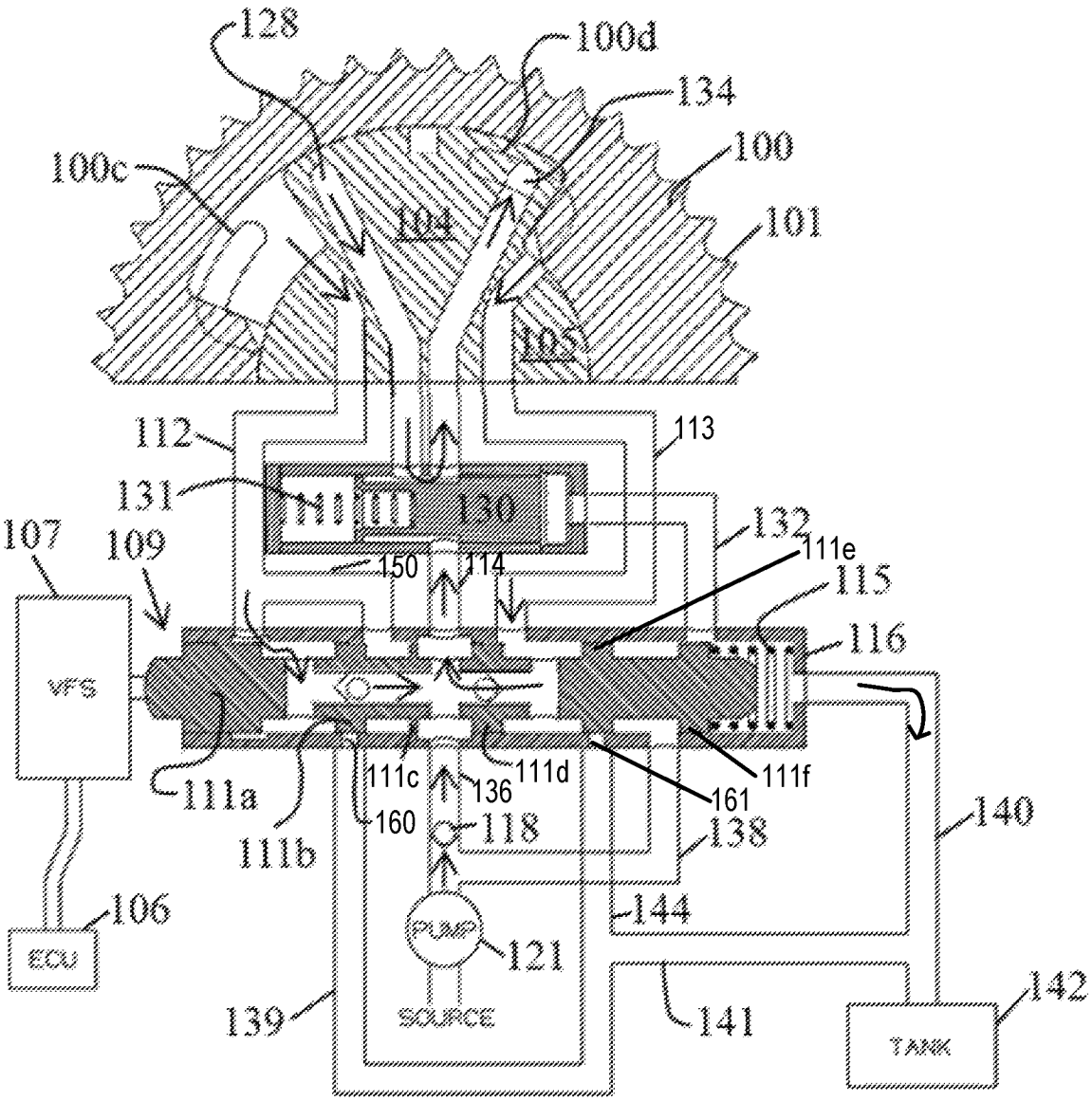
FIG. 6 shows a schematic of the phaser of the first embodiment in an advance position moving towards the midlock or intermediate locking position.
Figure 7:
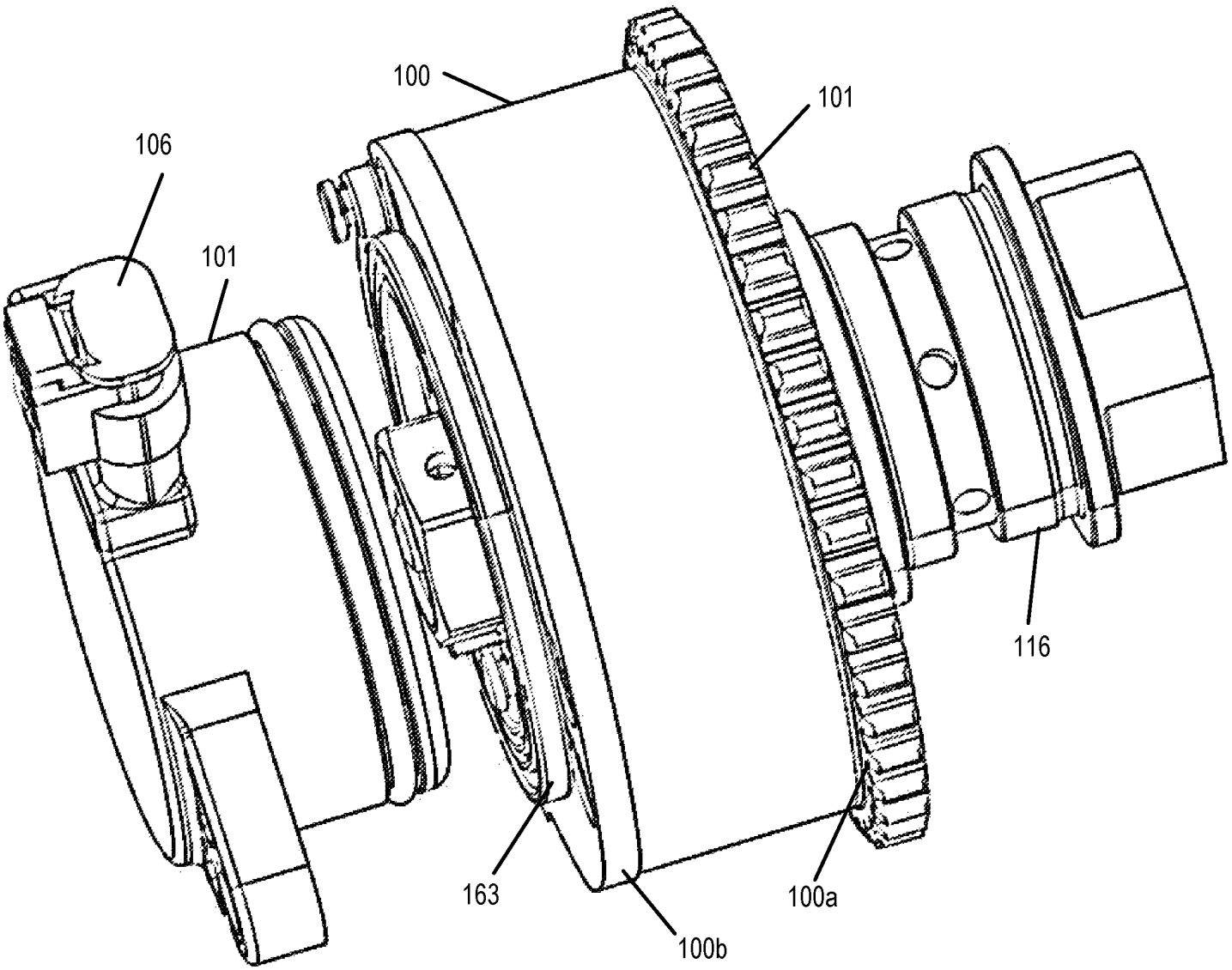
FIG. 7 shows a perspective view of the phaser of the first embodiment.
Figure 8:
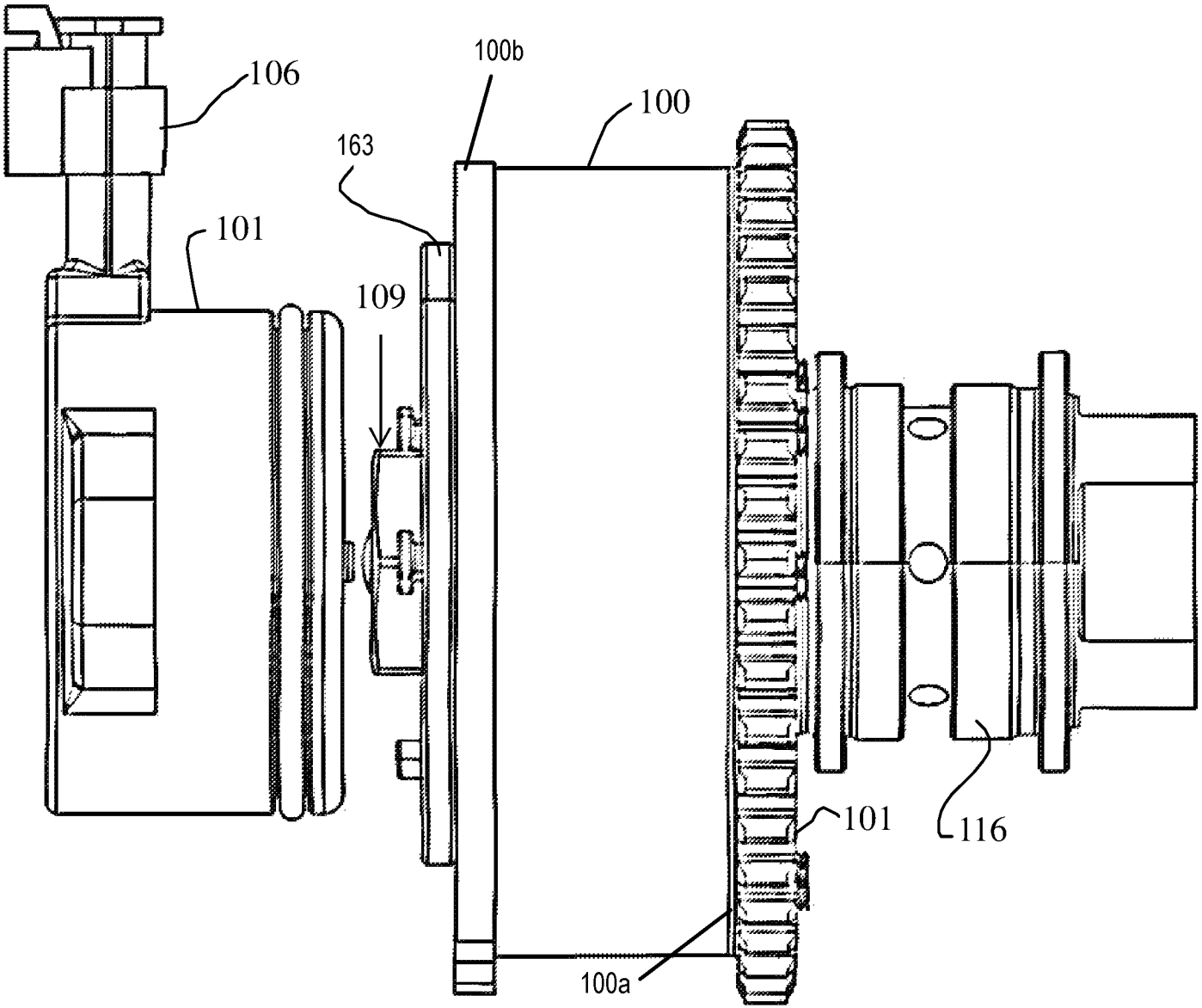
FIG. 8 shows a side view of the phaser of the first embodiment.
Figure 9:
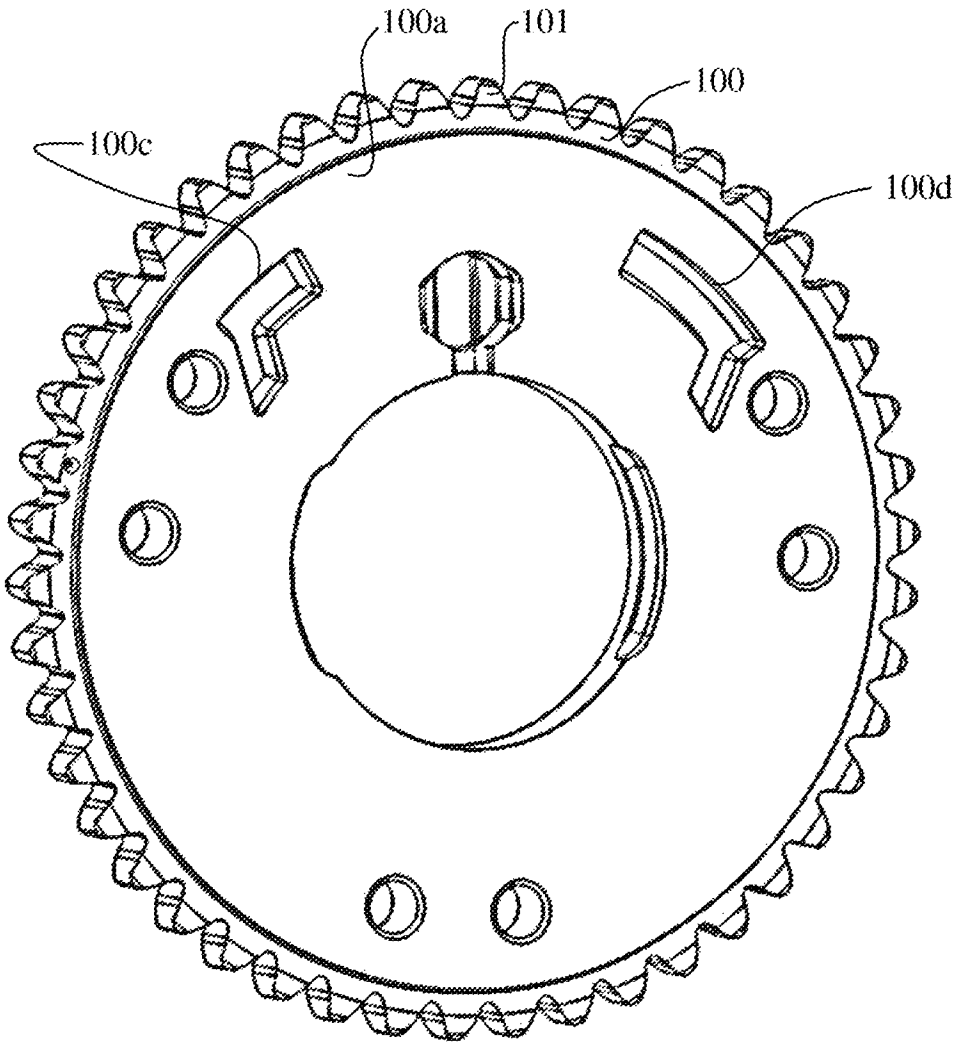
FIG. 9 shows an end view of the end plate of the phaser of the first embodiment.
Figure 10:
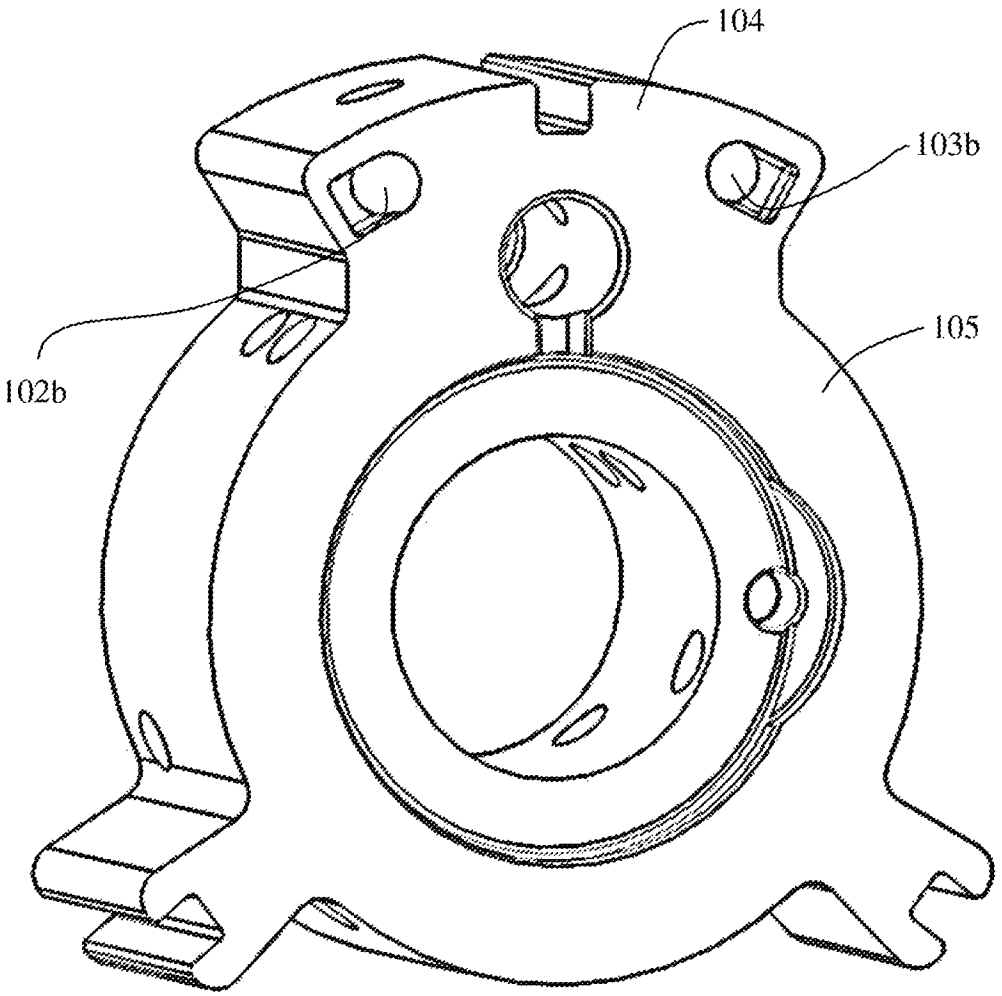
FIG. 10 shows an end view of the rotor of the phaser of the first embodiment.
Figure 11:
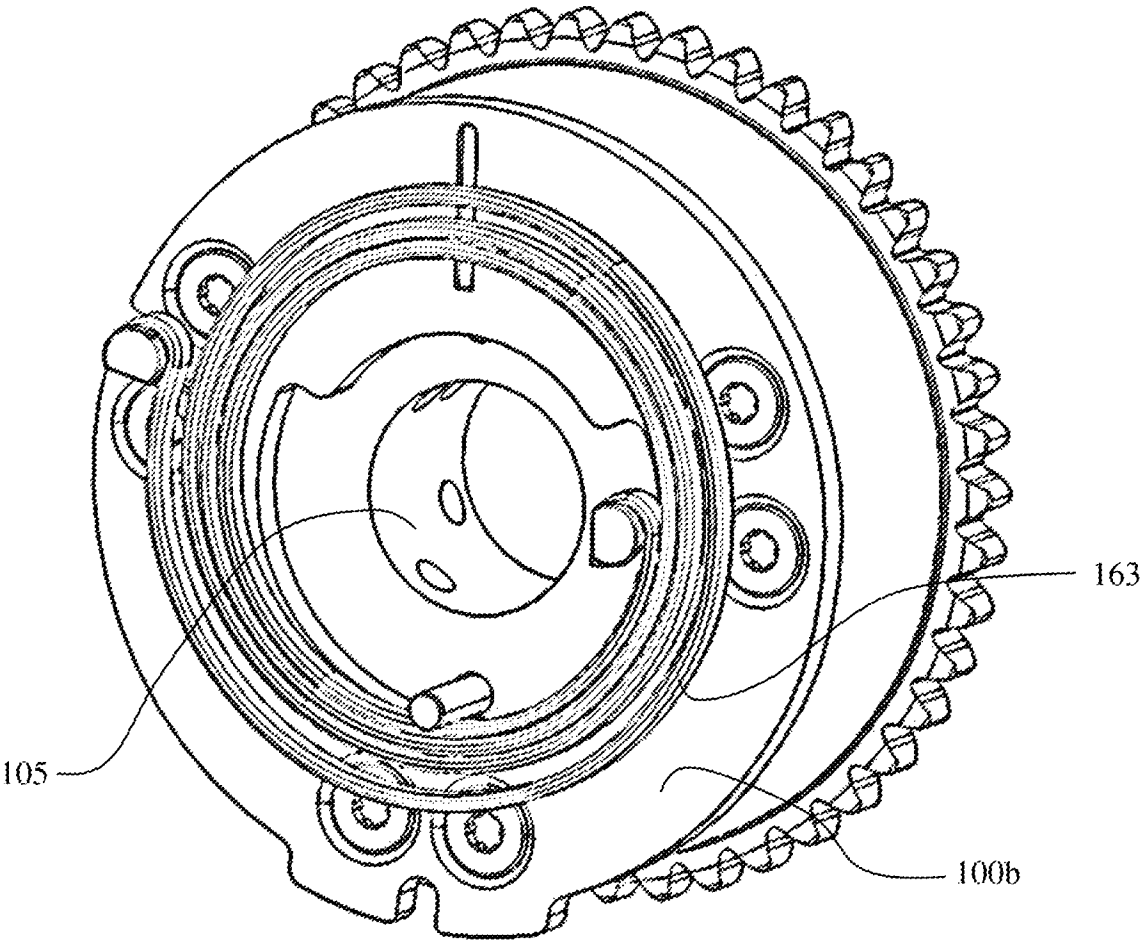
FIG. 11 shows a front view of the phaser of the first embodiment.

Referring to FIGS. 4-6, when the duty cycle of the variable force solenoid 107 is 0%, the spool is in detent mode, the pilot valve 130 is vented, the hydraulic detent circuit 133 is open or on, and the rotor assembly 105 is preferably in a mid-position or an intermediate phase angle position. Depending on where the vane 104 was prior to the duty cycle of the variable force solenoid 107 being changed to 0%, either the advance detent line 128 or the retard detent line 134 will be exposed to the advance or retard chamber 102, 103 by the end plate advance and end plate retard metering pocket 100*c*, 100*d* respectively.

In addition, if the engine had an abnormal shut down (e.g. the engine stalled), when the engine is cranking, the duty cycle of the variable force solenoid 107 would be 0%, the rotor assembly 105 would move via the detent circuit 133 to a mid-position or intermediate phase angle position regardless of what position the vane 104 was in relative to the housing assembly 100 prior to the abnormal shut down of the engine.

The ability of the phaser of the present invention to default to a mid-position or intermediate phase angle position without using electronic controls allows the phaser to move to the mid-position or intermediate phase angle position even during engine cranking when electronic controls are not typically used for controlling the cam phaser position. In addition, since the phaser defaults to the mid-position or intermediate phase angle position, it provides a fail safe position, especially if control signals or power is lost, which guarantees that the engine will be able to start and run even without active control over the VCT phaser. Since the phaser has the mid-position or intermediate phase angle position upon cranking of the engine, longer travel of the phase of the phaser is possible, providing calibration opportunities. In the prior art, longer travel phasers or a longer phase angle is not possible, since the mid-position or intermediate phase angle position is not present upon engine cranking and startup and the engine has difficulty starting at either the extreme advance or retard stops.

If the vane 104 was positioned within the housing assembly 100 near or in the retard position (see FIG. 5) fluid from the retard chamber 103 flows through retard line 113 to the control valve 109 through port 183. From the control valve 109, fluid flows through the central passage 162 and the advance recirculating check valve 110 through port 182 and into common line 114. From common line 114, fluid flows through the open pilot valve 130 and to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the end plate advance metering pocket 100*c* within the chamber 117 formed between the housing assembly 100 and the rotor assembly 105.

If the vane 104 was positioned within the housing assembly 100 near or in the advance position (see FIG. 6) fluid from the advance chamber 102 flows through advance line 112 to the control valve 109 through port 180. From the control valve 109, fluid flows through the central passage 162 and the retard recirculating check valve 108 through port 182 and into common line 114. From common line 114, fluid flows through the open pilot valve 130 and to the retard detent line 134, which is exposed to the retard chamber 103 through the aligned rotor retard metering pocket 103*b* and end plate metering pocket 100*d*. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are partially open to the end plate metered pockets 100*c*, 100*d* and rotor metering pockets 102*b* and 103*b*.

When the duty cycle is set between 60-100%, the vane of the phaser is moving toward and/or in a retard position.

Having the phaser in a retard position is ideal for a hot or warm restart since a lower compression ratio can be used to restart the engine. By placing the phaser in a full retard position and therefore using a lower compression ratio, the efficiency of the engine restart is increased, the vibration of the engine during the engine restart is minimized, the work load on the starter is minimized, and the time for the engine to restart is accelerated.

Figure 2:
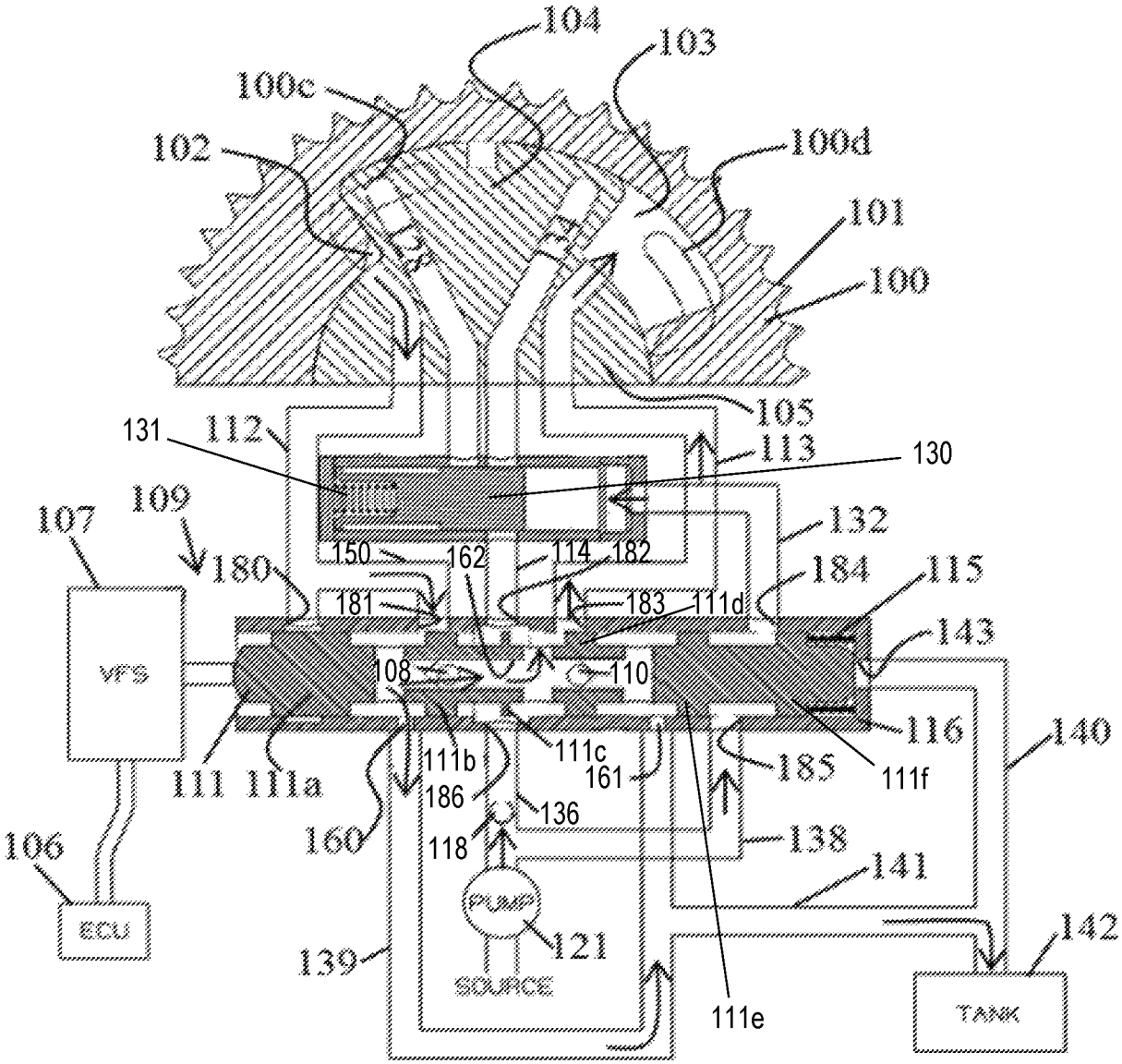
FIG. 2 shows a schematic of the phaser of the first embodiment in a retard position.

Referring to FIG. 2, to move towards the retard position, the duty cycle is adjusted to a range greater than 60% of the force of the VFS 107 on the spool 111 is changed and the spool 111 is moved to the right in a retard mode in the figure by VFS 107, until the force of the VFS 107 balances the force of the spring 115. Fluid exits from the advance chamber 102 through advance line 112 to line 150 and port 181 to the control valve 109 between spool lands 111*a* and 111*b*. Some of the fluid from the chamber exits through vent 160 and flows to tank 142. Some of the fluid can also flow through the central passage 162, through the retard recirculating check valve 108, between spool lands 111*b* and 111*d*, to retard line 113, and to the retard chamber 103. It should be noted that the amount of fluid which vents through vent 160 and the amount of fluid that recirculates to the retard chamber 103 through retard check 108 is based on the size of the vent 160. It the vent 160 is very small or restricted, more fluid will recirculate from the advance chamber 102 to the retard chamber 103 and the phaser will function more similarly to a cam torque actuated phaser. If the vent 160 is large, the phaser will function more similarly to an oil pressure actuated or torsion assisted phaser.

Makeup oil or source is supplied to the phaser from source S by pump 121 and enters inlet line 136 and flows through an inlet check valve 118 and to the control valve 109. From the control valve 109, fluid enters the central passage 162, flows between spool lands 111*b* and 111*d* and over spool land 111*c*, out port 183 to the retard line 113. Fluid is also provided to the pilot valve 130 by flowing through line 138, to the spool 111 between lands 111*e* and 111*f* to line 132 in fluid communication with the pilot valve 130. The fluid provided to the pilot valve 130 from line 132 pressurizes the pilot valve 130 against the spring 131, moving the pilot valve 130 to a position where retard detent line 134 and the advance detent line 128 are blocked from common line 114 and each other and the detent circuit is off. Exhaust vent 143 is blocked by spool land 111*f*, preventing the pilot valve 130 from venting.

In FIGS. 15*a*-18*c*, it should be noted that spool land 111*a* is split into two parts 111*a*1 and 111*a*2, however in the schematics the spool land is just represented as 111*a*. Spool land part 111*a*1 is solely used for sealing off port 180 to atmosphere. Spool land 111*a*2 is the active portion of the land sealing off port 180 when the phaser is operating out of detent mode.

Figure 16A:
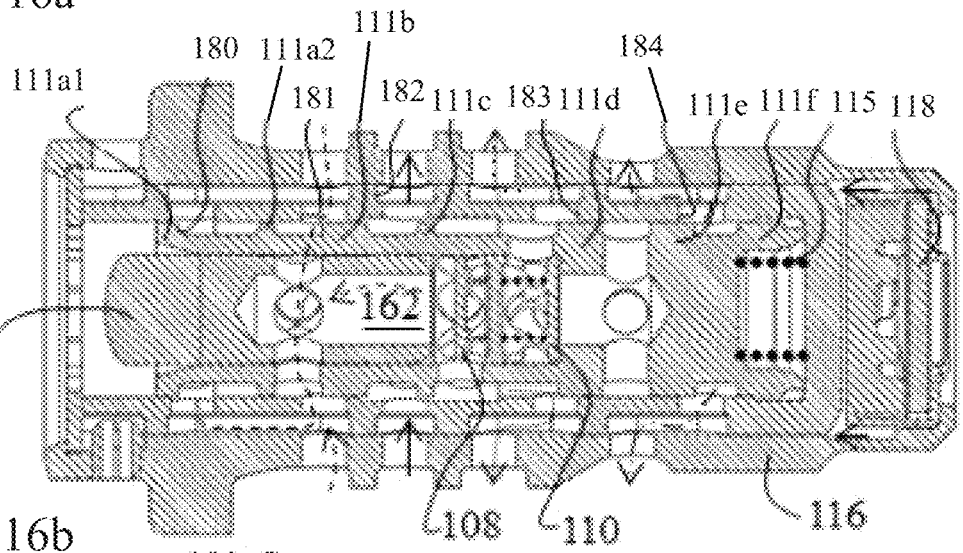
FIG. 16*a* shows a first cross-sectional view of the control valve in the retard position.
Figure 16B:
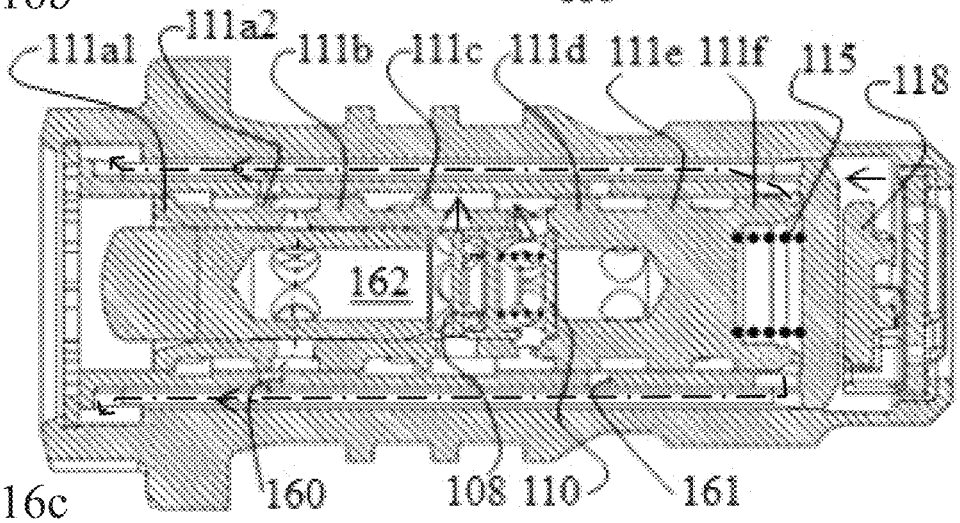
FIG. 16*b* shows a second cross-sectional view of the control valve in the retard position.
Figure 16C:
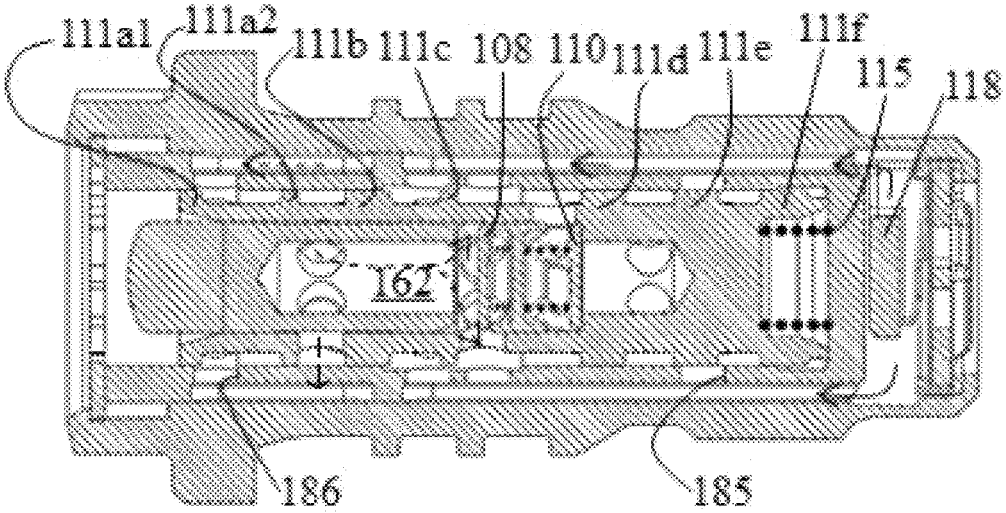
FIG. 16*c* shows a third cross-sectional view of the control valve in the retard position.

FIGS. 16*a*-16*c* show different cross-sections of the control valve in the retard position. Fluid flow from the advance chamber 102 is shown as a dashed line, source fluid flow within the control valve 109 is shown as a solid line, fluid flow to the retard chamber 103 is shown as a dotted line, fluid flow relative to the pilot valve 130 is shown as a dash-dot-dot line, fluid flow venting is shown as a dash-dash-dot line.

Referring to FIG. 1, to move towards the advance position, the duty cycle is adjusted to a range of 20-50% the force of the VFS 107 on the spool 111 and the spool 111 is moved to the right in a retard mode in the figure by VFS 107, until the force of the VFS 107 balances the force of the spring 115. Fluid exits from the retard chamber 103 through retard line 113 and port 183 to the control valve 109 between spool lands 111*d* and 111*e*. Some of the fluid from the chamber 103 exits through vent 161 and flows to tank 142. Some of the fluid can also flow through the central passage 162, through the advance recirculating check valve 110, in between spool lands 111*b* and 111*d*, and over spool land 111*c* to line 150. From line 150, fluid flows to advance line 112 to the advance chamber 102. It should be noted that the amount of fluid which vents through vent 161 and the amount of fluid that recirculates to the advance chamber 102 through advance recirculating check valve 110 is based on the size of the vent 161. It the vent 161 is very small or restricted, more fluid will recirculate from the retard chamber 103 to the advance chamber 102 and the phaser will function more similarly to a cam torque actuated phaser. If the vent 161 is large, the phaser will function more similarly to an oil pressure actuated or torsion assisted phaser.

Makeup oil or source is supplied to the phaser from source S by pump 121 and enters inlet line 136 and flows through an inlet check valve 118 and to the control valve 109. From the control valve 109, fluid enters the central passage 162, flows between spool lands 111*b* and 111*d* and over spool land 111*c*, out port 181 to the advance lines 150, 112. Fluid is also provided to the pilot valve 130 by flowing through line 138, to the spool 111 between lands 111*e* and 111*f* to line 132 in fluid communication with the pilot valve 130. The fluid provided to the pilot valve 130 from line 132 pressurizes the pilot valve 130 against the spring 131, moving the pilot valve 130 to a position where retard detent line 134 and the advance detent line 128 are blocked from common line 114 and each other and the detent circuit is off. Exhaust vent 143 is blocked by spool land 111*f*, preventing the pilot valve 130 from venting.

Figure 15A:
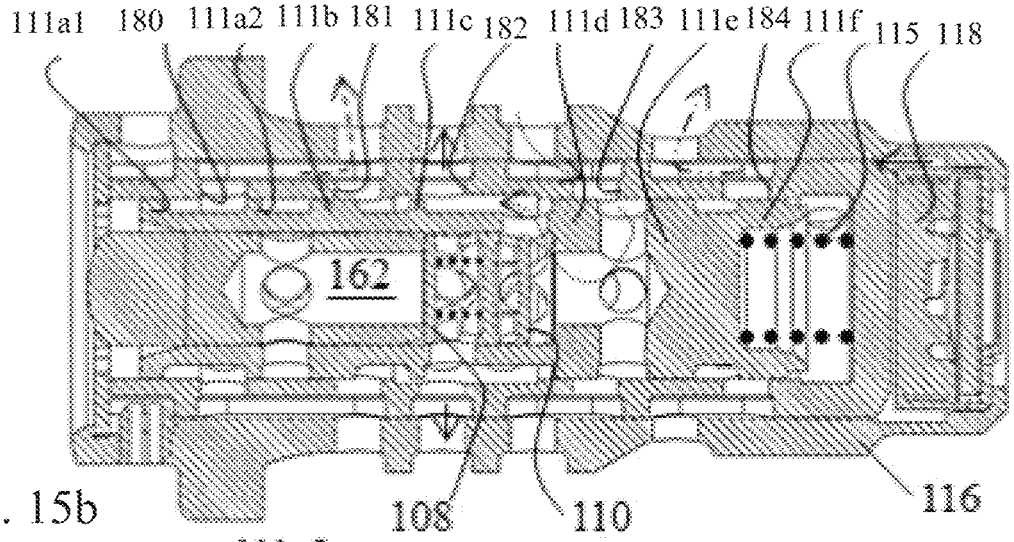
FIG. 15*a* shows a first cross-sectional view of the control valve in the advance position.
Figure 15B:
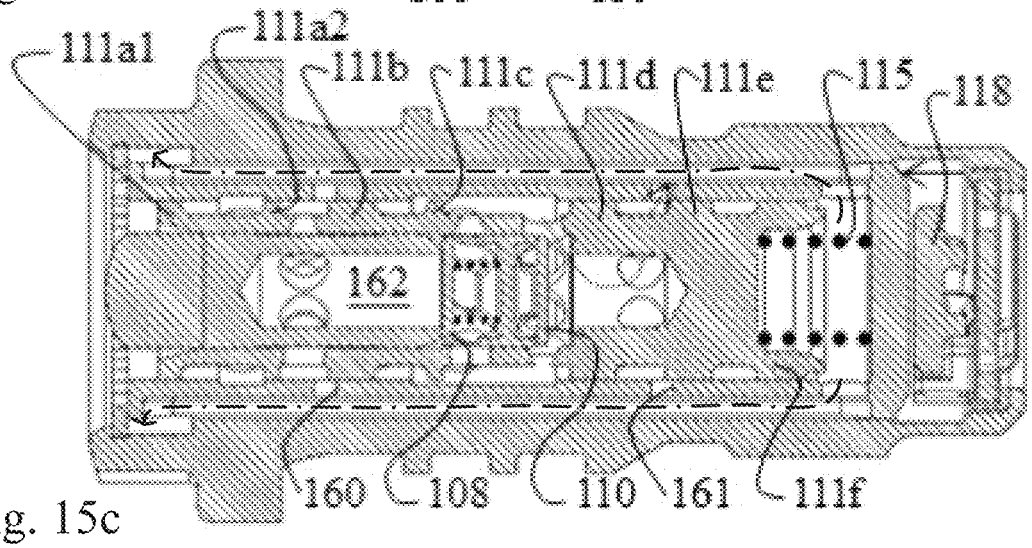
FIG. 15*b* shows a second cross-sectional view of the control valve in the advance position.
Figure 15C:
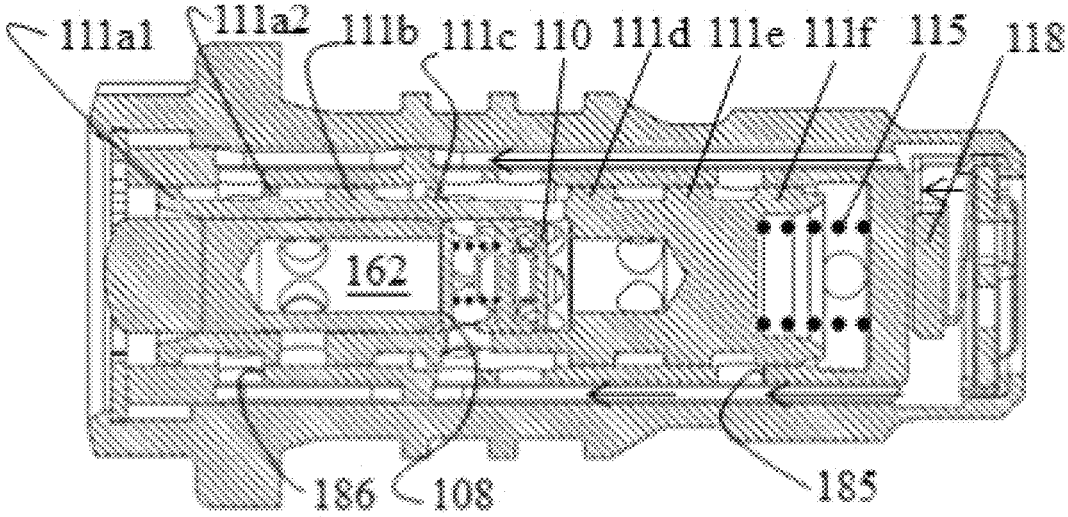
FIG. 15*c* shows a third cross-sectional view of the control valve in the advance position.

FIGS. 15*a*-15*c* show different cross-sections of the control valve in the advance position. Fluid flow from the advance chamber 102 is shown as a dashed line, source fluid flow within the control valve 109 is shown as a solid line, fluid flow to the retard chamber 103 is shown as a dotted line, fluid flow relative to the pilot valve 130 is shown as a dash-dot-dot line, fluid flow venting is shown as a dash-dash-dot line.

The holding position of the phaser preferably takes place between the retard and advance position of the vane 104 relative to the housing assembly 100.

Figure 3:
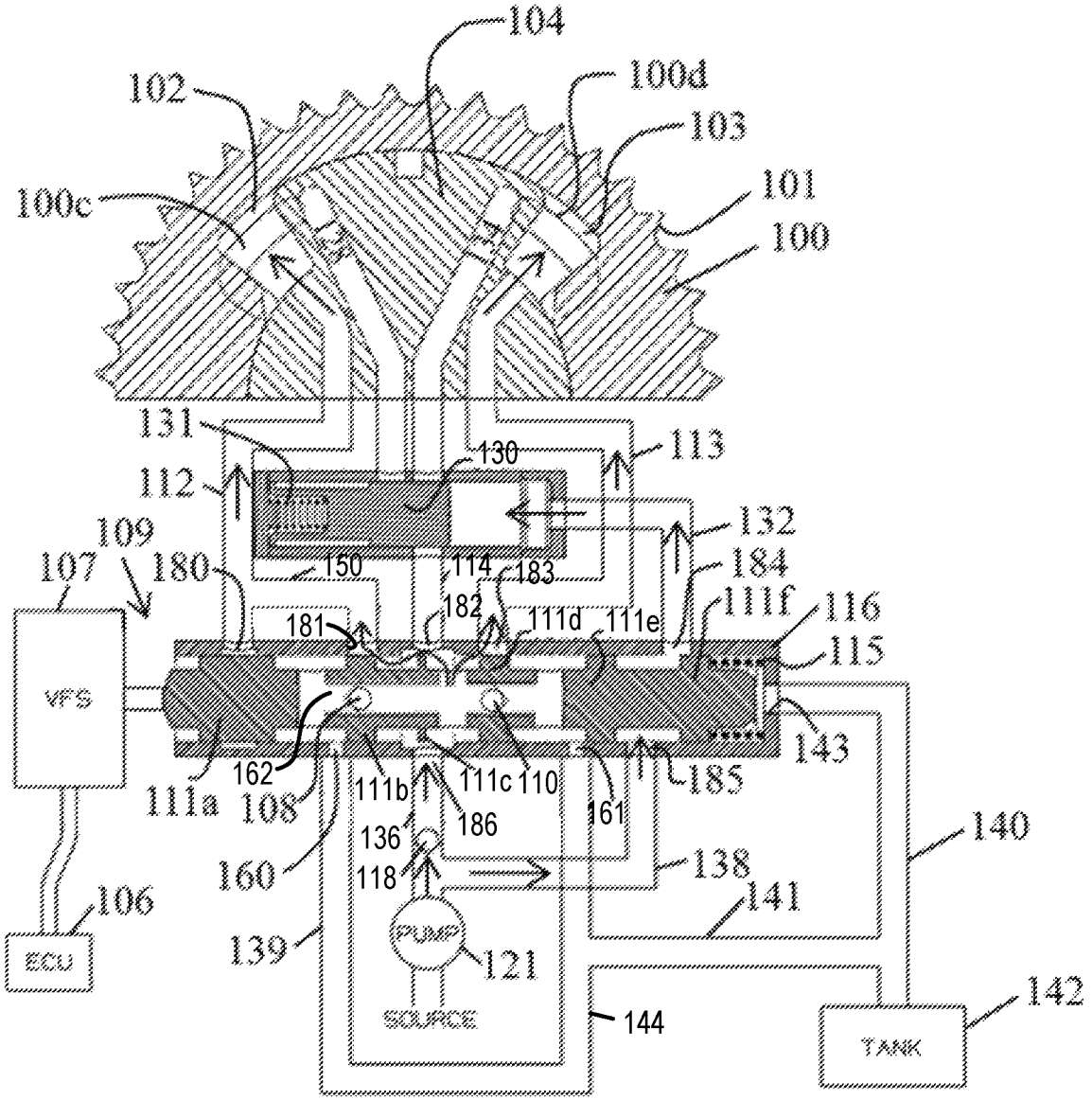
FIG. 3 shows a schematic of the phaser of the first embodiment in a holding position.

FIG. 3 shows the phaser in the holding position. In this position, the duty cycle of the variable force solenoid 107 is 50-60% and the force of the VFS 107 on one end of the spool 111 equals the force of the spring 115 on the opposite end of the spool 111 in holding mode. Land 111*a* blocks the flow of fluid to advance line 112. Makeup oil is supplied to the phaser from source S by pump 121 to make up for leakage and enters line 136 and passes through the inlet check valve 118. From line 136, fluid enters the central passage 162 between spool lands 111*c* and 111*d*. From the central passage 162, fluid flows to the retard line 113 and line 150 to the advance line 112. Fluid also flows from the source S to line 138 to the control valve 109. Fluid flows between spool lands 111*e* and 111*f* to line 132 leading to the pilot valve 130. The fluid in line 132 pressurizes the pilot valve 130 against the spring 131, moving the pilot valve 130 to a position where retard detent line 134 and advance detent line 128 are blocked from common line 114 and from each other.

Figure 17A:
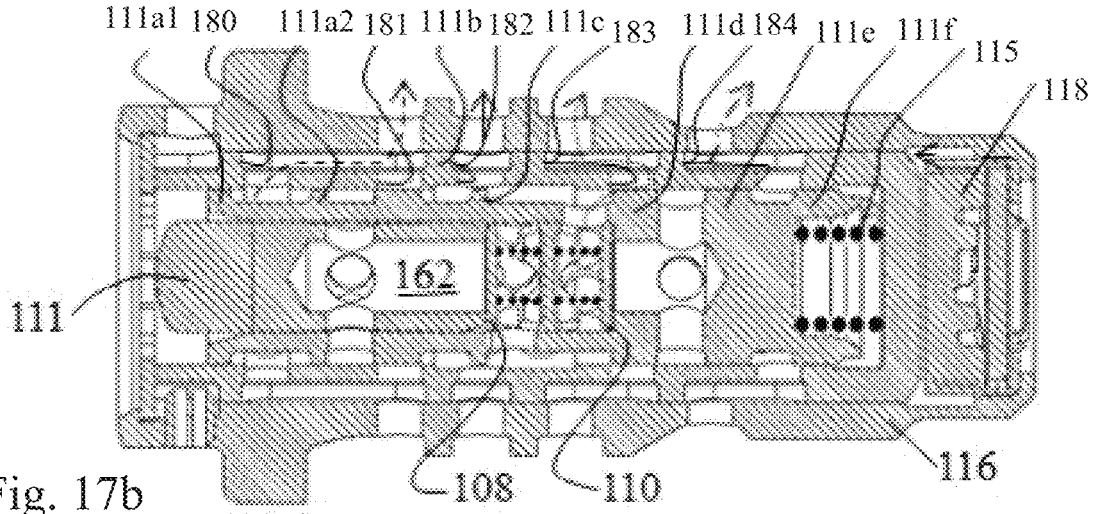
FIG. 17*a* shows a first cross-sectional view of the control valve in the null position.
Figure 17B:
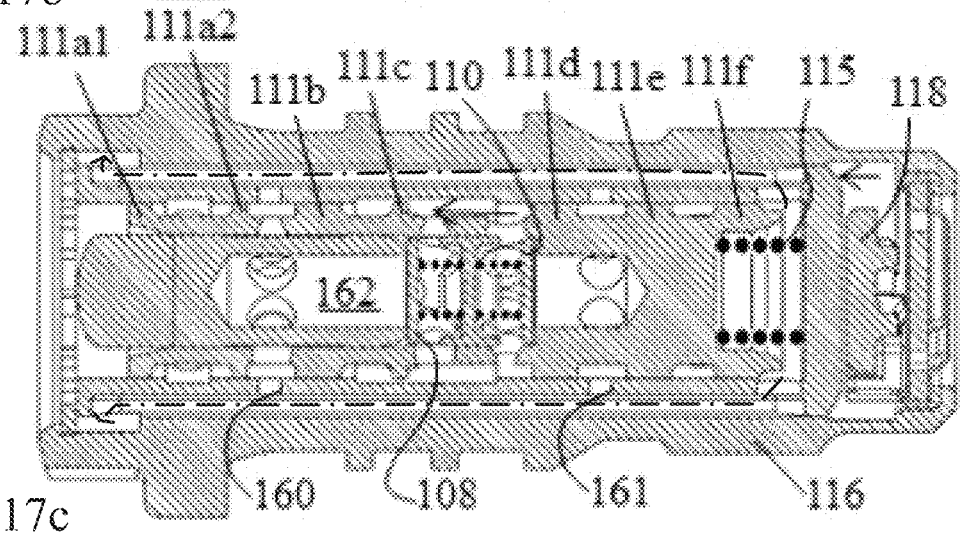
FIG. 17*b* shows a second cross-sectional view of the control valve in the null position.
Figure 17C:
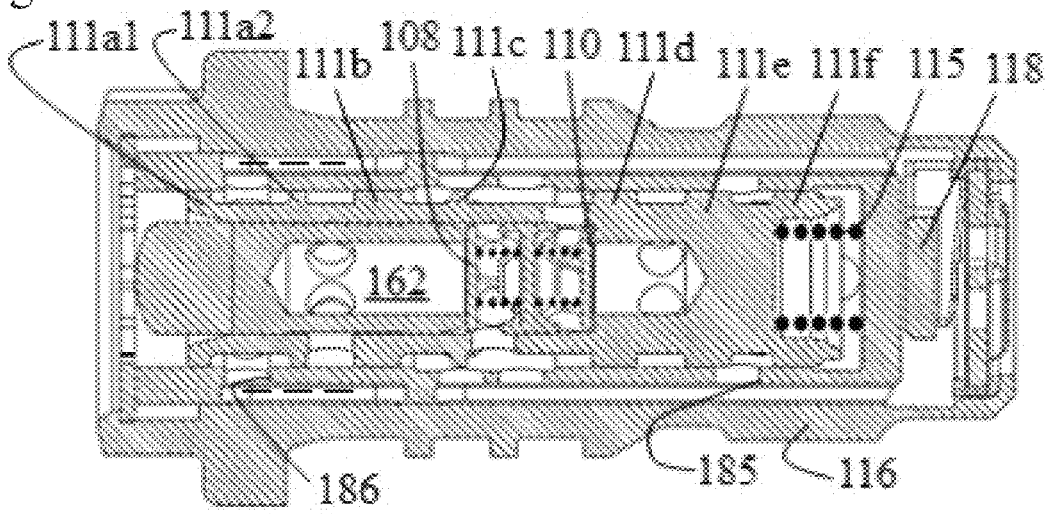
FIG. 17*c* shows a third cross-sectional view of the control valve in the null position.

FIGS. 17*a*-17*c* show different cross-sections of the control valve in the null position. Fluid flow from the advance chamber 102 is shown as a dashed line, source fluid flow within the control valve 109 is shown as a solid line, fluid flow to the retard chamber 103 is shown as a dotted line, fluid flow relative to the pilot valve 130 is shown as a dash-dot-dot line, fluid flow venting is shown as a dash-dash-dot line.

FIG. 4 shows the phaser in the mid-position or intermediate phase angle position, where the duty cycle of the variable force solenoid 107 is 0%, the spool 111 is in detent mode, the pilot valve 130 is vented through the exhaust vent 143 of the spool to passage 140 leading to tank 142 or exhaust, and the hydraulic detent circuit 133 is open or on.

Depending on where the vane 104 was prior to the duty cycle of the variable force solenoid 107 being changed to 0%, either the advance detent line 128 or the retard detent line 134 will be exposed to the advance or retard chamber 102, 103 respectively.

When the duty cycle of the variable force solenoid 107 is just set to 0%, the force of the VFS 107 on the spool 111 is decreased, and the spring 115 moves the spool 111 to the far left end of the spool's travel to a detent mode as shown in the FIG. 4. In the detent mode, spool land 111*b* and 111*c* blocks the flow of fluid from advance lines 112, 150 from entering any of the other lines unless fluid passes through retard recirculating check valve 108, and spool land 111*d* and 111*e* block the flow of fluid from line 132 unless fluid passes through advance recirculating check valve 110, effectively removing control of the phaser from the control valve 109. At the same time, fluid from source may flow through line 136 and inlet check valve 118 into and around spool 111 between spool lands 111*c* and 111*d* to the common line 114. Fluid is prevented from flowing to the pilot valve 130 by spool land 111*f*. Since fluid cannot flow to line 132 in fluid communication with the pilot valve 130, the pilot valve 130 vents to exhaust opening 143 of the control valve 109, opening passage between the advance detent line 128 and the retard detent line 134 through the pilot valve 130 and the common line 114, in other words, opening or turning on the hydraulic detent circuit 133.

Figure 18A:
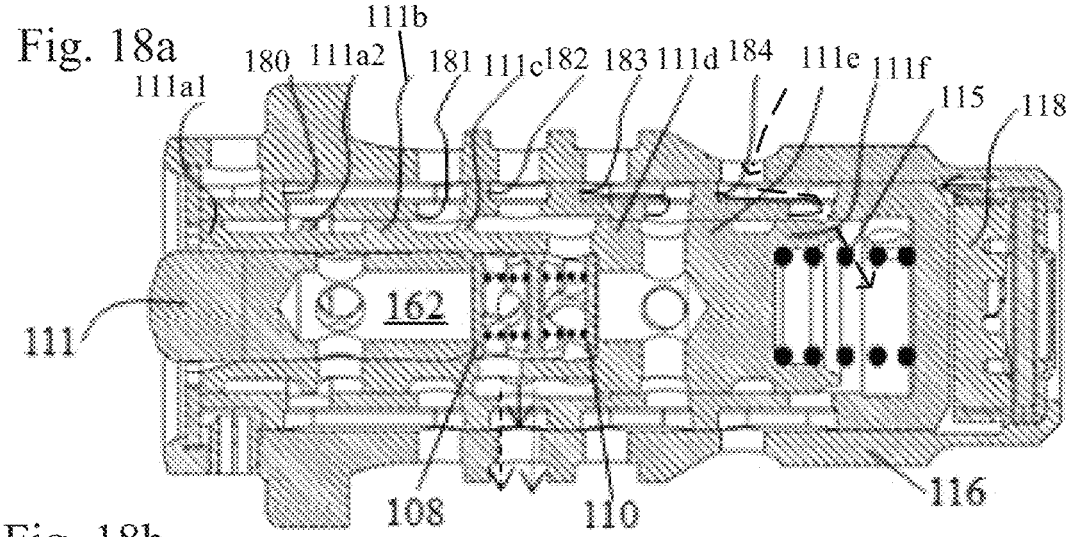
FIG. 18*a* shows a first cross-sectional view of the control valve in the detent position.
Figure 18B:
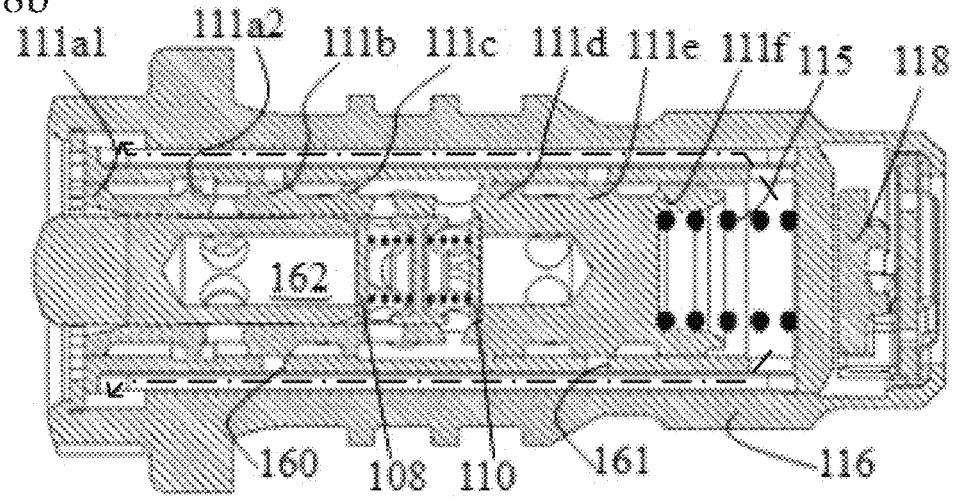
FIG. 18*b* shows a second cross-sectional view of the control valve in the detent position.
Figure 18C:
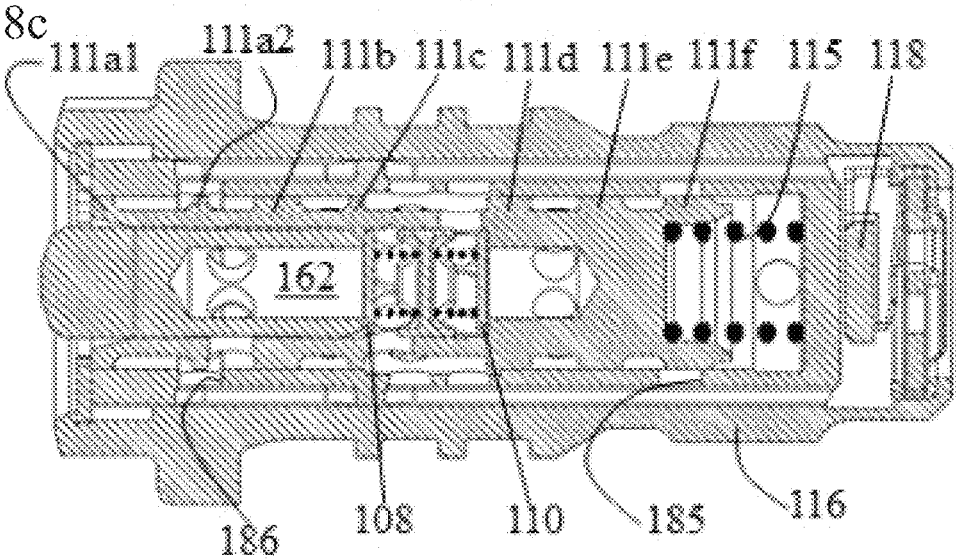
FIG. 18*c* shows a third cross-sectional view of the control valve in the detent position.

FIGS. 18*a*-18*c* show different cross-sections of the control valve in the detent position. Fluid flow from the advance chamber 102 is shown as a dashed line, source fluid flow within the control valve 109 is shown as a solid line, fluid flow to the retard chamber 103 is shown as a dotted line, fluid flow relative to the pilot valve 130 is shown as a dash-dot-dot line, fluid flow venting is shown as a dash-dash-dot line.

Referring to FIG. 6, if the vane 104 was positioned within the housing assembly 100 near or in the advance position, fluid from the advance chamber 102 flows through advance line 112 through port 180 into central passage 162 and through the retard recirculating check valve 108. Fluid then travels through port 182 to common line 114, through the pilot valve 130 and into retard detent line 134. Fluid then travels into rotor metering pocket 103*b* which is aligned with end plate metering pocket 100*d*, and into retard chamber 103. Vane 104 continues to move towards the retard wall 103*a* until rotor metering pocket 103*b* and end plate metering pocket 100*d* become misaligned, placing the phaser in the mid-position or intermediate phase angle position within the chamber 117 formed between the housing assembly 100 and the rotor assembly 105. During this time, advance detent line 128 is closed off to the advance chamber 102 by the clearance between the end plate 100*a* and the rotor assembly 105 until the phaser reaches the mid-position, which is when the rotor metering pocket 102*b* aligns with end plate metering pocket 100*c*, positioning the phaser in the mid-position or intermediate phase angle position within the chamber 117 formed between the housing assembly 100 and the rotor assembly 105.

Referring to FIG. 5, if the vane 104 was positioned within the housing assembly 100 near or in the retard position fluid from the retard chamber 103 will flow through retard line 113 through port 183 into central passage 162 through the advance recirculating check valve 110. Fluid then travels through port 182 to common line 114, through the pilot valve 130 and into advance detent line 128. Fluid then travels into rotor metering pocket 102*b* which is aligned with end plate metering pocket 100*c* and into advance chamber 102. Vane 104 continues to move towards the advance wall 102*a* until rotor metering pockets 102*b* and end plate metering pocket 100*c* become misaligned positioning the phaser in the mid-position or intermediate phase angle position within the chamber 117 formed between the housing assembly 100 and the rotor assembly 105. During this time retard detent line 134 is closed off to the retard chamber 103 by the clearance between the end plate 100*a* and the rotor assembly 105 until the phaser reaches the mid-position, which is then that rotor metering pocket 102*b* aligns with end plate metering pocket 100*d*, positioning the phaser in the mid-position or intermediate phase angle position within the chamber 117 formed between the housing assembly 100 and the rotor assembly 105.

FIGS. 39-42 show another embodiment, similar to the first embodiment, in which the rotor advance and retard metered pockets 102*b*, 103*b* are present on a minor diameter of the rotor assembly 105, instead of a major diameter of the rotor assembly 105. The schematic regarding fluid flow for the phaser shown in FIGS. 39-42 is shown in FIGS. 1-5. By using the minor diameter of the rotor assembly 105 for the metered pockets 102*b*, 103*b*, the phaser package can be reduced in dimension.

Figure 40:
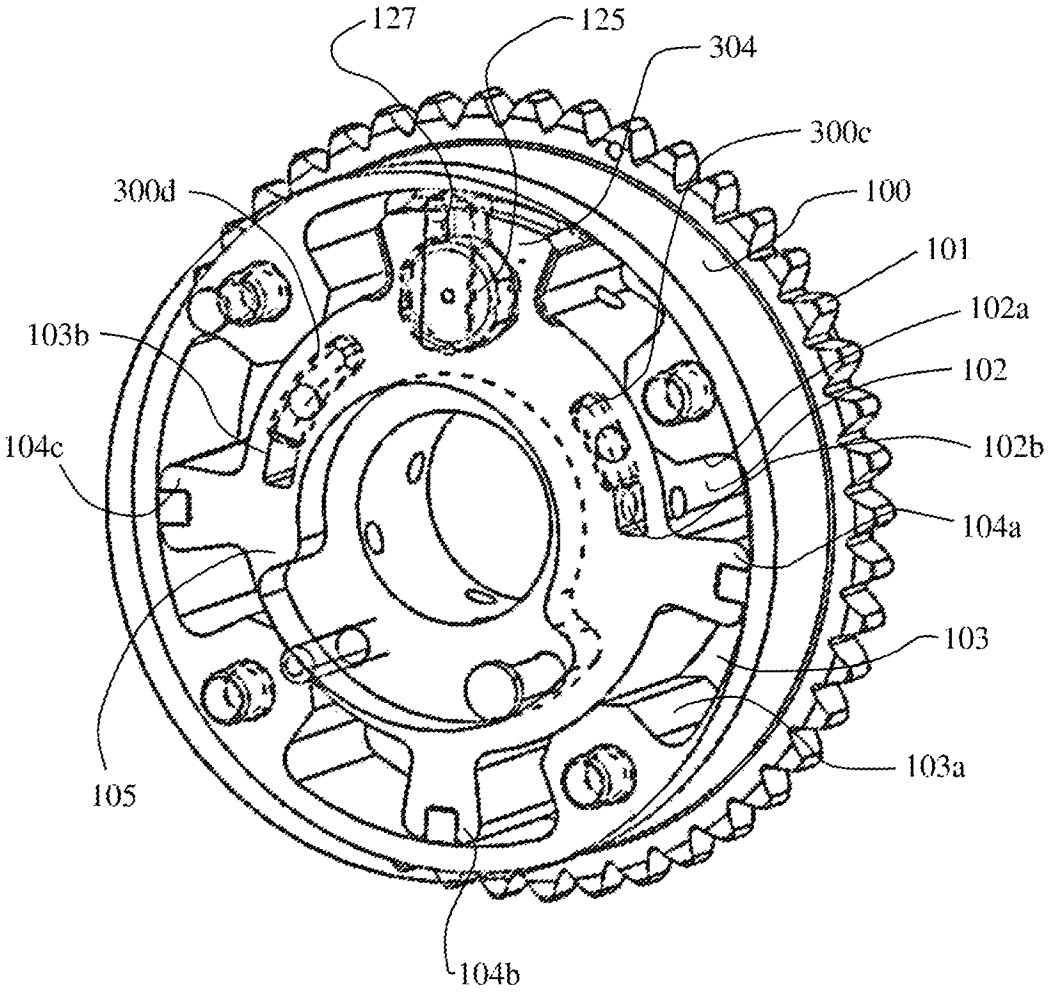
FIG. 40 shows a sectional view of the phaser in a midblock or intermediate locking position.

The housing assembly 100 of the phaser has an outer circumference 101 for accepting drive force as well as a first end plate 100*a* and a second end plate 100*b*. A bias spring 163 may be present on the second end plate 100*b* to bias the rotor assembly towards an advance position. The rotor assembly 105 is connected to the camshaft and is coaxially located within the housing assembly 100. The rotor assembly 105 has at least one active vane 104*a*, 104*b*, 104*c* and a vane 304 which contains a lock pin 125. The active vanes 104*a*-104*c* separating a chamber 117 formed between the housing assembly 100 and the rotor assembly 105 into an advance chamber 102 and a retard chamber 103. The chamber 117 has an advance wall 102*a*, and a retard wall 103*a* which is separated by a distance through an arc 117*a*. Within at least one active vane 104 of the rotor assembly 105 are a rotor advance metered pocket 102*b* and a rotor retard metered pocket 103*b*. In specific positions of the vane 104 relative to an end plate 100*a* or 100*b* of the housing assembly 100, end plate metered pockets 300*c*, 300*d* align with either of the rotor advance metered pocket 102*b* or the rotor retard metered pocket 103*b* to allow fluid to recirculate between the chambers 102, 103 through a pilot valve 130 in the midlock or intermediate position as shown in FIG. 40. The active vanes 104*a*-104*c* are capable of rotation to shift the relative angular position of the housing assembly 100 and the rotor assembly 105. Additionally, a hydraulic detent circuit 133 is also present.

The hydraulic detent circuit 133 includes a spring 131 loaded pilot valve 130, an advance detent line 128 that connects the advance chamber 102 to the pilot valve 130 and the common line 114 via the rotor advance metered pocket 102*b*, and a retard detent line 134 that connects the retard chamber 103 to the pilot valve 130 and the common line 114 via the rotor retard metered pocket 103*b*. An advance detent line 128 is present within one of the active vanes 104*c* and the retard detent line 134 is present within the active vane 104*a*.

A control valve 109, preferably a spool valve, includes a spool 111 with cylindrical lands 111*a*, 111*b*, 111*c*, 111*d*, 111*e* and 111*f* slidably received in a sleeve 116 within a bore in the rotor assembly 105 and pilots in the camshaft (not shown). The spool 111 also includes a retard recirculating check valve 108 and an advance recirculating check valve 110 within a central passage 162 of the spool 111.

The control valve 109 may be located remotely from the phaser, within a bore in the rotor assembly 105 which pilots in the camshaft, or in a center bolt of the phaser. One end of the spool contacts spring 115 and the opposite end of the spool 111 contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-186 and vent orifices 160-161 acting as tunable exhaust ports. The port 180 is in fluid communication with the advance line 112. Port 181 is in fluid communication with line 150. Port 182 is in fluid communication with common line 114. Port 183 is in fluid communication with retard line 113. Port 184 is in fluid communication the pilot valve 130 of the hydraulic detent circuit 133. Port 185 is in communication with line 138. Vent orifice 161 is in communication with tank 142 through line 139. Port 186 is in fluid communication with line 136. Vent orifice 160 is in communication with tank 142 through line 139.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 is open (on) or closed (off). In other words, the position of the spool 111 actively controls the pilot valve 130. The control valve 109 has an advance mode, a retard mode, a null mode (holding position), a detent mode.

Figure 39:
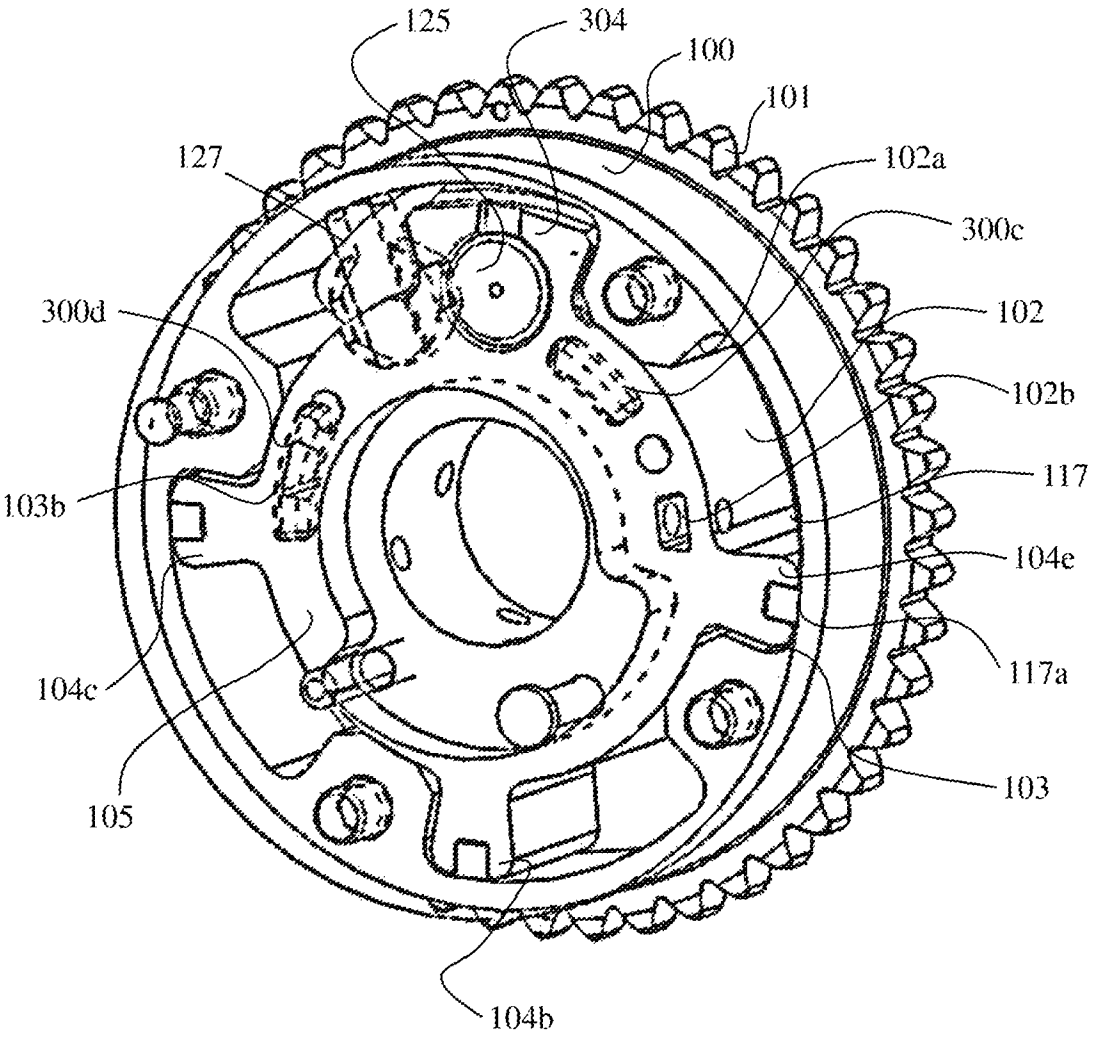
FIG. 39 shows a sectional view of a phaser of another embodiment in an advance position moving towards an intermediate position.

Referring to FIG. 39, in the advance mode, the spool 111 is moved to a position so that fluid may flow from the retard chamber 103 into the spool 111 and through the advance recirculating check valve 110 into advance line 112 and into advance chamber 102 or to sump or tank 142 via a tunable exhaust port or vent orifice 161 and through line 144 and line 141. Fluid is blocked from exiting the advance chamber 102, and the detent valve circuit 133 is off or closed.

Figure 41:
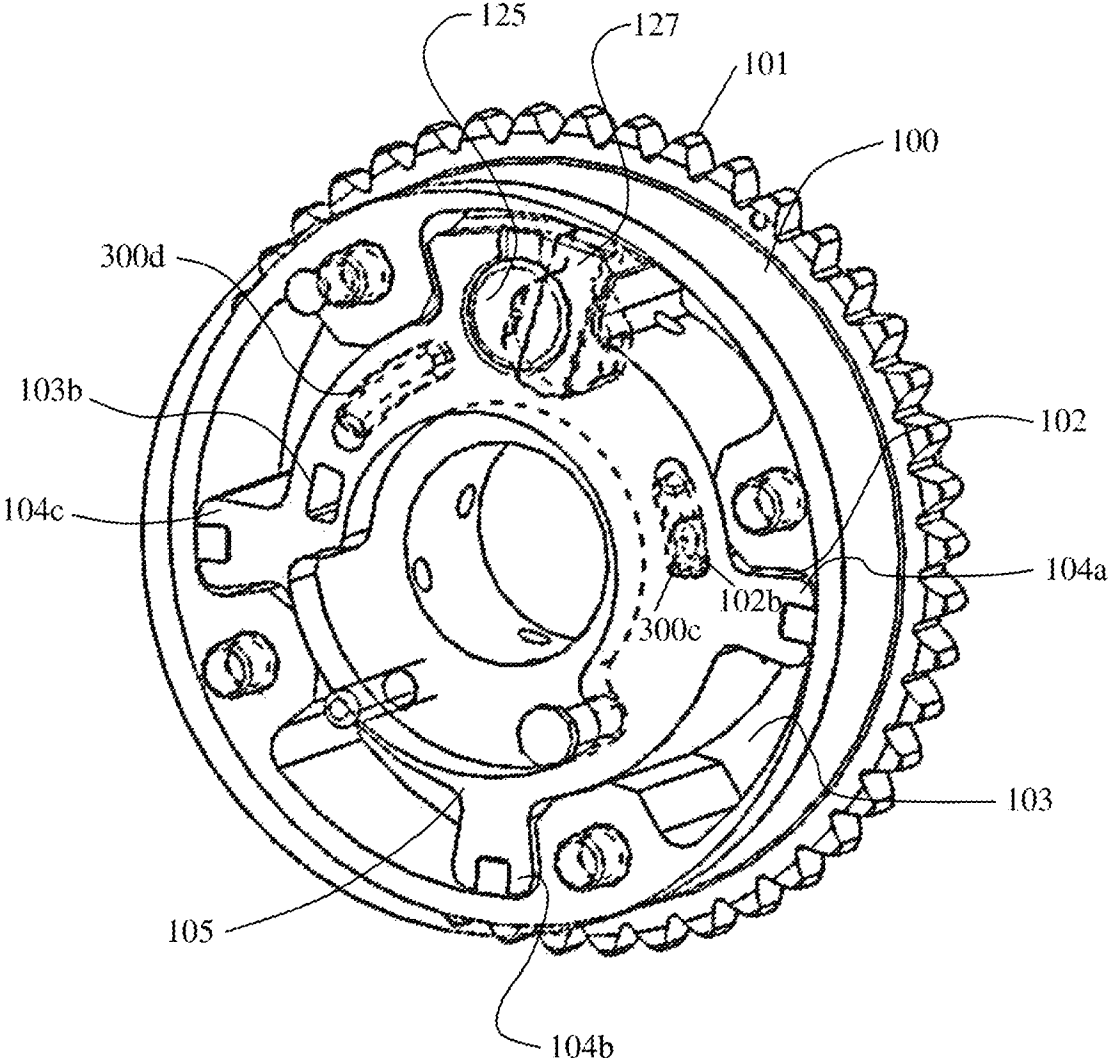
FIG. 41 shows a sectional view of the phaser in a retard position moving towards an intermediate position.
Figure 42:
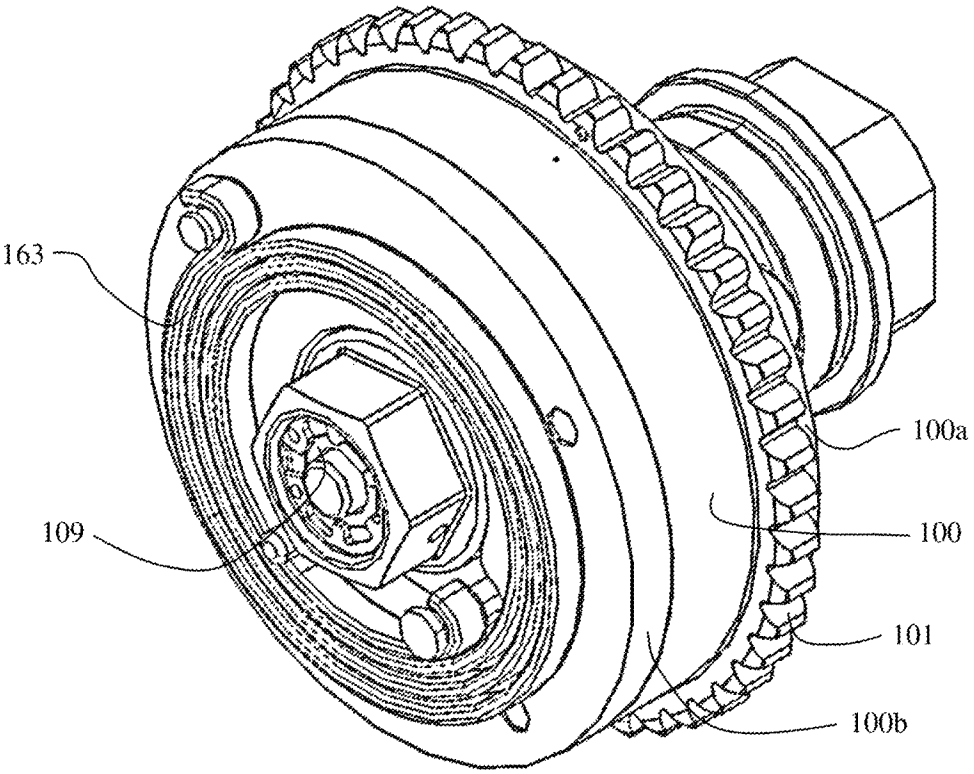
FIG. 42 shows a perspective view of the phaser.

Referring to FIG. 41, in the retard mode, the spool 111 is moved to a position so that fluid may flow from the advance chamber 102 through the spool 111 and through the retard recirculating check 108 into retard line 113 and into the retard chamber 103 or to sump or tank 142 via a tunable exhaust port or vent orifice 160 and through line 139 and line 141. Fluid is blocked from exiting the retard chamber 103 and the detent valve circuit 133 is off.

In null mode, the spool 111 is moved to a position that blocks the exit of fluid from the advance and retard chambers 102, 103 to the tank 142, and the detent valve circuit 133 is off.

Referring to FIG. 40, in the detent mode, the spool 111 moves to a position in which spool land 111*b* blocks the flow of fluid from advance line 112 to tank 142, spool land 111*e* blocks the flow of fluid from retard line 113 to tank 142, spool lands 111*c* and 111*d* block fluid from exiting either advance line 112 and retard line 113 to each other, effectively removing control of the phaser from the control valve 109. At the same time, any fluid that does exit the advance chamber 102 can flow through advance line 112 through port 180 to between spool lands 111*a* and 111*b* to central passage 162. Fluid flows through the retard recirculating check valve 108 within the central passage 162 and through port 182 to common line 114. From common line 114, fluid can flow through the pilot valve 130 and enter either the advance detent line 128 or the retard detent line 134. Any fluid that exits the retard chamber 103 can flow through retard line 113 through port 183 to central passage 162. Fluid flows through the advance recirculating check valve 110 within the central passage 162 and through port 182 to common line 114. From the common line 114 fluid can flow through the pilot valve 130 and enter either the advance detent line 128 or the retard detent line 134.

Also in the in the detent mode, the detent valve circuit 133 is opened or turned on. The detent valve circuit 133 has complete control over the phaser moving to advance or retard, until the active vane 104*a*-104*c* reaches the intermediate phase angle position.

Additionally in the intermediate phase angle position or mid-position, where the active vanes 104*a*-104*c* is somewhere between the advance wall 102*a* and the retard wall 103*a* defining the chamber 117 between the housing assembly 100 and the rotor assembly 105, the advance detent line 128 and metering pocket 300C overlap and the retard detent line 134 and metering pocket 300D overlap on the minor axis of the rotor assembly 105. The intermediate phase angle position can be anywhere between the advance wall 102*a* and retard wall 103*a* and is determined by where the advance detent line 128 and metering pocket 300C overlap and the retard detent line 134 and metering pocket 300D overlap.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133 and vent the pilot valve 130, since if power or control is lost, the phaser will default to a locked position. It should be noted that the duty cycle percentages listed above are an example and they may be altered. Furthermore, the hydraulic detent circuit 133 may be open and the pilot valve 130 vented at 100% duty cycle, if desired.

When the duty cycle of the variable force solenoid 107 is just set to 0%, the force on the VFS on the spool 111 is decreased, and the spring 115 moves the spool 111 to the far left end of the spool's travel to a detent position as shown in the Figures. In this detent position, spool land 111*b* blocks the flow of fluid from advance line 112 in between spool lands 111*a* and 111*b* from exhausting to tank 142 through exhaust line 139 and spool land 111*d* blocks the flow of fluid from retard line 113 from exhausting to tank 142 through exhaust line 139, spool lands 111*c* and 111*d* block fluid from exiting either advance line 112 and retard line 113 to each other, effectively removing control of the phaser from the control valve 109. At the same time, fluid from source may flow through line 136 and inlet check valve 118 to the common line 114 between spool lands 111*c* and 111*d*. Fluid from advance line 112 can however pass through the central passage 162, retard recirculating check valve 108, and flow to the common line 114 between spool lands 111*c* and 111*d*. Fluid from retard line 113 can also pass through the central passage 162 and advance recirculating check valve 110 and flow to the common line 114 between spool lands 111*c* and 111*d*.

Fluid is prevented from flowing through line 132 to the pilot valve 130 by spool land 111*f*. Since fluid cannot flow to line 132, the fluid vents through the spool 111 to exhaust orifice 143 at the end of the sleeve 116, opening passage between the advance detent line 128 and the retard detent line 134 through the pilot valve 130 to the common line 114, in other words opening the hydraulic detent circuit 133.

FIGS. 19-24 show the operating modes of a switchable VCT phaser of a second embodiment depending on the spool valve position. The positions shown in the figures define the direction the VCT phaser is moving to. It is understood that the oil control valve has an infinite number of intermediate positions, so that the control valve not only controls the direction the VCT phaser moves but, depending on the discrete spool position, controls the rate at which the VCT phaser changes positions. Therefore, it is understood that the oil control valve can also operate in infinite intermediate positions and is not limited to the positions shown in the Figures.

In this embodiment, the TA or OPA VCT phasers can have one or more working chambers which operate in a cam torque actuated (CTA) operating mode. The invention utilizes the control valve in a detent mode and a hydraulic detent circuit to direct the VCT phaser in either direction, advance or retard, to reach the mid lock position and, if so desired, to engage a lock pin at that mid lock position. The following description and embodiments are described in terms of a torsion assisted (TA) phaser, which has one or more check valves in oil source lines, but it will be understood that they are also applicable to an oil pressure actuated phaser. An offset or remote pilot valve is added to a hydraulic circuit of a torsion assist or oil pressure actuated phaser to manage the hydraulic detent switching function. The fluid supplying pressure to move the pilot valve from a first position to a second position also supplies fluid to the lock pin which in a locked position, locks the housing assembly relative to the rotor assembly at mid-position.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor assembly 205 with one or more vanes 204, mounted to the end of the camshaft (not shown), surrounded by a housing assembly 200 with the vane chambers into which the vanes fit. It is possible to have the vanes 204 mounted to the housing assembly 200, and the chambers in the rotor assembly 205, as well. The housing's outer circumference 201 forms the sprocket, pulley or gear accepting drive force through a chain, belt, or gears, usually from the crankshaft, or possible from another camshaft in a multiple-cam engine.

The housing assembly 200 of the phaser has an outer circumference 201 for accepting drive force. The rotor assembly 205 is connected to the camshaft and is coaxially located within the housing assembly 200. The rotor assembly 205 has a vane 204 separating a chamber 217 formed between the housing assembly 200 and the rotor assembly 205 into an advance chamber 202 and a retard chamber 203. The chamber 217 has an advance wall 202*a*, and a retard wall 203*a* which is separated by a distance through an arc 217*a*. A portion of the arc 217*a* of the chamber 217 seals the metered edges 204*a*, 204*b* of vane 204. The vane 204 is capable of rotation to shift the relative angular position of the housing assembly 200 and the rotor assembly 205. The vane 204 has metered edges 204*a* and 204*b* which can be sealed by the arc 217*a* of the chamber 217. The metered edge 204*a*-204*b* are preferably the metering position for mid-park. At the metering edges 204*a*-204*b*, a slight underlap is present in advance and retard detent lines 228, 234 until the phaser either moves in the advance direction or the retard direction, closing off one of the metering edges and exposing the other. By sealing the advance and retard detent lines 228, 234 with the metered edges 204*a*, 204*b* the advance and retard detent lines 228, 234 within the vane 204 are sealed off from the advance chamber 202 and the retard chamber 203 As the vane 204 rotates, the metered edges 204*a*, 204*b* are sealed and unsealed exposing the advance and retard detent lines 228, 234 to the advance or retard chambers 202, 203. Additionally, a hydraulic detent circuit 233 and a lock pin circuit 223 are also present. The hydraulic detent circuit 233 and the lock pin circuit 223 are essentially one circuit, but will be discussed separately for simplicity.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The advance detent line 228 and the retard detent line 234 are present within the vane 204.

The lock pin 225 is slidably housed in a bore in the rotor assembly 205 and has an end portion that is biased towards and fits into a recess 227 in the housing assembly 200 by a spring 224. Alternatively, the lock pin 225 may be housed in the housing assembly 200 and be spring 224 biased towards a recess 227 in the rotor assembly 205. The opening and closing of the hydraulic detent circuit 233 and pressurization of the lock pin circuit 223 are both controlled by the switching/movement of the oil control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-288 and vent orifices 260-261 acting as tunable exhaust ports. The port 280 is in fluid communication with the advance line 212. Port 281 is in fluid communication with line 250. Port 282 is in fluid communication with common line 214. Port 283 is in fluid communication with retard line 213. Port 284 is in fluid communication the lock pin circuit 223 and the hydraulic detent circuit 233. Port 285 is in communication with line 238. Vent orifice 261 is in communication with tank 242 through line 239. Port 286 is in fluid communication with line 237. Port 287 is in fluid communication with line 236. Port 288 is in fluid communication with line 235. Vent orifice 260 is in communication with tank 242 through line 239.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the lock pin circuit 223 and the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 into the spool 211 and to sump or tank 242 via exhaust line 239 and line 241. Fluid is blocked from exiting the advance chamber 202, and the detent valve circuit 233 is off or closed. The lock pin 225 is in an unlocked position.

In the retard mode, the spool 211 is moved to a position so that fluid may flow from the advance chamber 202 through the spool 211 and to sump or tank 242 via exhaust line 239 and line 241. Fluid is blocked from exiting the retard chamber 203 and the detent valve circuit 233 is off. The lock pin 225 is in an unlocked position.

In null mode, the spool 211 is moved to a position that blocks the exit of fluid from the advance and retard chambers 202, 203 to the tank 242, and the detent valve circuit 233 is off. In the null mode the lock pin 225 is in an unlocked position.

In the detent mode, three functions occur simultaneously. The first function in the detent mode is that the spool 211 moves to a position in which spool land 211*b* blocks the flow of fluid from advance line 212 to tank 242, spool land 211*e* blocks the flow of fluid from retard line 213 to tank 242, spool lands 211*c* and 211*d* block fluid from exiting either advance line 212 and retard line 213 to each other, effectively removing control of the phaser from the control valve 209. At the same time, any fluid that does exit the advance chamber 202 can flow through advance line 212 to port 280 between spool lands 211*a* and 211*b*, to line 235. From line 235, fluid flows through retard recirculating check valve 208 to line 236, between spool lands 211*c* and 211*d* to common line 214. Any fluid that does exit the retard chamber 203 can flow through retard line 213 to port 283 between spool lands 211*d* and 211*e* to line 237. From line 237 fluid flows through the advance recirculating check valve 210 and through to port 286 and between spool lands 211*c* and 211*d* and to the common line 214 through port 282. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function is the intermediate phase angle position or mid-position is where the vane 204 is somewhere between the advance wall 202*a* and the retard wall 203*a* defining the chamber 217 between the housing assembly 200 and the rotor assembly 205. The intermediate phase angle position can be anywhere between the advance wall 202*a* and retard wall 203*a* and is determined by where the advance and retard detent lines 228 and 234 are within the vane 204. Also in the third function, the lock pin circuit 223 is vented, allowing the lock pin 225 to engage the recess.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed, and the lock pin 225 will be pressurized and released.

When the duty cycle of the variable force solenoid 207 is 0%, the spool 211 is moved to the detent mode such that the pilot valve 230 vents and moves to the second position, the hydraulic detent circuit 233 will be open, and the lock pin 225 vented and engaged with the recess 227. A duty cycle of 0% was chosen as the extreme position along the spool 211 stroke to open the hydraulic detent circuit 233, vent the pilot valve 230, and vent and engage the lock pin 225 with the recess 227, since if power or control is lost, the phaser will default to a locked position. It should be noted that the duty cycle percentages listed above are an example and they may be altered. Furthermore, the hydraulic detent circuit 233 may be open, the pilot valve 230 vented, and the lock pin 225 vented and engaged with the recess 227 at 100% duty cycle, if desired.

In order for the phaser to be in detent position with the lock pin 225 in a locked position, the duty cycle of the VFS is set to 0%. The lock pin 225 will remain in a locked position as the duty cycle is increased up to 40%.

The detent position is ideal for a cold start of the engine since the phaser is locked with the vane 204 in an intermediate position between a full advance position and a full retard position. The "full advance position" is defined as the position at which the vane 204 contacts the advance wall 202*a*, and the "full retard position" is defined as the vane 204 contacting the retard wall 203*a*. The detent position can also provide an ideal or optimized compression ratio at ignition for starting the engine, for example approximately 8:1. When the phaser in a full retard position, when the ignition fires the spark the compression ratio is too low to start the engine for a cold start, and when the phaser is in an advance position, the compression ratio is too high to start the engine for a cold start.

When the duty cycle of the variable force solenoid 207 is just set to 0%, the force on the VFS on the spool 211 is decreased, and the spring 215 moves the spool 211 to the far left end of the spool's travel to a detent position as shown in the Figures. In this detent position, spool land 211*b* blocks the flow of fluid from advance line 212 in between spool lands 211*a* and 211*b* from exhausting to tank 242 through exhaust line 239 and spool land 211*e* blocks the flow of fluid from retard line 213 from exhausting to tank 242 through exhaust line 239, spool lands 211*c* and 211*d* block fluid from exiting either advance line 212 and retard line 213 to each other, effectively removing control of the phaser from the control valve 209. At the same time, fluid from source may flow through line 236 and inlet check valve 218 to the common line 214 between spool lands 211*c* and 211*d*. Fluid from advance line 212 can pass through line 235, retard recirculating check valve 208 and enter line 235 and to the common line 214 between spool lands 211*c* and 211*d*. Fluid from retard line 213 can also pass through line 237, advance recirculating check valve 210 and enter line 235 to the common line 214 between spool lands 211*c* and 211*d*.

Fluid is prevented from flowing through line 238 to the lock pin 225 by spool land 211*f*. Since fluid cannot flow to line 235, the lock pin 225 is no longer pressurized and vents through the spool 211 to exhaust orifice 243 at the end of the sleeve 216. Similarly, the pilot valve 230 also vents to exhaust orifice 243 at the end of the sleeve 216, opening passage between the advance detent line 228 and the retard detent line 234 through the pilot valve 230 to the common line 214, in other words opening the hydraulic detent circuit 233.

Figure 22:
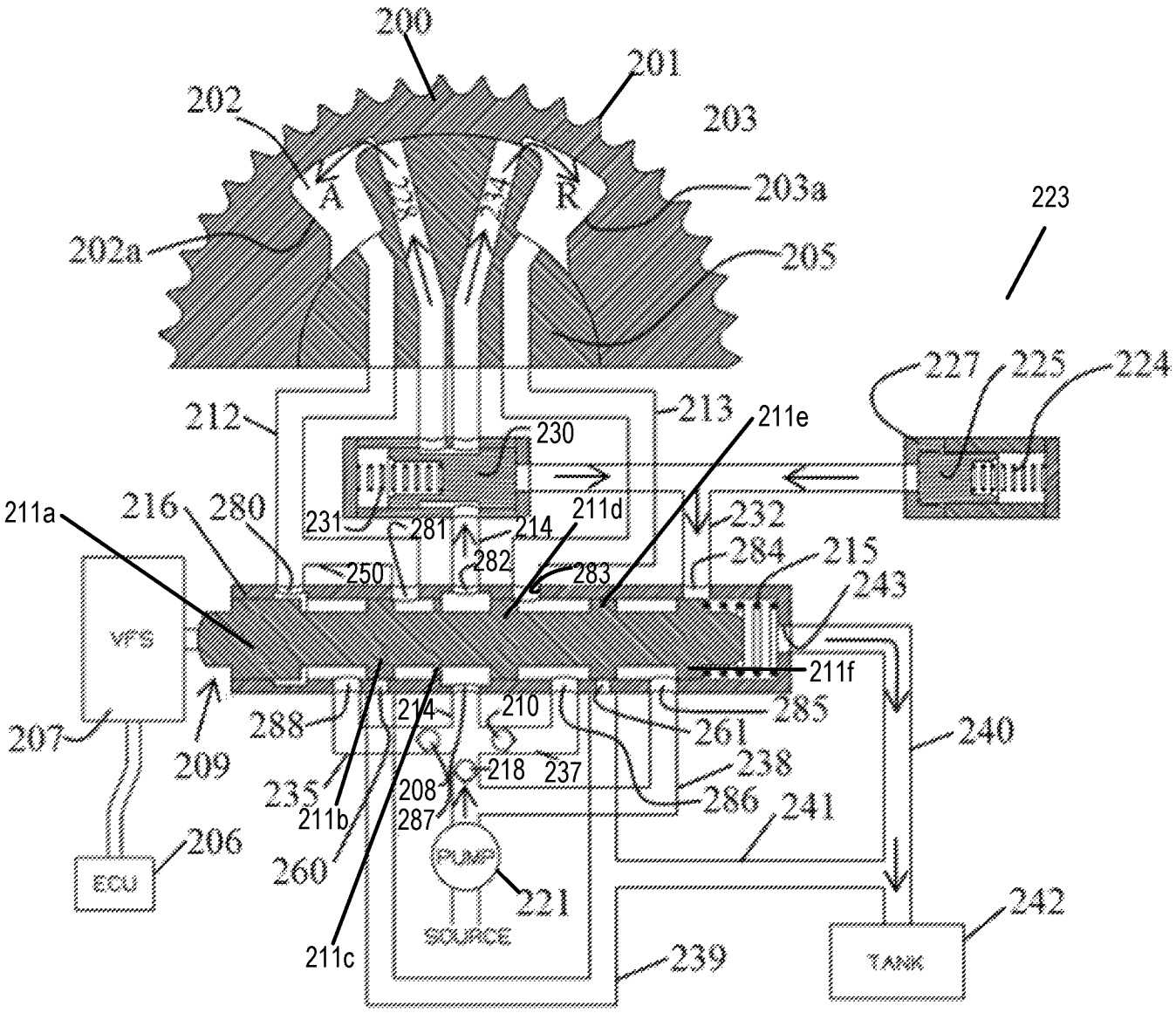
FIG. 22 shows a schematic of the phaser of the second embodiment in a midlock or intermediate locking position.
Figure 23:
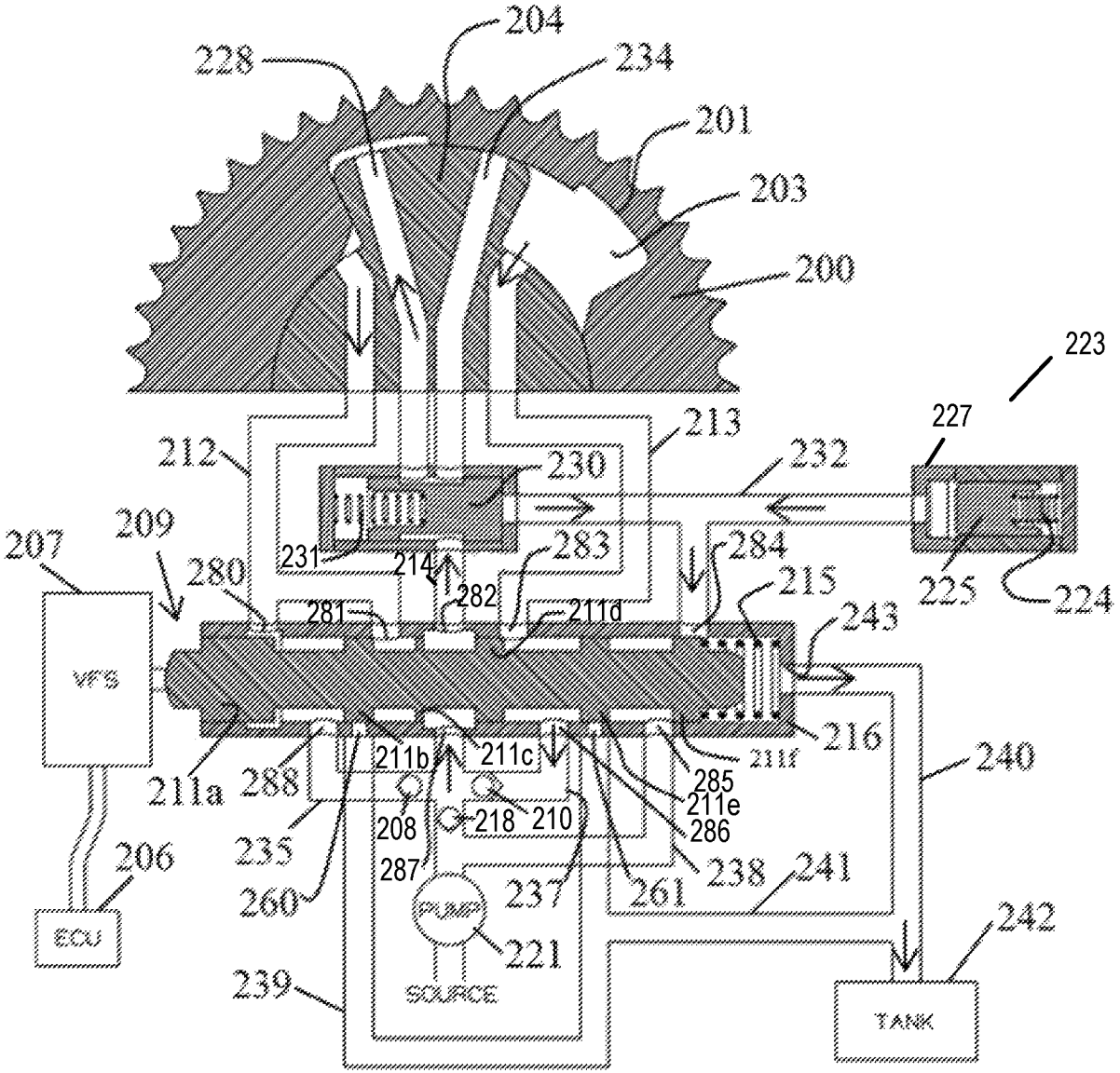
FIG. 23 shows a schematic of the phaser of the second embodiment in a retard position moving towards the mid-lock or intermediate locking position.
Figure 24:
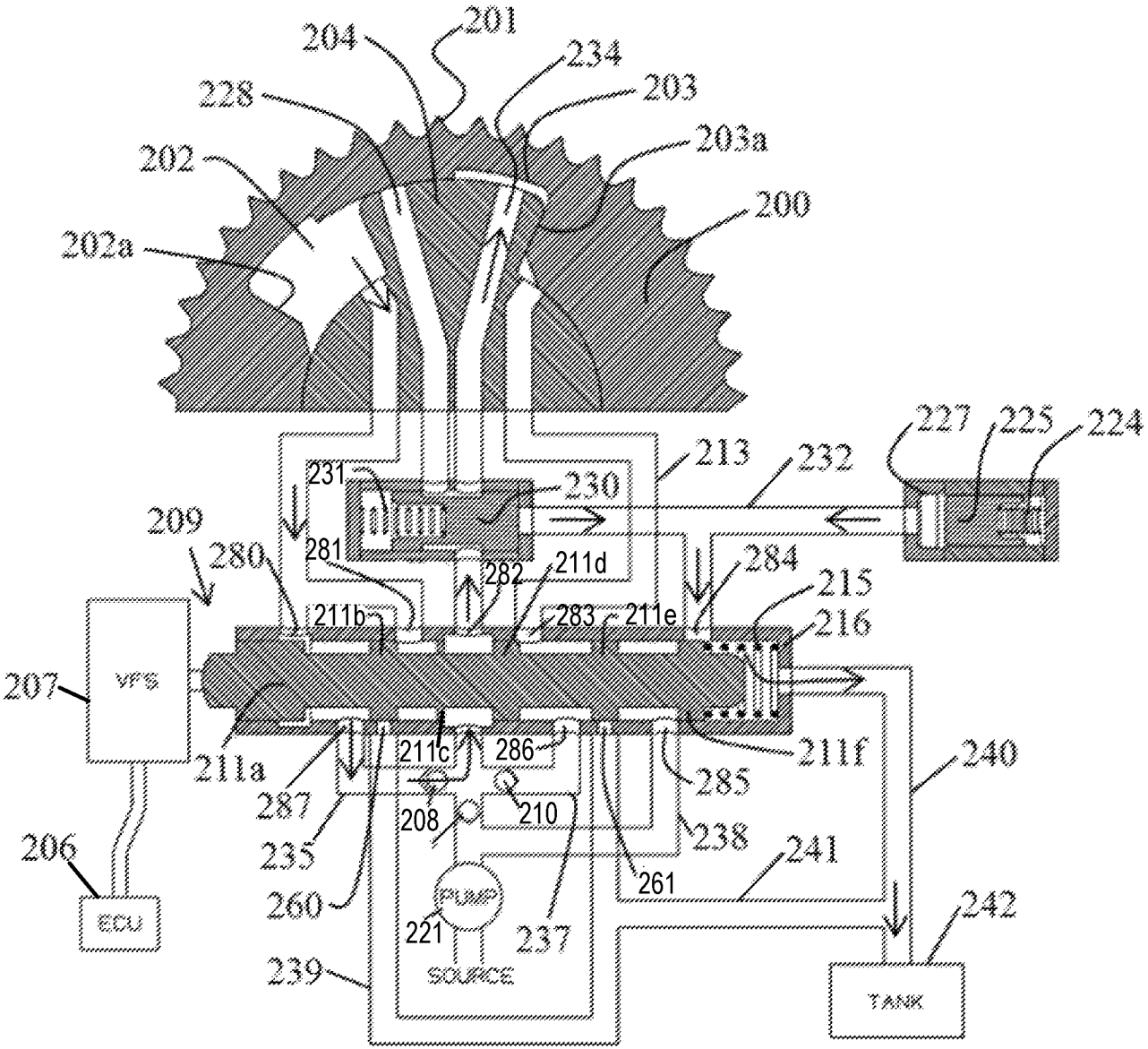
FIG. 24 shows a schematic of the phaser of the second embodiment in an advance position moving towards the midlock or intermediate locking position.

Referring to FIGS. 22-24, when the duty cycle of the variable force solenoid 207 is 0%, the spool is in detent mode, the pilot valve 230 is vented, the hydraulic detent circuit 233 is open or on, and the lock pin circuit 223 is off or closed, the lock pin 225 is vented and engages with a recess 227, and the rotor assembly 205 is locked relative to the housing assembly 200 in a mid-position or an intermediate phase angle position. Depending on where the vane 204 was prior to the duty cycle of the variable force solenoid 207 being changed to 0%, either the advance detent line 228 or the retard detent line 234 will be exposed to the advance or retard chamber 202, 203 respectively.

In addition, if the engine had an abnormal shut down (e.g. the engine stalled), when the engine is cranking, the duty cycle of the variable force solenoid 207 would be 0%, the rotor assembly 205 would move via the detent circuit 233 to a mid lock position or an intermediate phase angle position and the lock pin 225 would be engaged in mid-position or intermediate phase angle position regardless of what position the vane 204 was in relative to the housing assembly 200 prior to the abnormal shut down of the engine.

The ability of the phaser of the present invention to default to a mid-position or intermediate phase angle position without using electronic controls allows the phaser to move to the mid-position or intermediate phase angle position even during engine cranking when electronic controls are not typically used for controlling the cam phaser position. In addition, since the phaser defaults to the mid-position or intermediate phase angle position, it provides a fail safe position, especially if control signals or power or lost, that guarantees that the engine will be able to start and run even without active control over the VCT phaser. Since the phaser has the mid-position or intermediate phase angle position upon cranking of the engine, longer travel of the phase of the phaser is possible, providing calibration opportunities. In the prior art, longer travel phasers or a longer phase angle is not possible, since the mid-position or intermediate phase angle position is not present upon engine cranking and startup and the engine has difficulty starting at either the extreme advance or retard stops.

If the vane 204 was positioned within the housing assembly 200 near or in the retard position (FIG. 23), fluid from the retard chamber 203 flows through retard line 213 to the control valve 209 through port 283. From the control valve 209, fluid flows through line 237 and advance recirculating check valve 210 to line 236 and enters the control valve 209 through port 286. From the control valve 209, fluid enters common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber 202 by the metered edge 204*a* being sealed by the arc 217*a* of the housing 200 and the vane 204 is moved to an intermediate phase angle position or a mid-position within the chamber 217 formed between the housing assembly 200 and the rotor assembly 205. The lock pin 225 aligns with the recess 227, locking the rotor assembly 205 relative to the housing assembly 200 in a mid-position or an intermediate phase angle position.

If the vane 204 was positioned within the housing assembly 200 near or in the advance position (see FIG. 24), fluid from the advance chamber 202 flows through advance line 212 to the control valve 209 through port 280. From the control valve 209, fluid flows through line 235 and retard recirculating check valve 208 to line 236 and enters the control valve 209 through port 286. From the control valve 209, fluid enters common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205. The lock pin 225 aligns with the recess 227, locking the rotor assembly 205 relative to the housing assembly 200 in a mid-position or an intermediate phase angle position.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*, requiring that the lock pin 225 engages the recess 227 at the precise time in which the advance detent line 228 or the retard detent line 234 are closed off by the metered edges 204*a*, 204*b* from their respective chambers.

When the duty cycle is set between 60-100%, the vane 204 of the phaser is moving toward and/or in a retard position.

Having the phaser in a retard position is ideal for a hot or warm restart since a lower compression ratio can be used to restart the engine. By placing the phaser in a full retard position and therefore using a lower compression ratio, the efficiency of the engine restart is increased, the vibration of the engine during the engine restart is minimized, the work load on the starter is minimized, and the time for the engine to restart is accelerated.

Figure 20:
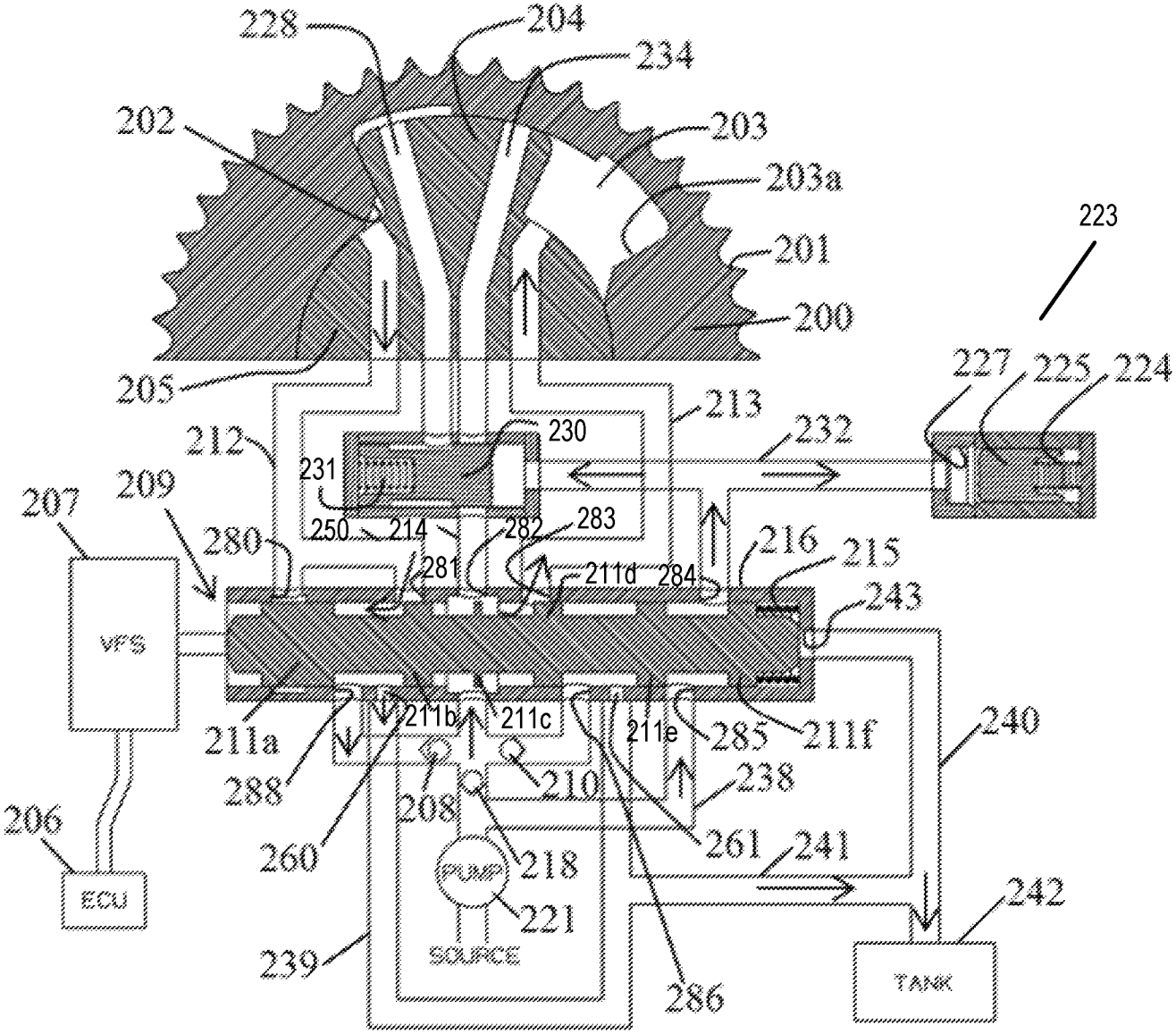
FIG. 20 shows a schematic of the phaser of the second embodiment in a retard position.

Referring to FIG. 20, to move towards the retard position, the duty cycle is adjusted to greater than 60%, the force of the VFS 207 on the spool 211 is changed and the spool 211 is moved to the right in a retard mode in the figure by VFS 207, until the force of VFS 207 balances the force of the spring 214. Fluid exits from the advance chamber 202 through advance line 212 to line 250 and the control valve 209 to port 281. From port 281, fluid flows between spool lands 211*a* and 211*b*. From the control valve 209, fluid flows into line 235 and through the retard recirculating check valve 208, to line 236 and into the control valve 209 between spool lands 211*c* and 211*d*. From the control valve 209, fluid flows to retard line 213 and to the retard chamber 203. Some of the fluid from the advance chamber 202 exits through vent orifice 260 and flows to tank 242. It should be noted that the amount of fluid which vents through vent orifice 260 and the amount of fluid that recirculates to the retard chamber 203 is based on the size of the vent orifice 260. It the vent orifice 260 is very small or restricted, more fluid will recirculate from the advance chamber 202 to the retard chamber 203 and the phaser will function more similarly to a cam torque actuated phaser. If the vent orifice 260 is large, the phaser will function more similarly to an oil pressure actuated or torsion assisted phaser.

Makeup oil is supplied to the phaser from source S by pump 221 to make up for leakage and enters line 219 and through inlet check valve 218 and the control valve 209. From the control valve 209, fluid enters retard line 213 and the retard chamber 203 between spool lands 211*c* and 211*d*. Fluid is also supplied from the source S to line 238 which flows between spool lands 211*e* and 211*f* to line 232. The fluid in line 232 biases the lock pin 225 against the spring 224 to a released position, filling the lock pin circuit 223 with fluid. The fluid in line 232 also pressurizes the pilot valve 230 against the spring 231, moving the pilot valve 230 to a position where retard detent line 234 and the advance detent line 228 are blocked from common line 214. Vent orifice 261 is blocked by spool lands 211*d* and 211*e*. Exhaust orifice 243 is blocked by the end of the spool 211 preventing the lock pin 225 and the pilot valve 230 from venting.

Figure 19:
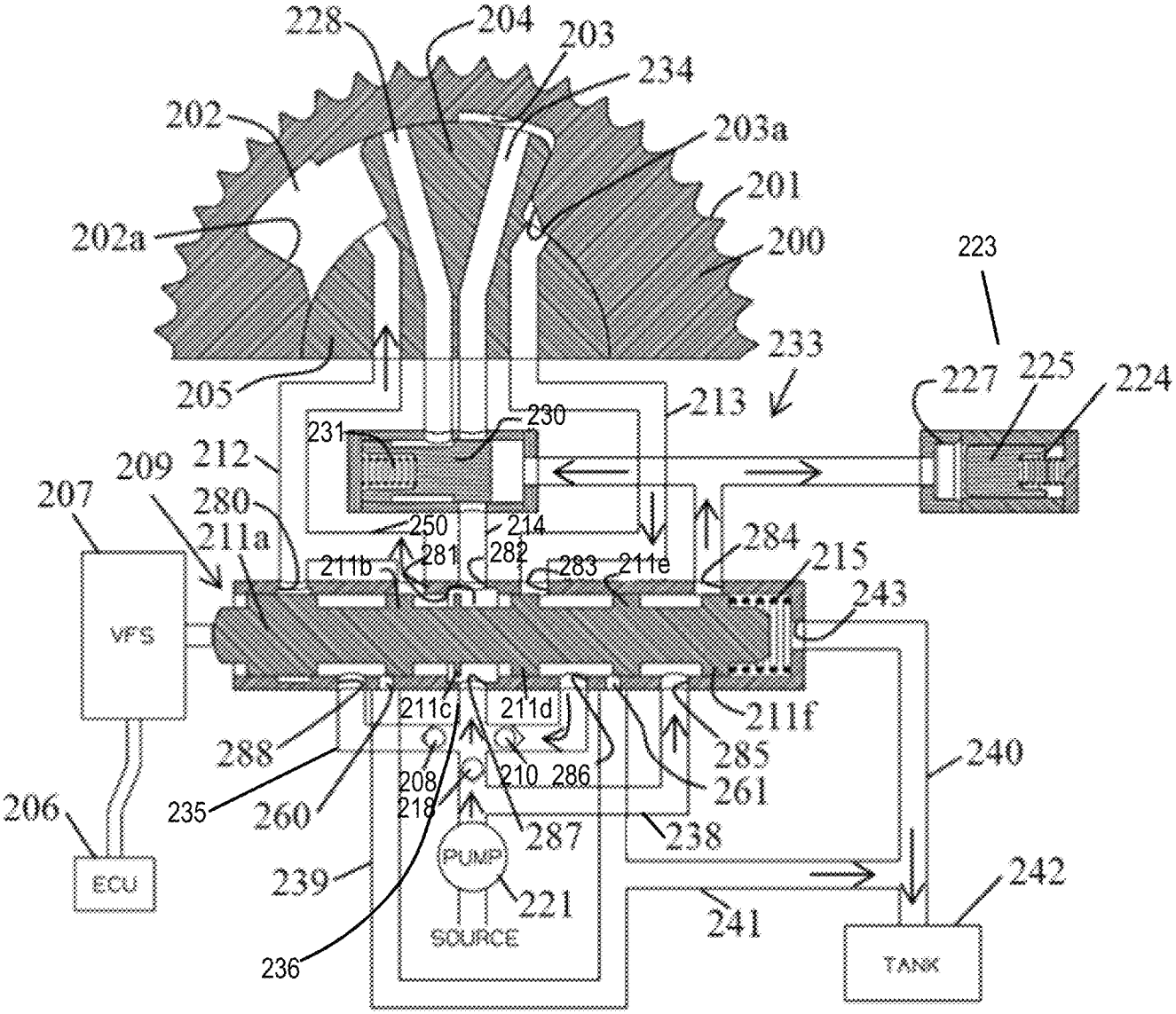
FIG. 19 shows a schematic of a phaser of a second embodiment in an advanced position.

Referring to FIG. 19, to move towards the advance position, the duty cycle is adjusted to a range of 20-50%, the force of the VFS 207 on the spool 211 is changed and the spool 211 is moved to the left in an advance mode in the figure by VFS 207, until the force of the VFS 207 balances the force of the spring 215.

Fluid exits from the retard chamber 203 through retard line 213 and the control valve 209 between spool lands 211*d* and 211*e*. From the control valve 209, fluid flows into line 237 and through the advance recirculating check valve 210, to line 236 and into the control valve 209 between spool lands 211*c* and 211*d*. From the control valve 209, fluid flows to line 250, advance line 212 and to the advance chamber 202. Some of the fluid from the retard chamber 203 exits through vent orifice 261 and flows to tank 242. It should be noted that the amount of fluid which vents through vent orifice 261 and the amount of fluid that recirculates to the advance chamber 203 is based on the size of the vent orifice 261. It the vent orifice 261 is very small or restricted, more fluid will recirculate from the retard chamber 203 to the advance chamber 202 and the phaser will function more similarly to a cam torque actuated phaser. If the vent orifice 261 is large, the phaser will function more similarly to an oil pressure actuated or torsion assisted phaser.

Makeup oil is supplied to the phaser from source S by pump 221 to make up for leakage and enters line 219 and through inlet check valve 218 and the control valve 209.

From the control valve 209, fluid enters line 250, advance line 212 and the advance chamber 202 between spool lands 211*b* and 211*c*. Fluid is also supplied from the source S to line 238 which flows between spool lands 211*e* and 211*f* to line 232. The fluid in line 232 biases the lock pin 225 against the spring 224 to a released position, filling the lock pin circuit 223 with fluid. The fluid in line 232 also pressurizes the pilot valve 230 against the spring 231, moving the pilot valve 230 to a position where retard detent line 234 and the advance detent line 228 are blocked from common line 214. Exhaust line 261 is blocked by spool lands 211*d* and 211*e*. Exhaust orifice 243 is blocked by the end of the spool 211 preventing the lock pin 225 and the pilot valve 230 from venting.

The holding position of the phaser preferably takes place between the retard and advance position of the vane relative to the housing.

Figure 21:
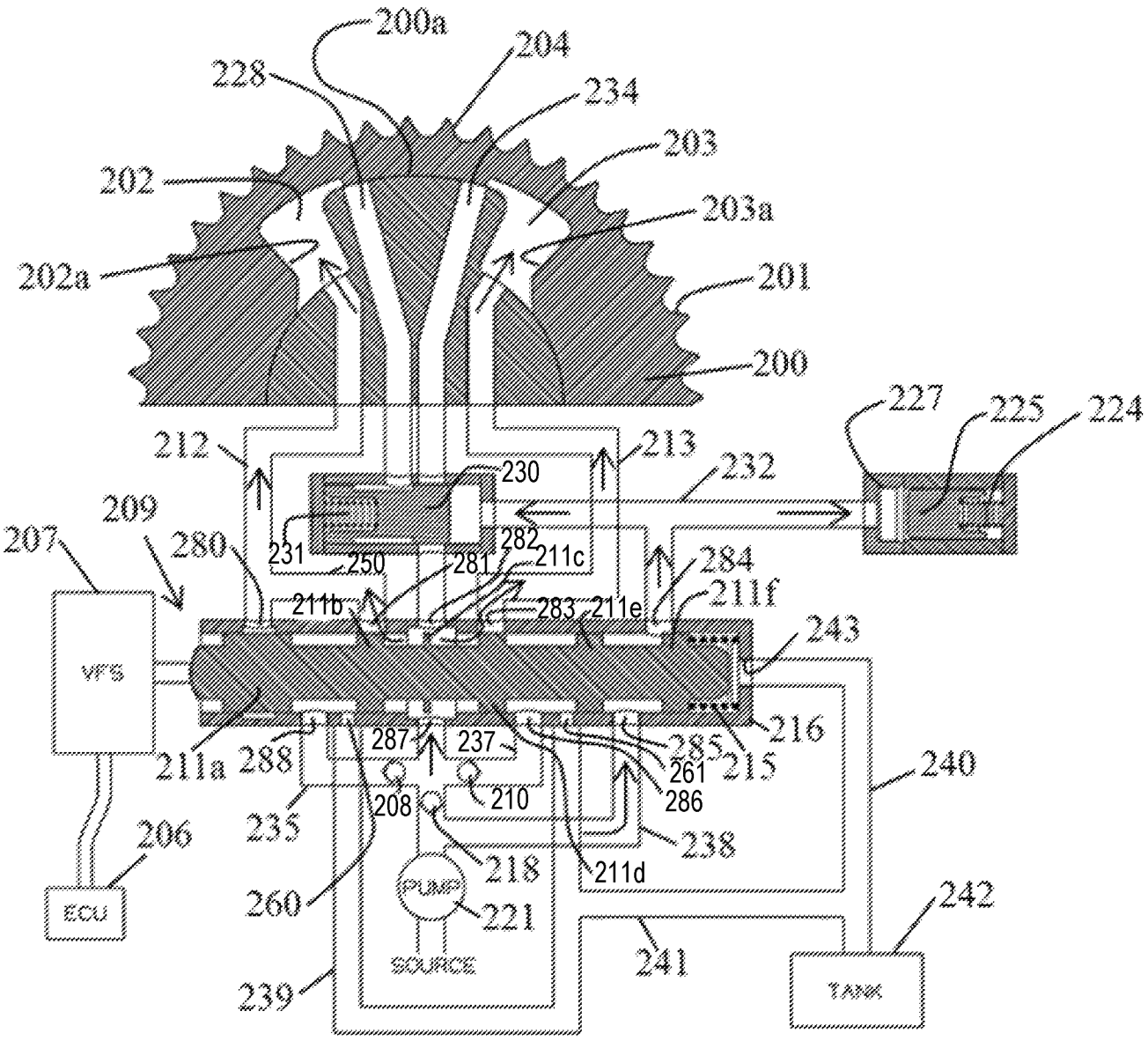
FIG. 21 shows a schematic of the phaser of the second embodiment in a holding position.

FIG. 21 shows the phaser in the holding position. In this position, the duty cycle of the variable force solenoid 207 is 50-60% and the force of the VFS 207 on one end of the spool 211 equals the force of the spring 215 on the opposite end of the spool 211 in holding mode. Land 211*a* blocks the flow of fluid to advance line 212. Makeup oil is supplied to the phaser from source S by pump 221 to make up for leakage and enters line 236 and passes through the inlet check valve 218. From line 236, fluid enters between spool lands 211*b*, and 211*c*, and spool lands 211*c* and 211*d* and flows to the retard line 213 and line 250 to the advance line 212. Fluid also flows from the source S to line 238 to the control valve 209. Fluid flows between spool lands 211*e* and 211*f* to line 232 leading to the pilot valve 230. The fluid in line 232 pressurizes the pilot valve 230 against the spring 231, moving the pilot valve 230 to a position where retard detent line 234 and advance detent line 228 are blocked from common line 214 and from each other.

FIG. 22 shows the phaser in the mid-position or intermediate phase angle position, where the duty cycle of the variable force solenoid is 0%, the spool 211 is in detent mode, the pilot valve 230 is vented through the exhaust orifice 243 of the spool to passage 240 leading to tank 242 or exhaust, and the hydraulic detent circuit 233 is open or on. The lock pin 225 is also vented, such that the force of the spring 224 moves the lock pin 225, such that the end of the lock pin 225 engages the recess 227, locking the housing assembly 200 relative to the rotor assembly 205.

Depending on where the vane 204 was prior to the duty cycle of the variable force solenoid 207 being changed to 0%, either the advance detent line 228 or the retard detent line 234 will be exposed to the advance or retard chamber 202, 203 respectively.

When the duty cycle of the variable force solenoid 207 is just set to 0%, the force on the VFS on the spool 211 is decreased, and the spring 215 moves the spool 211 to the far left end of the spool's travel to a detent mode as shown in the FIG. 22. In the detent mode, spool land 211*c* blocks the flow of fluid from advance line 212 from entering any line except for line 235 which recirculates fluid back through the control valve 209 and to common line 214 and to the advance and retard detent lines 228, 234 through the pilot valve 230, effectively removing control of the phaser from the control valve 209. Similarly, spool land 211*d* and 211*e* block the flow of fluid from retard line 213 from flowing to other passages, except for line 237, which recirculates fluid back to common line 214 and to the advance and retard detent lines 228, 234 through the pilot valve 230, effectively removing control of the phaser from the control valve 209.

At the same time, fluid from source may flow through line 236 and inlet check valve 218 to the common line 214. Fluid is prevented from flowing to the pilot valve 230 by spool land 211*f*. Since fluid cannot flow to line 232 in fluid communication with the pilot valve 230, the pilot valve 230 vents to exhaust orifice 243 of the control valve 209, opening passage between the advance detent line 228 and the retard detent line 234 through the pilot valve 230 and the common line 214, in other words, opening or turning on the hydraulic detent circuit 233. With the venting of line 232, the force of the spring 224 moves the lock pin 225, such that the end of the lock pin 225 engages the recess 227, locking the housing assembly 200 relative to the rotor assembly 205.

Referring to FIG. 24, if the vane 204 was positioned within the housing assembly 200 near or in the advance position, the retard detent line 234 is exposed to the retard chamber 203 and fluid from the advance chamber 202 can flow to the retard chamber 203 through the retard detent line 234. Fluid in the advance chamber 202 exits through advance line 212 and flows into the control valve 209 through port 280. Fluid flows between spool lands 211*a* and 211*b*, through port 287 to line 235 and through the retard recirculating check valve 208 and to line 236. From line 236, fluid enters the control valve 209 through port 286 between spool lands 211*c* and 211*d*. Fluid exits the control valve 209 through port 282 and to common line 214. From common line 214, fluid flows to the retard detent line 234 and the retard chamber 203. Fluid in the retard chamber 203 moves the vane 204 relative to the housing assembly 200 to close off or block retard detent line 234 to the retard chamber 203 by the metered edge 204*b* being sealed from the retard chamber 203 by the arc 217*a* of the chamber 217. As the rotor assembly 205 closes off the retard detent line 234 through the emptying of fluid from the advance chamber 202, the vane 204 is moved to a mid-position or intermediate phase angle position within the chamber 217 formed between the housing assembly 200 and the rotor assembly 205. As the rotor assembly 205 approaches the mid-position, the lock pin 225 will align with and engage the recess 227, locking the rotor assembly 205 relative to the housing assembly 200.

Referring to FIG. 23, if the vane 204 was positioned within the housing assembly 200 near or in the retard position and the advance detent line 228 is exposed to the advance chamber 202, and fluid from the retard chamber 203 can flow to the advance chamber 203 through the advance detent line 228. Fluid in the retard chamber 203 exits through retard line 213 and flows into the control valve 209 through port 283. Fluid flows between spool lands 211*d* and 211*e*, through port 286 to line 237 and through the advance recirculating check valve 210 and to line 236. From line 236, fluid enters the control valve 209 through port 286 between spool lands 211*c* and 211*d*. Fluid exits the control valve 209 through port 282 and to common line 214. From common line 214, fluid flows to the advance detent line 228 and the advance chamber 202. Fluid in the advance chamber 202 moves the vane 204 relative to the housing assembly 200 to close off or block advance detent line 228 to the advance chamber 202 by the metered edge 204*a* being sealed from the advance chamber 202 by the arc 217*a* of the chamber 217. As the rotor assembly 205 closes off the advance detent line 228 through the emptying of fluid from the retard chamber 203, the vane 204 is moved to a mid-position or intermediate phase angle position within the chamber 217 formed between the housing assembly 200 and the rotor assembly 205. As the rotor assembly 205 approaches the mid-position, the lock pin 225 will align with and engage the recess 227, locking the rotor assembly 205 relative to the housing assembly 200.

Figure 25:
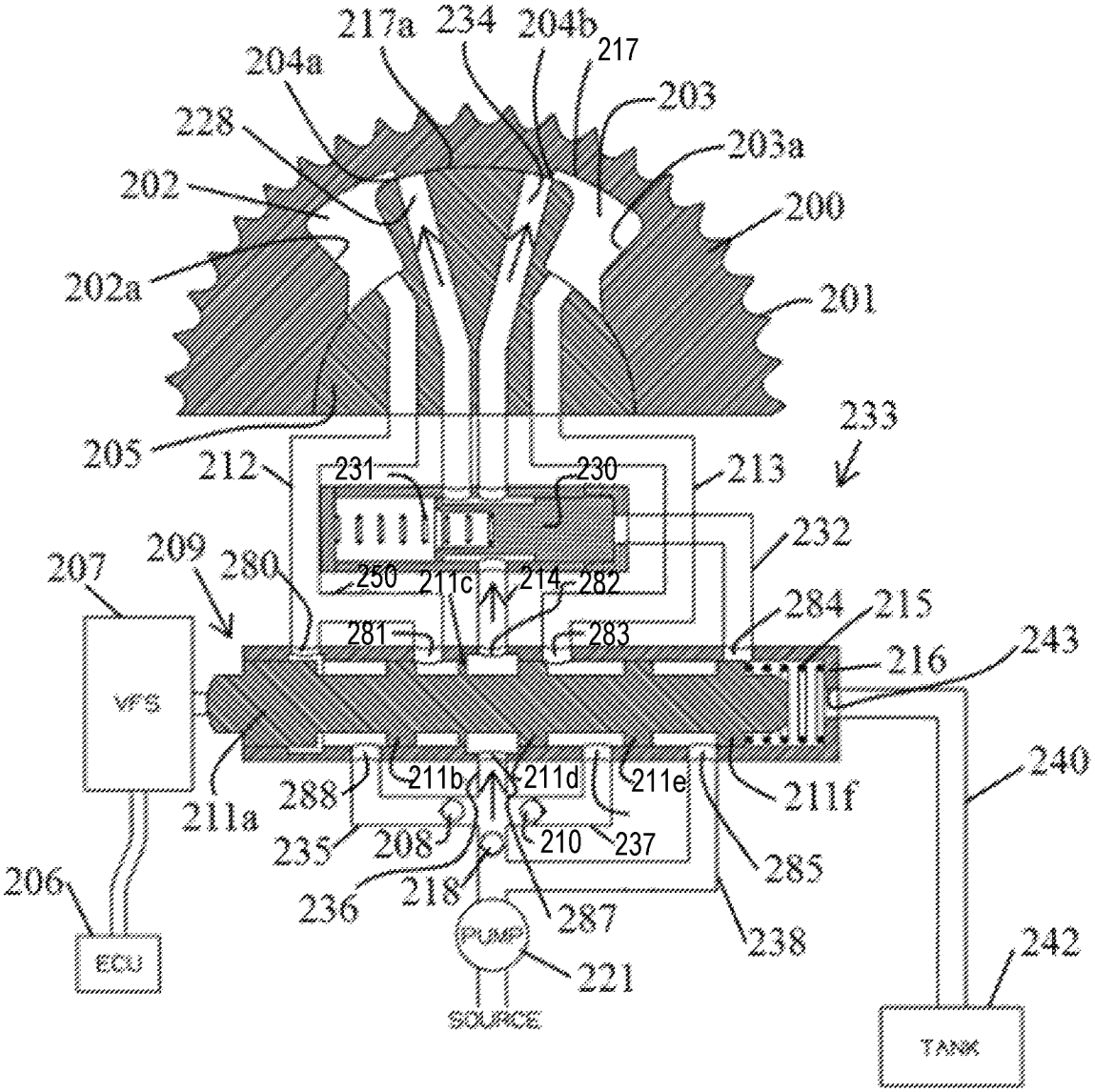
FIG. 25 shows a phaser of an alternate embodiment at the midlock or intermediate locking position with metered edges on the major diameter of the rotor with recirculation.

FIG. 25 shows a phaser of an alternate embodiment at the midlock or intermediate locking position with metered edges on the major diameter of the rotor.

This embodiment differs from the embodiment of FIGS. 19-24, in that a lock pin 225 is no longer present and vent orifices 260 and 261 and associated exhaust lines 239, 241 have been removed. The same reference numbers of FIGS. 19-24 are used for this embodiment as applicable.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The passages 228, 234 within the vane 204 are the advance detent line 228 and the retard detent line 234. The opening and closing of the hydraulic detent circuit 233 is controlled by the switching/movement of the oil control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-288. The port 280 is in fluid communication with the advance line 212. Port 281 is in fluid communication with line 250. Port 282 is in fluid communication with common line 214. Port 283 is in fluid communication with retard line 213. Port 284 is in fluid communication with the hydraulic detent circuit 233 and line 232. Port 285 is in communication with line 238. Port 286 is in fluid communication with line 237. Port 287 is communication with line 236. Port 288 is in fluid communication with line 235. Since no vent orifices are present in the spool except for orifice 243, in communication with the pilot valve 230, this phaser operates solely as a cam torque actuated phaser.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 through the spool 211 and recirculate to the advance chamber 202 through the advance recirculating check valve 210. Fluid is blocked from exiting the advance chamber 202, and the detent valve circuit 233 is off or closed.

In the retard mode, the spool 211 is moved to a position so that fluid may flow from the advance chamber 202 through the spool 211 and recirculate to the retard chamber 203 through the retard recirculating check valve 208. Fluid is blocked from exiting the retard chamber 203 and the detent valve circuit 233 is off.

In null mode, the spool 211 is moved to a position that blocks the exit of fluid from the advance and retard chambers 202, 203, and the detent valve circuit 233 is off.

In the detent mode, as shown in FIG. 25, three functions occur simultaneously. The first function in the detent mode is that the spool 211 moves to a position in which spool land 211*c* blocks the flow of fluid from advance line 212 to retard line 213, spool land 211*d* blocks the flow of fluid from retard line 213 to advance line 212, effectively removing control of the phaser from the control valve 209. At the same time, any fluid that does exit the advance chamber 202 can flow through advance line 212 to between spool lands 211*a* and 211*b*, to line 235. From line 235, fluid flows through retard recirculating check valve 208 to line 236, between spool lands 211*b* and 211*c* to common line 214. From common line 214, fluid can flow through the pilot valve 230 and enter the advance detent line 228 or the retard detent line 234. Any fluid that does exit the retard chamber 203 can flow through retard line 213 to between spool lands 211*d* and 211*e* to line 237. From line 237, fluid flows through the advance recirculating check valve 210 to line 236, between spool lands 211*b* and 211*c* to common line 214. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function is that the vane is moved to an intermediate phase angle position or mid-position. This position of the vane 204 is somewhere between the advance wall 202*a* and the retard wall 203*a* defining the chamber 217 between the housing assembly 200 and the rotor assembly 205. The intermediate phase angle position can be anywhere between the advance wall 202*a* and retard wall 203*a* and is determined by where the detent lines 228 and 234 are within the vane 204.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed.

When the duty cycle of the variable force solenoid 207 is 0%, the spool 211 is moved to the detent mode such that the pilot valve 230 vents and moves to the second position, the hydraulic detent circuit 233 will be open. A duty cycle of 0% was chosen as the extreme position along the spool stroke to open the hydraulic detent circuit 233, vent the pilot valve 230, since if power or control is lost, the phaser will default to a locked position. It should be noted that the duty cycle percentages listed above are an example and they may be altered. Furthermore, the hydraulic detent circuit 233 may be open, and the pilot valve 230 vented at 100% duty cycle, if desired.

When the duty cycle of the variable force solenoid 207 is just set to 0%, the force on the VFS on the spool 211 is decreased, and the spring 215 moves the spool 211 to the far left end of the spool's travel to a detent position as shown in FIG. 25. In this detent position, spool land 211*c* blocks the flow of fluid from advance line 212 in between spool lands 211*a* and 211*b* from exhausting to the retard chamber 203 and spool land 211*d* blocks the flow of fluid from retard line 213 from exhausting to the advance chamber 202, effectively removing control of the phaser from the control valve 209. At the same time, fluid from source may flow through line 236 and inlet check valve 218 to the common line 214 between spool lands 211*b* and 211*c*. Fluid from advance line 212 can however pass through line 235, retard recirculating check valve 208 and enter line 235 and to the common line 214 between spool lands 211*b* and 211*c*. Fluid from retard line 213 can also pass through line 237, advance recirculating check valve 210 and enter line 235 to the common line 214 between spool lands 211*b* and 211*c*.

Fluid is prevented from flowing through line 238 and to the pilot valve 230 by spool land 211*f*. The pilot valve 230 vents to exhaust orifice 243 at the end of the sleeve 216, opening passage between the advance detent line 228 and the retard detent line 234 through the pilot valve 230 to the common line 214, in other words opening the hydraulic detent circuit 233.

If the vane 204 was positioned within the housing assembly 200 near or in the retard position, fluid from the retard chamber 203 flows through retard line 213 to the control valve 209 through port 283. From the control valve 209, fluid flows through line 237 and advance recirculating check valve 210 to line 236 and enters the control valve 209 through port 287. From the control valve 209, fluid enters common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber 202 by the metered edge 204*a* being sealed by the arc 217*a* of the housing 200 and the vane 204 is moved to an intermediate phase angle position or a mid-position within the chamber 217 formed between the housing assembly 200 and the rotor assembly 205.

If the vane 204 was positioned within the housing assembly 200 near or in the advance position, fluid from the advance chamber 202 flows through advance line 212 to the control valve 209 through port 280. From the control valve 209, fluid flows through line 235 and retard recirculating check valve 208 to line 236 and enters the control valve 209 through port 287. From the control valve 209, fluid enters common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*.

While not shown, the check valves 208, 210 may be present outside a sleeve 216 as a reed plate on a face of the rotor assembly 205 or present within the rotor assembly 205, instead of being present inside of the sleeve 216 of the control valve 209.

Figure 26:
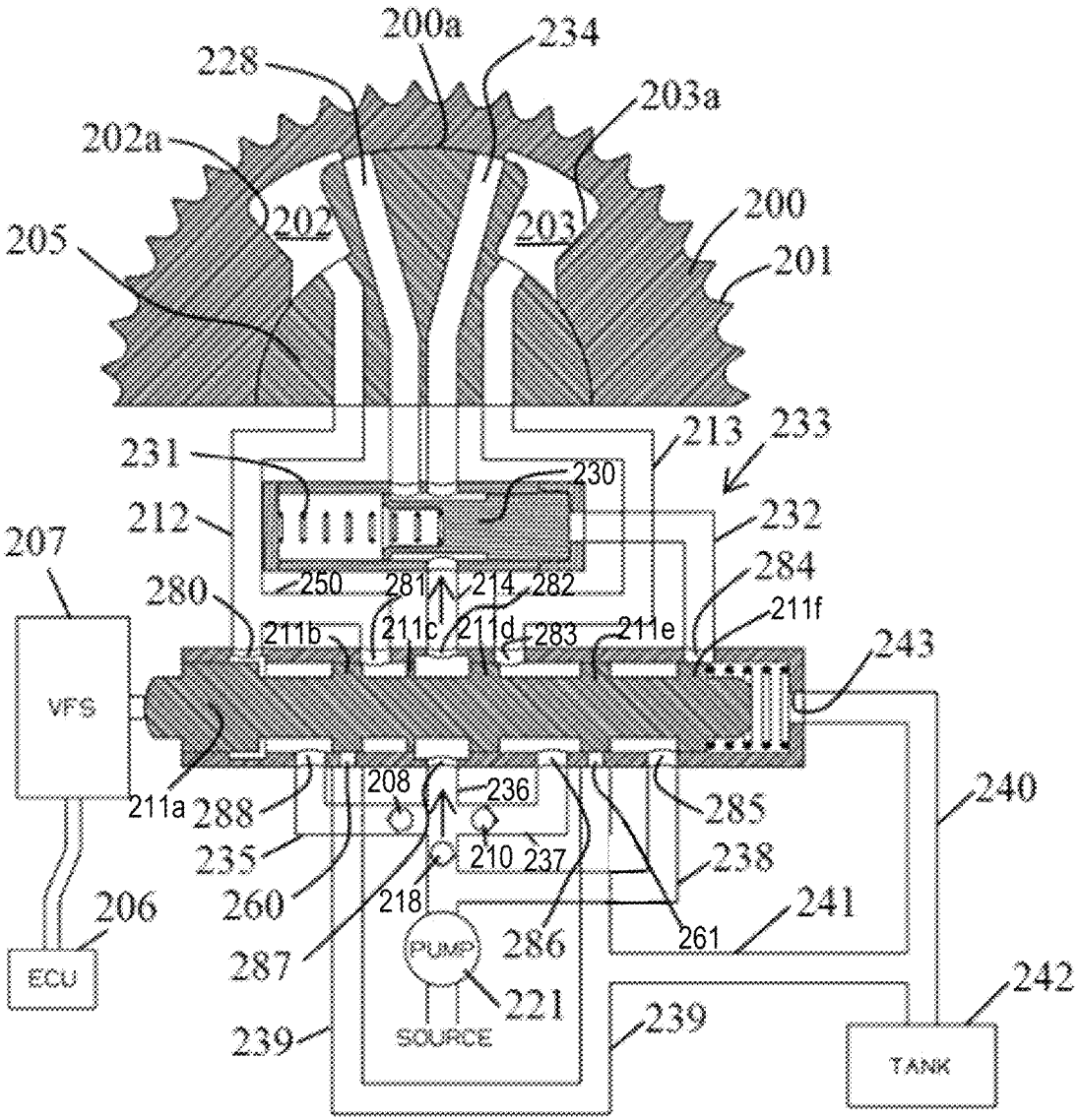
FIG. 26 shows a phaser of an alternate embodiment at the midlock or intermediate locking position with metered edges on the major diameter of the rotor with recirculation and vent.

FIG. 26 shows a phaser of an alternate embodiment at the midlock or intermediate locking position with metered edges on the major diameter of the rotor assembly with recirculation.

This embodiment differs from the embodiment of FIGS. 19-24, in that a lock pin 225 is no longer present. The same reference numbers of FIGS. 19-24 are used for this embodiment as applicable.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The passages 228, 234 within the vane 204 are the advance detent line 228 and the retard detent line 234. The opening and closing of the hydraulic detent circuit 233 is controlled by the switching/movement of the control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-288 and vent orifices 260-261. The port 280 is in fluid communication with the advance line 212. Port 281 is in fluid communication with line 250. Port 282 is in fluid communication with common line 214. Port 283 is in fluid communication with retard line 213. Port 284 is in fluid communication with the hydraulic detent circuit 233 and line 232. Port 285 is in communication with line 238. Vent orifice 261 is in communication with tank 242 through line 239. Port 286 is in fluid communication with line 237. Port 287 is communication with line 236. Port 288 is in fluid communication with line 235. Vent orifice 260 is in communication with tank 242 through line 239.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 through the spool 211 and to sump or tank 242 via exhaust line 244 and line 241. Fluid is blocked from exiting the advance chamber 202, and the detent valve circuit 233 is off or closed.

In the retard mode, the spool 211 is moved to a position so that fluid may flow from the advance chamber 202 through the spool 211 and to sump or tank 242 via exhaust line 239 and line 241. Fluid is blocked from exiting the retard chamber 203 and the detent valve circuit 233 is off.

In null mode, the spool 211 is moved to a position that blocks the exit of fluid from the advance and retard chambers 202, 203 to the tank 242, and the detent valve circuit 233 is off.

In the detent mode, as shown in FIG. 26, three functions occur simultaneously. The first function in the detent mode is that the spool 211 moves to a position in which spool land 211*b* blocks the flow of fluid from advance line 212 to tank 242, spool land 211*e* blocks the flow of fluid from retard line 213 to tank 242, spool lands 211*c* and 211*d* block fluid from exiting either advance line 212 and retard line 213 to each other, effectively removing control of the phaser from the control valve 209. At the same time, any fluid that does exit the advance chamber 202 can flow through advance line 212 to between spool lands 211*a* and 211*b*, to line 235. From line 235, fluid flows through retard recirculating check valve 208 to line 236, between spool lands 211*b* and 211*c* to common line 214. From common line 214, fluid can flow through the pilot valve 230 and enter the advance detent line 228 or the retard detent line 234. Any fluid that does exit the retard chamber 203 can flow through the retard line 213 to the control valve 209 to line 237. From line 237, fluid flows through the advance recirculating check valve 210 to line 236, between spool lands 211*b* and 211*c* to common line 214. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function is that the vane is moved to an intermediate phase angle position or mid-position. This position of the vane 204 is somewhere between the advance wall 202*a* and the retard wall 203*a* defining the chamber 217 between the housing assembly 200 and the rotor assembly 205. The intermediate phase angle position can be anywhere between the advance wall 202*a* and retard wall 203*a* and is determined by where the detent passages 228 and 234 are within the vane 204.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed.

When the duty cycle of the variable force solenoid 207 is 0%, the spool 211 is moved to the detent mode such that the pilot valve 230 vents and moves to the second position, the hydraulic detent circuit 233 will be open. A duty cycle of 0% was chosen as the extreme position along the spool stroke to open the hydraulic detent circuit 233, and vent the pilot valve 230, since if power or control is lost, the phaser will default to an intermediate position. It should be noted that the duty cycle percentages listed above are an example and they may be altered. Furthermore, the hydraulic detent circuit 233 may be open, and the pilot valve 230 vented at 100% duty cycle, if desired.

When the duty cycle of the variable force solenoid 207 is just set to 0%, the force on the VFS on the spool 211 is decreased, and the spring 215 moves the spool 211 to the far left end of the spool's travel to a detent position as shown in FIG. 26. In this detent position, spool land 211*b* blocks the flow of fluid from advance line 212 in between spool lands 211*a* and 211*b* from exhausting to tank 242 through exhaust line 239 and spool land 211*e* blocks the flow of fluid from retard line 213 from exhausting to tank 242 through exhaust line 239, spool lands 211*c* and 211*d* block fluid from exiting either advance line 212 and retard line 213 to each other, effectively removing control of the phaser from the control valve 209. At the same time, fluid from source may flow through line 236 and inlet check valve 218 to the common line 214 between spool lands 211*c* and 211*d*. Fluid from advance line 212 can however pass through line 235, retard recirculating check valve 208 and enter line 235 and to the common line 214 between spool lands 211*c* and 211*d*. Fluid from retard line 213 can also pass through line 237, advance recirculating check valve 210 and enter line 235 to the common line 214 between spool lands 211*c* and 211*d*.

Fluid is prevented from flowing through line 238 to the pilot valve 230, the pilot valve 230 vents to exhaust orifice 243 at the end of the sleeve 216, opening passage between the advance detent line 228 and the retard detent line 234 through the pilot valve 230 to the common line 214, in other words opening the hydraulic detent circuit 233.

If the vane 204 was positioned within the housing assembly 200 near or in the retard position, fluid from the retard chamber 203 flows through retard line 213 to the control valve 209 through port 283. From the control valve 209, fluid flows through line 237 and advance recirculating check valve 210 to line 236 and enters the control valve 209 through port 287. From the control valve 209, fluid enters common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber 202 by the metered edge 204*a* being sealed by the arc 217*a* of the housing 200 and the vane 204 is moved to an intermediate phase angle position or a mid-position within the chamber 217 formed between the housing assembly 200 and the rotor assembly 205.

If the vane 204 was positioned within the housing assembly 200 near or in the advance position, fluid from the advance chamber 202 flows through advance line 212 to the control valve 209 through port 280. From the control valve 209, fluid flows through line 235 and retard recirculating check valve 208 to line 236 and enters the control valve 209 through port 287. From the control valve 209, fluid enters common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*.

Figure 27:
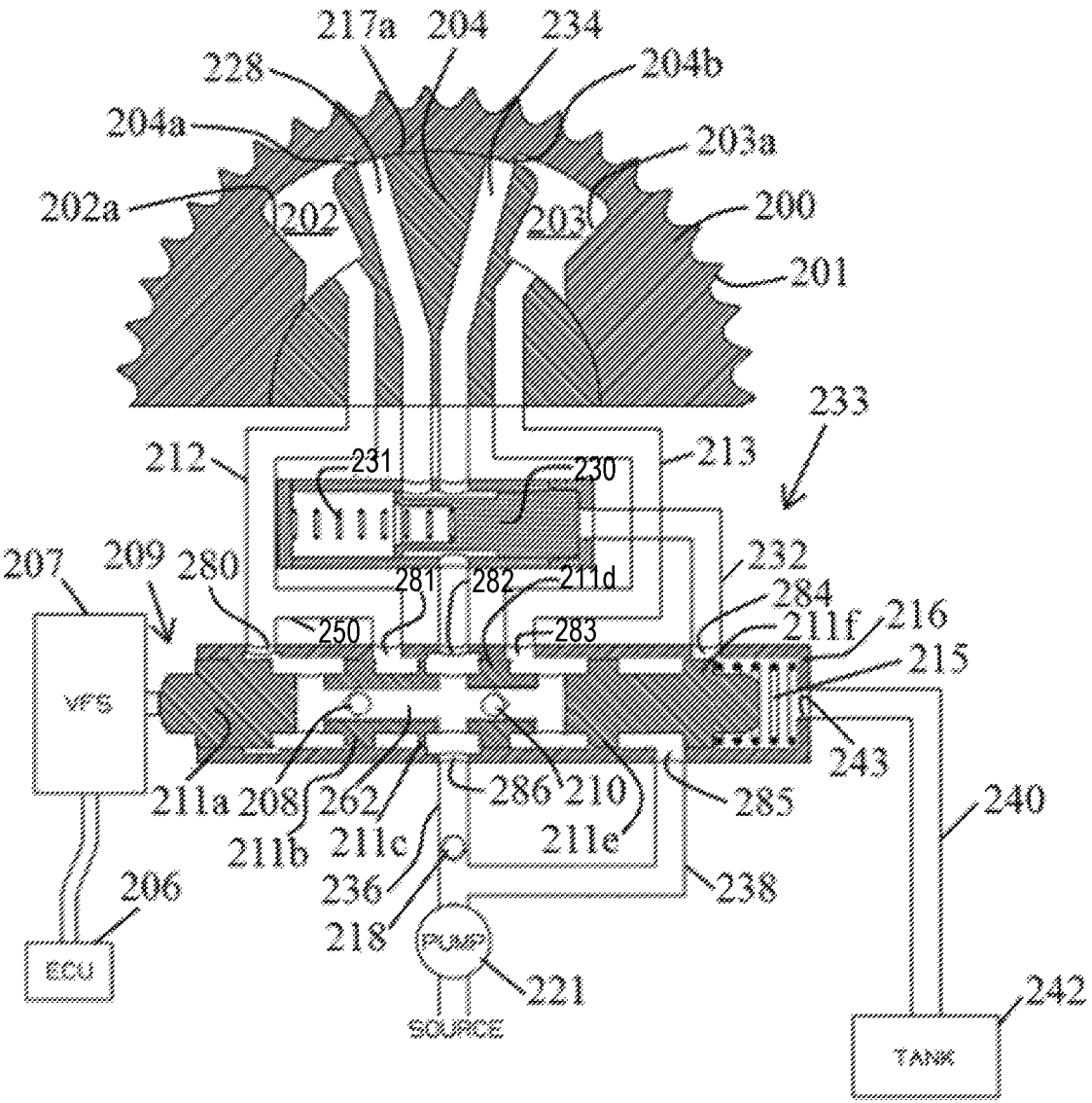
FIG. 27 shows a phaser of an alternate embodiment at the midlock or intermediate locking position with metered edges on the major diameter of the rotor with check valves present in the spool of the control valve with recirculation.

FIG. 27 shows a phaser of an alternate embodiment at the midlock or intermediate locking position with metered edges on the major diameter of the rotor with check valves present in the spool of the control valve.

This embodiment differs from the embodiment of FIGS. 19-24, in that a lock pin 225 is no longer present, vent orifices 260, 261 and exhaust lines 239, 241 are no longer present and the advance and retard check valves 208, 210 are present within a central passage 262 of the control valve 209. The same reference numbers of FIGS. 19-24 are used for this embodiment as applicable.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The advance and retard detent lines 228, 234 within the vane 204 are the advance detent line 228 and the retard detent line 234. The opening and closing of the hydraulic detent circuit 233 is controlled by the switching/movement of the oil control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The spool 211 also includes an retard recirculating check valve 208 and an advance recirculating check valve 210 within a central passage 262 of the spool 211. The control valve 209 may be located remotely from the phaser, within a bore in the rotor assembly 205 which pilots in the camshaft, or in a center bolt of the phaser. One end of the spool contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-286. The port 280 is in fluid communication with the advance line 212. Port 281 is in fluid communication with line 250. Port 282 is in fluid communication with common line 214. Port 283 is in fluid communication with retard line 213. Port 284 is in fluid communication with the hydraulic detent circuit 233 and line 232. Port 285 is in communication with line 238. Port 286 is in fluid communication with line 236. Since no vent orifices are present in the spool except for exhaust orifice 243 in communication with the pilot valve, this phaser operates solely as a cam torque actuated phaser.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 through the spool 211 and recirculate to the advance chamber 202 through the advance recirculating check valve 210 within the control valve 209. Fluid is blocked from exiting the advance chamber 202, and the detent valve circuit 233 is off or closed.

In the retard mode, the spool 211 is moved to a position so that fluid may flow from the advance chamber 202 through the spool 211 and recirculate to the retard chamber 203 through the retard recirculating check valve 208 within the control valve 209. Fluid is blocked from exiting the retard chamber 203 and the detent valve circuit 233 is off.

In null mode, the spool 211 is moved to a position that blocks the exit of fluid from the advance and retard chambers 202, 203, and the detent valve circuit 233 is off.

In the detent mode, as shown in FIG. 27, three functions occur simultaneously. The first function in the detent mode is that the spool 211 moves to a position in which spool land 211*c* blocks the flow of fluid directly from advance line 212 to retard line 213, spool land 211*d* blocks the flow of fluid directly from retard line 213 to advance line 212, effectively removing control of the phaser from the control valve 209. At the same time, any fluid that does exit the advance chamber 202 can flow through advance line 212 to between spool lands 211*a* and 211*b*, to passage 262, through retard recirculating check valve 208 to common line 214. From common line 214, fluid can flow through the pilot valve 230 and enter the advance detent line 228 or the retard detent line 234. Any fluid that does exit the retard chamber 203 can flow through retard line 213 to between spool lands 211*d* and 211*e* to passage 262, through the advance recirculating check valve 210 to common line 214. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function is that the vane is moved to an intermediate phase angle position or mid-position. This position of the vane 204 is somewhere between the advance wall 202*a* and the retard wall 203*a* defining the chamber between the housing assembly 200 and the rotor assembly 205. The intermediate phase angle position can be anywhere between the advance wall 202*a* and retard wall 203*a* and is determined by where the detent passages 228 and 234 are within the vane 204.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed.

When the duty cycle of the variable force solenoid 207 is 0%, the spool 211 is moved to the detent mode such that the pilot valve 230 vents and moves to the second position, the hydraulic detent circuit 233 will be open. A duty cycle of 0% was chosen as the extreme position along the spool stroke to open the hydraulic detent circuit 233 and vent the pilot valve 230, since if power or control is lost, the phaser will default to mid position. It should be noted that the duty cycle percentages listed above are an example and they may be altered. Furthermore, the hydraulic detent circuit 233 may be open, and the pilot valve 230 vented at 100% duty cycle, if desired.

When the duty cycle of the variable force solenoid 207 is just set to 0%, the force on the VFS on the spool 211 is decreased, and the spring 215 moves the spool 211 to the far left end of the spool's travel to a detent position as shown in FIG. 27. In this detent position, spool land 211*c* blocks most of the flow of fluid from advance line 212 in between spool lands 211*a* and 211*b* from exhausting to the retard chamber 203 and spool land 211*d* blocks most of the flow of fluid from retard line 213 from exhausting to the advance chamber 202, effectively removing control of the phaser from the control valve 209. At the same time, fluid from source may flow through line 236 and inlet check valve 218 to the common line 214 between spool lands 211*c* and 211*d*. Fluid from advance line 212 can however pass to passage 262, through the retard recirculating check valve 208 and enter the common line 214 between spool lands 211*c* and 211*d*. Fluid from retard line 213 can also pass to passage 262, through the advance recirculating check valve 210 and enter the common line 214 between spool lands 211*c* and 211*d*.

Fluid is prevented from flowing through line 238 to the pilot valve 230 by spool land 211*f*; and the pilot valve 230 vents to exhaust orifice 243 at the end of the sleeve 216, opening passage between the advance detent line 228 and the retard detent line 234 through the pilot valve 230 to the common line 214, in other words opening the hydraulic detent circuit 233.

If the vane 204 was positioned within the housing assembly 200 near or in the retard position, fluid from the retard chamber 203 flows through retard line 213 to the control valve 209 through port 283. Within the control valve 209, fluid flows through central passage 262 and advance recirculating check valve 210 to common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber by the metered edge 204*a* being sealed by the arc 217*a* of the housing 200 and the vane 204 is moved to an intermediate phase angle position or a mid-position within the chamber formed between the housing assembly 200 and the rotor assembly 205.

If the vane 204 was positioned within the housing assembly 200 near or in the advance position, fluid from the advance chamber 202 flows through advance line 212 to the control valve 209 through port 280. Within the control valve 209, fluid flows through central passage 262 and retard recirculating check valve 208 to common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*.

Figure 28:
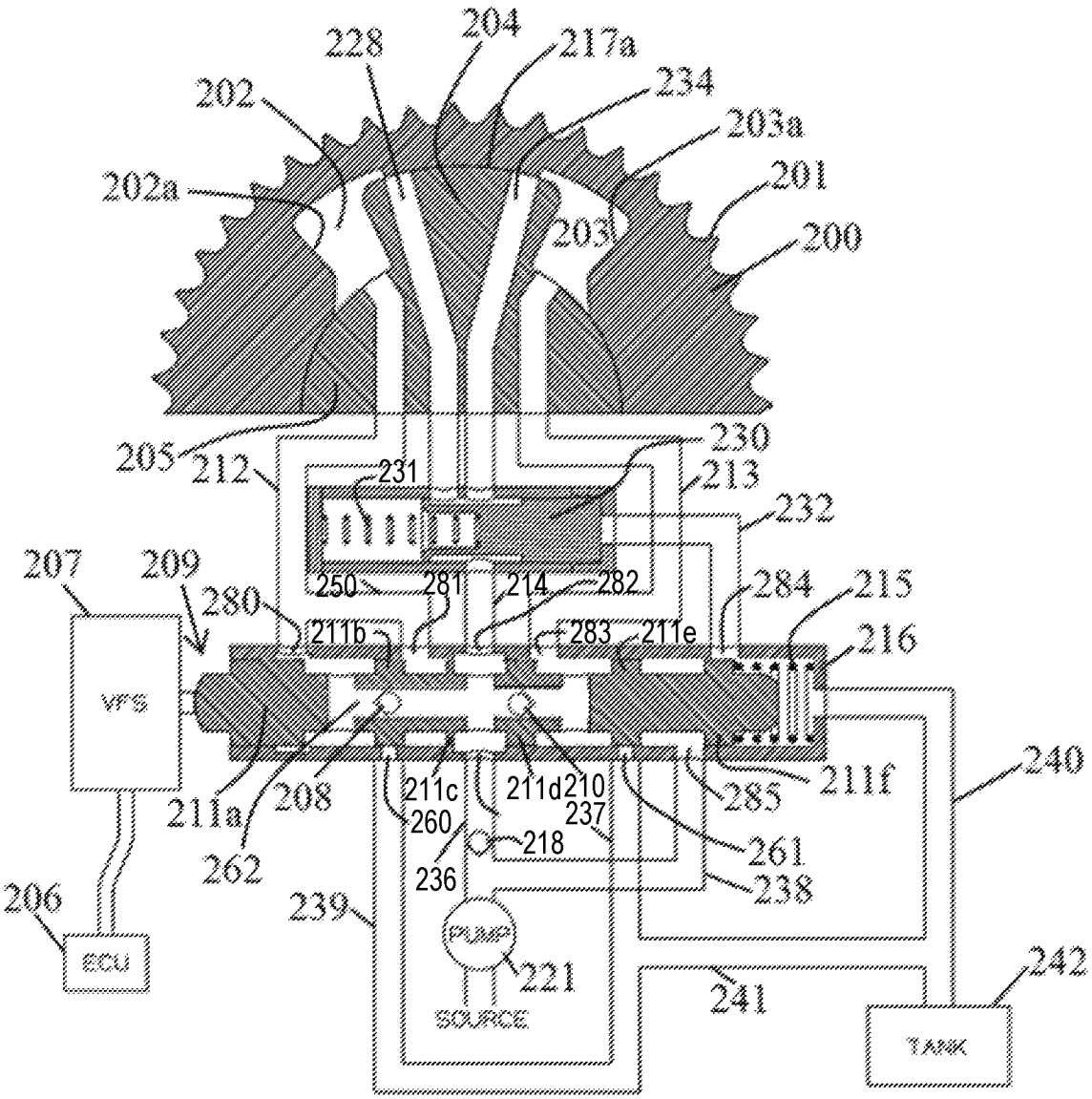
FIG. 28 shows a phaser of an alternate embodiment at the midlock or intermediate locking position with metered edges on the major diameter of the rotor with check valves present in the spool of the control valve and recirculation and vent.

FIG. 28 shows a phaser of an alternate embodiment at the midlock or intermediate locking position with metered edges on the major diameter of the rotor with check valves present in the spool of the control valve and recirculation.

This embodiment differs from the embodiment of FIGS. 19-24, in that a lock pin 225 is no longer present, and the advance and retard check valves 208, 210 are present within a central passage 262 of the control valve 209. The same reference numbers of FIGS. 19-24 are used for this embodiment as applicable.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The passages 228, 234 within the vane 204 are the advance detent line 228 and the retard detent line 234. The opening and closing of the hydraulic detent circuit 233 is controlled by the switching/movement of the oil control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The spool 211 also includes an retard recirculating check valve 208 and a advance recirculating check valve 210 within a central passage 262 of the spool 211. The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-286 and vent orifices 260-261. The port 280 is in fluid communication with the advance line 212. Port 281 is in fluid communication with line 250. Port 282 is in fluid communication with common line 214. Port 283 is in fluid communication with retard line 213. Port 284 is in fluid communication with the hydraulic detent circuit 233 and line 232. Port 285 is in communication with line 238. Vent orifice 261 is in communication with tank 242 through line 239. Port 286 is in fluid communication with line 237. Port 287 is communication with line 236. Vent orifice 260 is in communication with tank 242 through line 239.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 through the spool 211 and to sump or tank 242 via exhaust line 239 and line 241. Fluid is blocked from exiting the advance chamber 202, and the detent valve circuit 233 is off or closed.

In the retard mode, the spool 211 is moved to a position so that fluid may flow from the advance chamber 202 through the spool 211 and to sump or tank 242 via exhaust line 239 and line 241. Fluid is blocked from exiting the retard chamber 203 and the detent valve circuit 233 is off.

In null mode, the spool 211 is moved to a position that blocks the exit of fluid from the advance and retard chambers 202, 203 to the tank 242, and the detent valve circuit 233 is off.

In the detent mode, as shown in FIG. 28, three functions occur simultaneously. The first function in the detent mode is that the spool 211 moves to a position in which spool land 211*b* blocks the flow of fluid from advance line 212 to tank 242, spool land 211*e* blocks the flow of fluid from retard line 213 to tank 242, spool lands 211*c* and 211*d* block fluid from exiting either advance line 212 and retard line 213 to each other, effectively removing control of the phaser from the control valve 209. At the same time, any fluid that does exit the advance chamber 202 can flow through advance line 212 to between spool lands 211*a* and 211*b*, to central passage 262 within the control valve 209 and through the retard recirculating check valve 208 to common line 214. Any fluid that does exit the retard chamber 203 can flow through retard line 213 to between spool lands 211*d* and 211*e*, to central passage 262 within the control valve 209 and through the advance recirculating check valve 210 to common line 214. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function is that the vane 204 is moved to an intermediate phase angle position or mid-position. This position of the vane 204 is somewhere between the advance wall 202*a* and the retard wall 203*a* defining the chamber 217 between the housing assembly 200 and the rotor assembly 205. The intermediate phase angle position can be anywhere between the advance wall 202*a* and retard wall 203*a* and is determined by where the detent passages 228 and 234 are within the vane 204.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed.

When the duty cycle of the variable force solenoid 207 is 0%, the spool 211 is moved to the detent mode such that the pilot valve 230 vents and moves to the second position, the hydraulic detent circuit 233 will be open. A duty cycle of 0% was chosen as the extreme position along the spool stroke to open the hydraulic detent circuit 233 and vent the pilot valve 230, since if power or control is lost, the phaser will default to a mid position. It should be noted that the duty cycle percentages listed above are an example and they may be altered. Furthermore, the hydraulic detent circuit 233 may be open, and the pilot valve 230 vented at 100% duty cycle, if desired.

When the duty cycle of the variable force solenoid 207 is just set to 0%, the force on the VFS on the spool 211 is decreased, and the spring 215 moves the spool 211 to the far left end of the spool's travel to a detent position as shown in FIG. 28. In this detent position, spool land 211*b* blocks the flow of fluid from advance line 212 from exhausting to tank 242 via line 239 and spool land 211*e* blocks the flow of fluid from retard line 213 from exhausting to tank 242 through exhaust line 239, spool lands 211*c* and 211*d* block fluid from exiting either advance line 212 and retard line 213 to each other, effectively removing control of the phaser from the control valve 209. At the same time, fluid from source may flow through line 236 and inlet check valve 218 to the common line 214 between spool lands 211*c* and 211*d*. Fluid from advance line 212 can however pass into the central passage 262 of the control valve and flow through the retard recirculating check valve 208 and enter the common line 214 between spool lands 211*c* and 211*d*. Fluid from retard line 213 can also pass into central passage 262 and flow through the advance recirculating check valve 210 and enter common line 214 between spool lands 211*c* and 211*d*.

Fluid is prevented from flowing through line 238 and the pilot valve 230 by spool land 211*f*. The pilot valve 230 vents to exhaust orifice 243 at the end of the sleeve 216, opening passage between the advance detent line 228 and the retard detent line 234 through the pilot valve 230 to the common line 214, in other words opening the hydraulic detent circuit 233.

If the vane 204 was positioned within the housing assembly 200 near or in the retard position, fluid from the retard chamber 203 flows through retard line 213 to the control valve 209 through port 283. Within the control valve 209, fluid flows through central passage 262 and advance recirculating check valve 210 to common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber 202 by the metered edge 204*a* being sealed by the arc 217*a* of the housing assembly 200 and the vane 204 is moved to an intermediate phase angle position or a mid-position within the chamber 217 formed between the housing assembly 200 and the rotor assembly 205.

If the vane 204 was positioned within the housing assembly 200 near or in the advance position, fluid from the advance chamber 202 flows through advance line 212 to the control valve 209 through port 280. Within the control valve 209, fluid flows through central passage 262 and retard recirculating check valve 208 to common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*.

Figure 29:
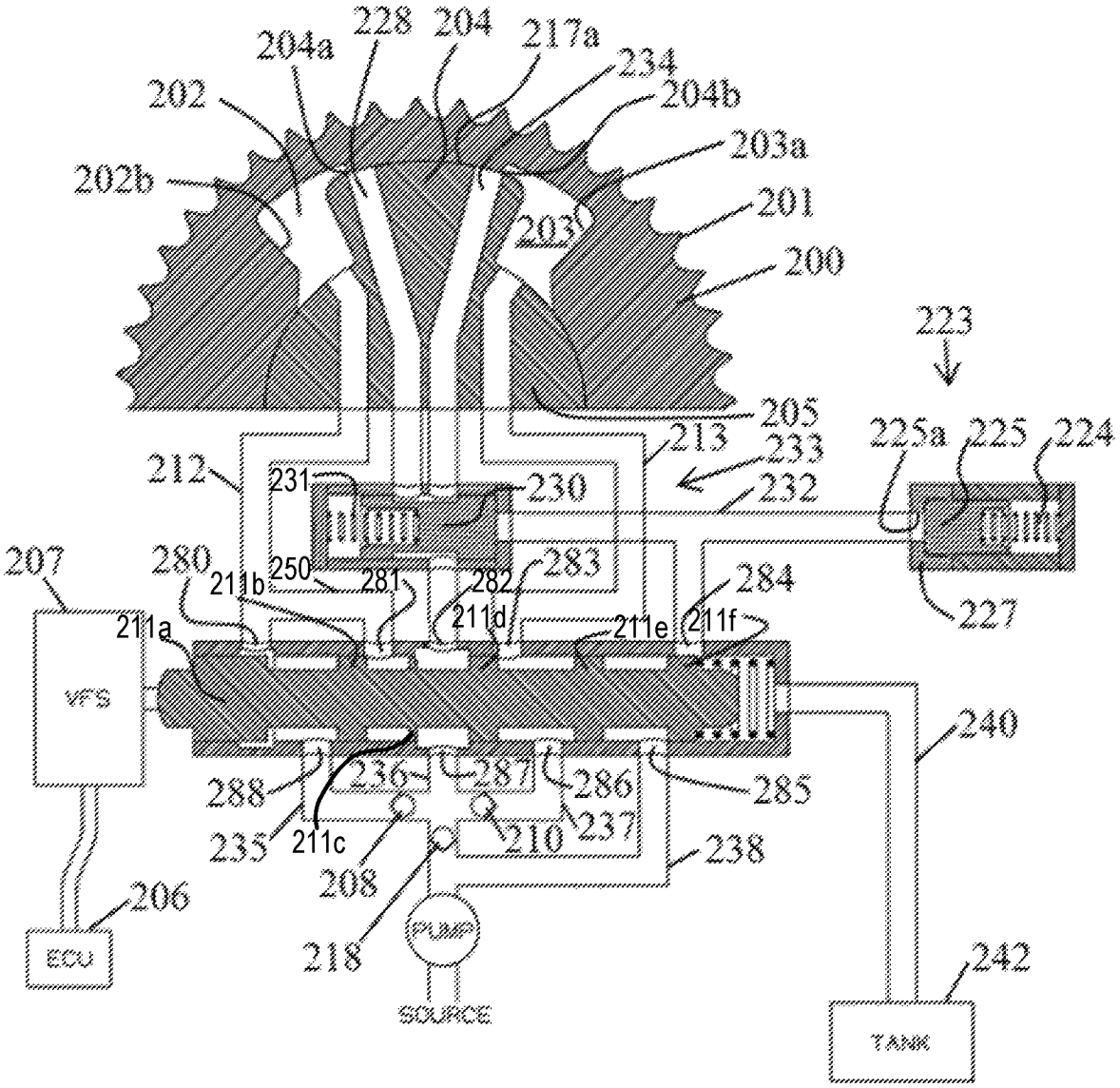
FIG. 29 shows a phaser of an alternate embodiment at the midlock or intermediate locking position with metered edges on the major diameter of the rotor with a lock pin with recirculation.

FIG. 29 shows a phaser of an alternate embodiment at the midlock or intermediate locking position with metered edges on the major diameter of the rotor with a lock pin.

This embodiment differs from the embodiment of FIGS. 19-24, in that the vents 260, 261 and the associated exhaust lines 239 and 241 are not present. The same reference numbers of FIGS. 19-24 are used for this embodiment as applicable.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The passages 228, 234 within the vane 204 are the advance detent line 228 and the retard detent line 234.

A lock pin 225 is slidably housed in a bore in the rotor assembly 205 and has an end portion that is biased towards and fits into a recess 227 in the housing assembly 200 by a spring 224. Alternatively, the lock pin 225 may be housed in the housing assembly 200 and be spring 224 biased towards a recess 227 in the rotor assembly 205. The opening and closing of the hydraulic detent circuit 233 and pressurization of the lock pin circuit 223 are both controlled by the switching/movement of the oil control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-288. The port 280 is in fluid communication with the advance line 212. Port 281 is in fluid communication with line 250. Port 282 is in fluid communication with common line 214. Port 283 is in fluid communication with retard line 213. Port 284 is in fluid communication the lock pin circuit 223 and the hydraulic detent circuit 233 via line 232. Port 285 is in communication with line 238. Port 286 is in fluid communication with line 237. Port 288 is in fluid communication with line 235.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the lock pin circuit 223 and the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 through the spool 211 and to the advance chamber 202, recirculating the fluid between the advance and retard chambers 202, 203. Fluid is blocked from exiting the advance chamber 202 and the detent valve circuit 233 is off or closed. The lock pin 225 is in an unlocked position.

In the retard mode, the spool 211 is moved to a position so that fluid may flow from the advance chamber 202 through the spool 211 and to the retard chamber 203, recirculating the fluid between the advance and retard chambers 202, 203. Fluid is blocked from exiting the retard chamber 203 and the detent valve circuit 233 is off. The lock pin 225 is in an unlocked position.

In null mode, the spool 211 is moved to a position that blocks the exit of fluid from the advance and retard chambers 202, 203 and the detent valve circuit 233 is off. In the null mode the lock pin 225 is in an unlocked position. Fluid can be supplied to the advance and retard chambers 202, 203 to make up for leakage in this mode.

In the detent mode, three functions occur simultaneously. The first function in the detent mode is that the spool 211 moves to a position in which spool land 211*c* blocks the flow of fluid from advance line 212 to retard line 213, spool land 211*d* blocks the flow of fluid from retard line 213 to advance line 212, effectively removing control of the phaser from the control valve 209.

At the same time, any fluid that does exit the advance chamber 202 can flow through advance line 212 to between spool lands 211*a* and 211*b*, to line 235, through retard recirculating check valve 208 to line 236 and then the common line 214. From common line 214, fluid can flow through the pilot valve 230 and enter the advance detent line 228 or the retard detent line 234. Any fluid that does exit the retard chamber 203 can flow through retard line 213 to between spool lands 211*d* and 211*e* to line 237, through the advance recirculating check valve 210 to line 236 and then the common line 214. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function in the detent mode is to vent the lock pin circuit 223, allowing the lock pin 225 to engage the recess 227. The intermediate phase angle position or mid-position is when the vane 204 is somewhere between the advance wall 202*a* and the retard wall 203*a* defining the chamber 217 between the housing assembly 200 and the rotor assembly 205. The intermediate phase angle position can be anywhere between the advance wall 202*a* and retard wall 203*a* and is determined by where the detent passages 228 and 234 are within the vane 204.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed, and the lock pin 225 will be pressurized and released.

When the duty cycle of the variable force solenoid 207 is 0%, the spool 211 is moved to the detent mode such that the pilot valve 230 vents and moves to the second position, the hydraulic detent circuit 233 will be open, and the lock pin 225 vented and engaged with the recess 227. A duty cycle of 0% was chosen as the extreme position along the spool stroke to open the hydraulic detent circuit 233, vent the pilot valve 230, and vent and engage the lock pin 225 with the recess 227, since if power or control is lost, the phaser will default to a locked position. It should be noted that the duty cycle percentages listed above are an example and they may be altered. Furthermore, the hydraulic detent circuit 233 may be open, the pilot valve 230 vented, and the lock pin 225 vented and engaged with the recess 227 at 100% duty cycle, if desired.

In order for the phaser to be in detent position with the lock pin 225 in a locked position, the duty cycle of the VFS is set to 0%. The lock pin 225 will remain in a locked position as the duty cycle is increased up to 40%. In the example of the figures, the stroke of the spool or position of the spool 211 relative to the sleeve 216.

When the duty cycle of the variable force solenoid 207 is just set to 0%, the force on the VFS on the spool 211 is decreased, and the spring 215 moves the spool 211 to the far left end of the spool's travel to a detent position as shown in FIG. 29. In this detent position, spool land 211*c* blocks most of the flow of fluid from advance line 212 in between spool lands 211*a* and 211*b* from exhausting directly to the retard chamber 203 and spool land 211*d* blocks most of the flow of fluid from retard line 213 from exhausting directly to the advance chamber 202, effectively removing control of the phaser from the control valve 209. At the same time, fluid from source may flow through inlet line 236 and inlet check valve 218 to the common line 214 between spool lands 211*c* and 211*d*. Fluid from advance line 212, fluid can pass through to line 235 and through the retard recirculating check valve 208 and enter the common line 214 between spool lands 211*c* and 211*d*. Fluid from retard line 213 can pass to line 237, through the advance recirculating check valve 210 and enter the common line 214 between spool lands 211*c* and 211*d*. From the common line 214, fluid can flow through the pilot valve 230 to either the advance or retard detent lines 228, 234.

Fluid is prevented from flowing through line 238 to the pilot valve 230 by spool land 211*f*. The pilot valve 230 vents to exhaust orifice 243 at the end of the sleeve 216, opening passage between the advance detent line 228 and the retard detent line 234 through the pilot valve 230 to the common line 214, in other words opening the hydraulic detent circuit 233.

If the vane 204 was positioned within the housing assembly 200 near or in the retard position, fluid from the retard chamber 203 flows through retard line 213 to the control valve 209 through port 283. From the control valve 209, fluid flows through line 237 and advance recirculating check valve 210 to line 236 and enters the control valve 209 through port 287. From the control valve 209, fluid enters common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber by the metered edge 204*a* being sealed by the arc 217*a* of the housing 200 and the vane 204 is moved to an intermediate phase angle position or a mid-position within the chamber 217 formed between the housing assembly 200 and the rotor assembly 205. As soon as the lock pin 225 is aligned with the recess 227, the lock pin 225 engages the recess 227.

If the vane 204 was positioned within the housing assembly 200 near or in the advance position, fluid from the advance chamber 202 flows through advance line 212 to the control valve 209 through port 280. From the control valve 209, fluid flows through line 235 and retard recirculating check valve 208 to line 236 and enters the control valve 209 through port 287. From the control valve 209, fluid enters common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205. As soon as the lock pin 225 is aligned with the recess 227, the lock pin engages the recess 227.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*.

Figure 30:
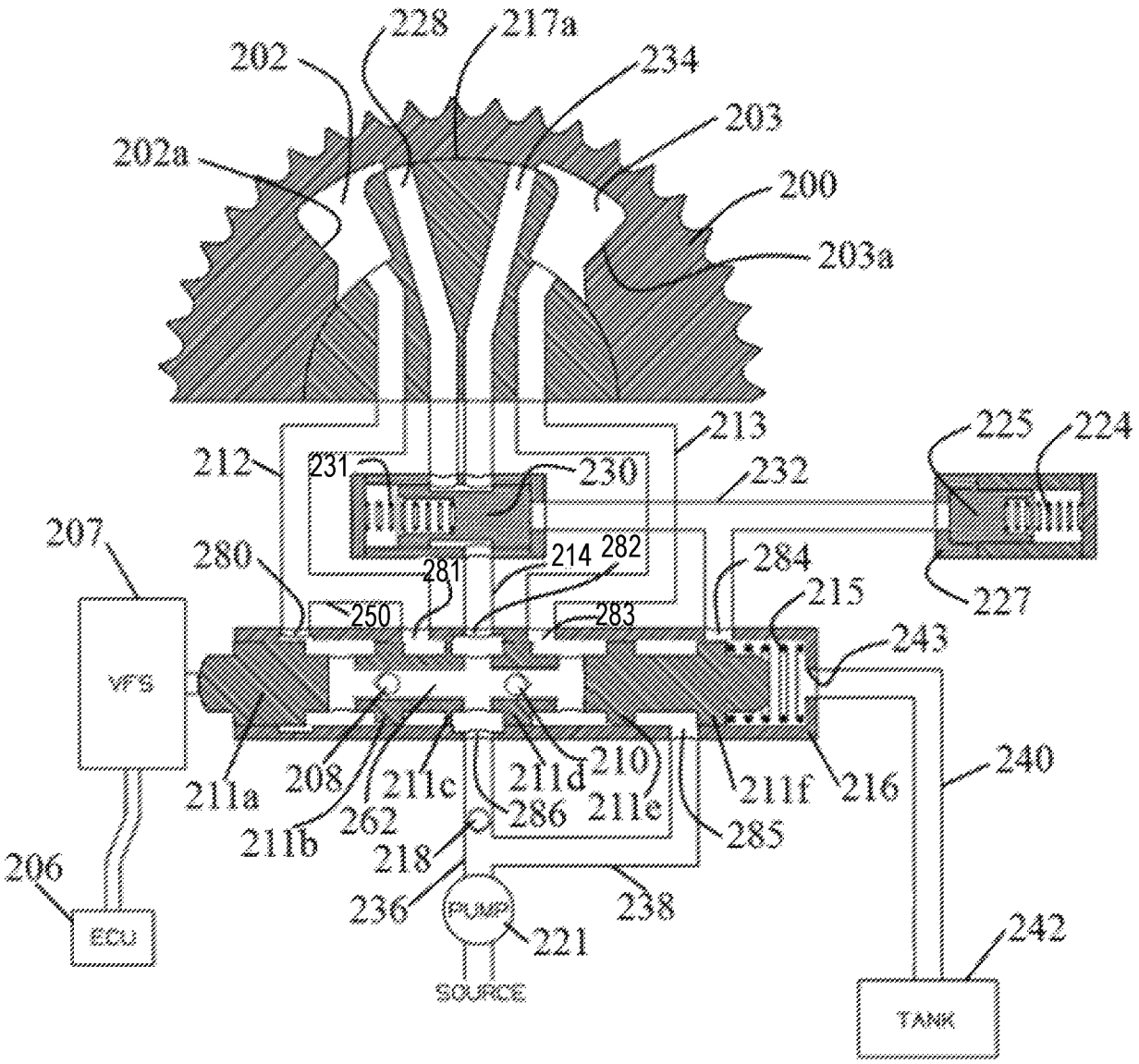
FIG. 30 shows a phaser of an alternate embodiment at the midlock or intermediate locking position with metered edges on the major diameter of the rotor with check valves present in the spool of the control valve and a lock pin with recirculation.

FIG. 30 shows a phaser of an alternate embodiment at the midlock or intermediate locking position with metered edges on the major diameter of the rotor with recirculation and a lock pin.

This embodiment differs from the embodiment of FIGS. 19-24, in that the control valve 209 includes a central passage 262 with the retard recirculating check valve 208 and the advance recirculating check valve 210, exhaust lines 239 and 241 and associated vent orifices 260 and 261 have been removed. The same reference numbers of FIGS. 19-24 are used for this embodiment as applicable.

A hydraulic detent circuit 233 and a lock pin circuit 223 are present. The hydraulic detent circuit 233 and the lock pin circuit 223 are essentially one circuit, but will be discussed separately for simplicity.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The passages 228, 234 within the vane 204 are the advance detent line 228 and the retard detent line 234.

The lock pin 225 is slidably housed in a bore in the rotor assembly 205 and has an end portion that is biased towards and fits into a recess 227 in the housing assembly 200 by a spring 224. Alternatively, the lock pin 225 may be housed in the housing assembly 200 and be spring 224 biased towards a recess 227 in the rotor assembly 205. The opening and closing of the hydraulic detent circuit 233 and pressurization of the lock pin circuit 223 are both controlled by the switching/movement of the oil control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The spool 211 also includes an retard recirculating check valve 208 and a advance recirculating check valve 210 within a central passage 262 of the spool 211. The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-286. The port 280 is in fluid communication with the advance line 212. Port 281 is in fluid communication with line 250. Port 282 is in fluid communication with common line 214. Port 283 is in fluid communication with retard line 213. Port 284 is in fluid communication with the hydraulic detent circuit 233 and line 232. Port 285 is in communication with line 238. Port 286 is in fluid communication with line 236. Since no vent orifices are present in the spool except for vent orifice 243, in communication with the pilot valve 230, this phaser operates solely as a cam torque actuated phaser.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 through the spool 211 and recirculate to the advance chamber 202 through the advance recirculating check valve 210 within the control valve 209. Fluid is blocked from exiting the advance chamber 202, and the detent valve circuit 233 is off or closed. The lock pin 225 is in an unlocked position.

In the retard mode, the spool 211 is moved to a position so that fluid may flow from the advance chamber 202 through the spool 211 and recirculate to the retard chamber 203 through the retard recirculating check valve 208 within the control valve 209. Fluid is blocked from exiting the retard chamber 203 and the detent valve circuit 233 is off. The lock pin 225 is in an unlocked position.

In null mode, the spool 211 is moved to a position that blocks the exit of fluid from the advance and retard chambers 202, 203, and the detent valve circuit 233 is off. The lock pin 225 is in an unlocked position.

In the detent mode, as shown in FIG. 30, three functions occur simultaneously. The first function in the detent mode is that the spool 211 moves to a position in which spool land 211*c* blocks the flow of fluid from the advance line 212 to the retard line 213, spool land 211*d* blocks the flow of fluid from the retard line 213 to the advance line 212, effectively removing control of the phaser from the control valve 209. At the same time, any fluid that does exit the advance chamber 202 can flow through advance line 212 to between spool lands 211*a* and 211*b*, to passage 262, through retard recirculating check valve 208 to common line 214. From common line 214, fluid can flow through the pilot valve 230 and enter the advance detent line 228 or the retard detent line 234. Any fluid that does exit the retard chamber 203 can flow through retard line 213 to between spool lands 211*d* and 211*e* to passage 262, through the advance recirculating check valve 210 to common line 214. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function in the detent mode is to vent the lock pin circuit 223, allowing the lock pin 225 to engage the recess 227. The intermediate phase angle position or mid-position is when the vane 204 is somewhere between the advance wall 202*a* and the retard wall 203*a* defining the chamber between the housing assembly 200 and the rotor assembly 205. The intermediate phase angle position can be anywhere between the advance wall 202*a* and retard wall 203*a* and is determined by where the detent passages 228 and 234 are within the vane 204.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed and the lock pin 225 will be pressurized and released.

When the duty cycle of the variable force solenoid 207 is 0%, the spool 211 is moved to the detent mode such that the pilot valve 230 vents and moves to the second position, the hydraulic detent circuit 233 will be open. A duty cycle of 0% was chosen as the extreme position along the spool stroke to open the hydraulic detent circuit 233 and vent the pilot valve 230, since if power or control is lost, the phaser will default to a locked position. It should be noted that the duty cycle percentages listed above are an example and they may be altered. Furthermore, the hydraulic detent circuit 233 may be open, and the pilot valve 230 vented at 100% duty cycle, if desired.

When the duty cycle of the variable force solenoid 207 is just set to 0%, the force on the VFS on the spool 211 is decreased, and the spring 215 moves the spool 211 to the far left end of the spool's travel to a detent position as shown in FIG. 30. In this detent position, spool land 211*c* blocks the flow of fluid from advance line 212 and line 235 from exhausting to the retard chamber 203 and spool land 211*c* also blocks most of the flow of fluid from retard line 213 from exhausting to the advance chamber 202, effectively removing control of the phaser from the control valve 209. At the same time, fluid from source may flow through inlet line 236 and inlet check valve 218 to the common line 214 between spool lands 211*c* and 211*d*. Fluid from the advance line 212 can however pass to central passage 262, through the retard recirculating check valve 208 and enter the common line 214 between spool lands 211*c* and 211*d*. Fluid from retard line 213 can also pass through to central passage 262, through the advance recirculating check valve 210 and enter the common line 214 between spool lands 211*c* and 211*d*.

Fluid is prevented from flowing through line 238 to the pilot valve 230 and the lock pin 225 via line 232 by spool land 211*f*. The pilot valve 230 vents to exhaust orifice 243 at the end of the sleeve 216, opening passage between the advance detent line 228 and the retard detent line 234 through the pilot valve 230 to the common line 214, in other words opening the hydraulic detent circuit 233.

If the vane 204 was positioned within the housing assembly 200 near or in the retard position, fluid from the retard chamber 203 flows through retard line 213 to the control valve 209 through port 283. Within the control valve 209, fluid flows through central passage 262 and advance recirculating check valve 210 to common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber by the metered edge 204*a* being sealed by the arc 217*a* of the housing 200 and the vane 204 is moved to an intermediate phase angle position or a mid-position within the chamber formed between the housing assembly 200 and the rotor assembly 205. As soon as the lock pin 225 is aligned with the recess 227, the lock pin 225 engages the recess 227.

If the vane 204 was positioned within the housing assembly 200 near or in the advance position, fluid from the advance chamber 202 flows through advance line 212 to the control valve 209 through port 280. Within the control valve 209, fluid flows through central passage 262 and retard recirculating check valve 208 to common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205. As soon as the lock pin 225 is aligned with the recess 227, the lock pin engages the recess 227.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*.

Figure 31:
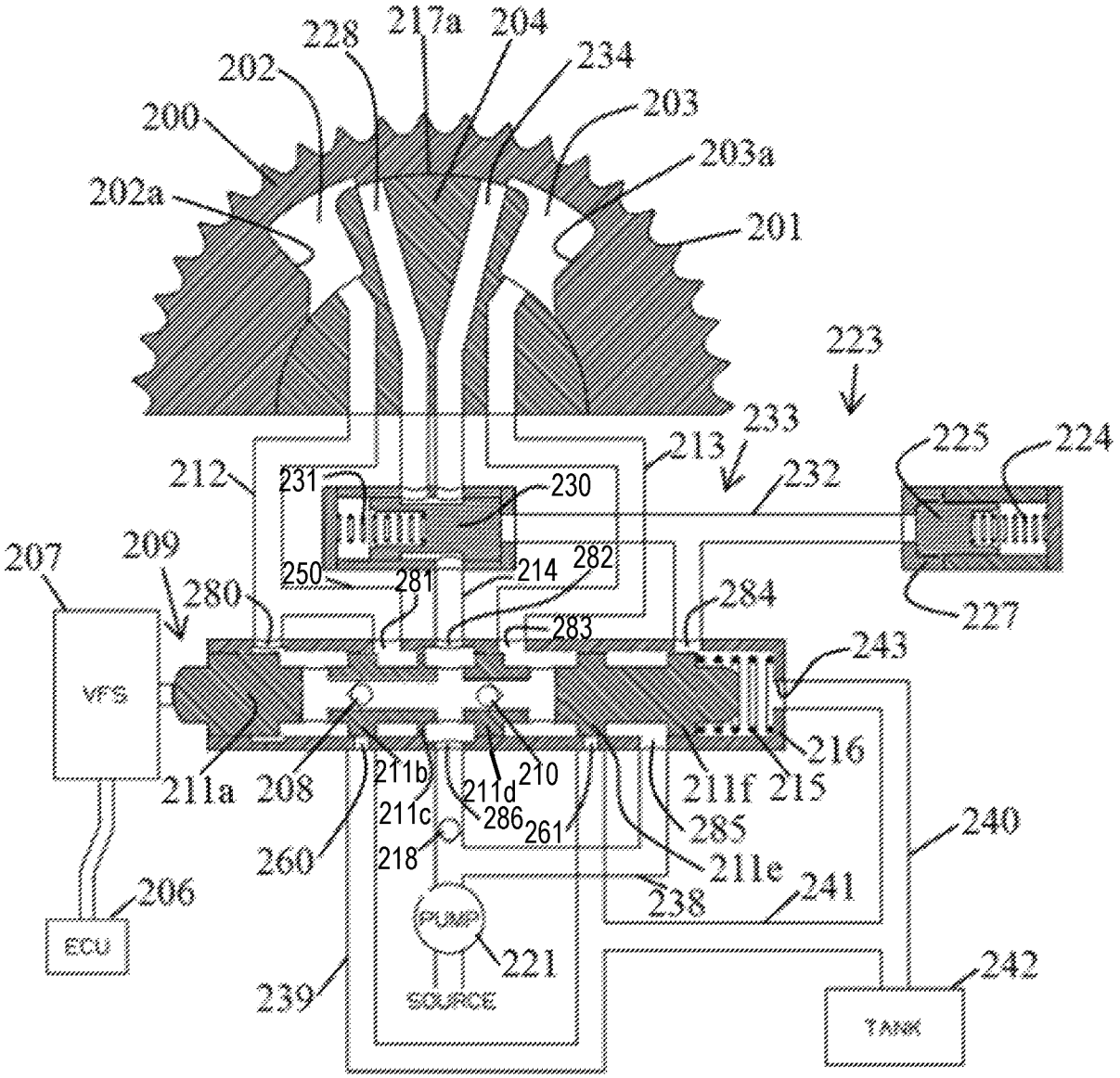
FIG. 31 shows a phaser of an alternate embodiment at the midlock or intermediate locking position with metered edges on the major diameter of the rotor with check valves present in the spool of the control valve, a lock pin and recirculation and vent.

FIG. 31 shows a phaser of an alternate embodiment at the midlock or intermediate locking position with metered edges on the major diameter of the rotor assembly with check valves present in the spool of the control valve, a lock pin and recirculation.

This embodiment differs from the embodiment of FIGS. 19-24, in that the control valve 209 includes a central passage 262 with the retard recirculating check valve 208 and the advance recirculating check valve 210. The same reference numbers of FIGS. 19-24 are used for this embodiment as applicable.

A hydraulic detent circuit 233 and a lock pin circuit 223 are also present. The hydraulic detent circuit 233 and the lock pin circuit 223 are essentially one circuit, but will be discussed separately for simplicity.

The hydraulic detent circuit 233 includes a spring 231 loaded pilot valve 230 and an advance detent line 228 that connects the advance chamber 202 to the pilot valve 230 and the common line 214, and a retard detent line 234 that connects the retard chamber 203 to the pilot valve 230 and the common line 214. The passages 228, 234 within the vane 204 are the advance detent line 228 and the retard detent line 234. The opening and closing of the hydraulic detent circuit 233 is controlled by the switching/movement of the oil control valve 209.

The lock pin 225 is slidably housed in a bore in the rotor assembly 205 and has an end portion that is biased towards and fits into a recess 227 in the housing assembly 200 by a spring 224. Alternatively, the lock pin 225 may be housed in the housing assembly 200 and be spring 224 biased towards a recess 227 in the rotor assembly 205. The opening and closing of the hydraulic detent circuit 233 and pressurization of the lock pin circuit 223 are both controlled by the switching/movement of the oil control valve 209.

A control valve 209, preferably a spool valve, includes a spool 211 with cylindrical lands 211*a*, 211*b*, 211*c*, 211*d*, 211*e*, and 211*f* slidably received in a sleeve 216 within a bore in the rotor assembly 205 and pilots in the camshaft (not shown). The spool 211 also includes an retard recirculating check valve 208 and a advance recirculating check valve 210 within a central passage 262 of the spool 211. The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 280-286 and vent orifices 260-261. The port 280 is in fluid communication with the advance line 212. Port 281 is in fluid communication with line 250. Port 282 is in fluid communication with common line 214. Port 283 is in fluid communication with retard line 213. Port 284 is in fluid communication with the hydraulic detent circuit 233 and the lock pin circuit 223 via line 232. Port 285 is in communication with line 238. Vent orifice 261 is in communication with tank 242 through line 239. Port 286 is in fluid communication with line 237. Port 287 is communication with line 236. Vent orifice 260 is in communication with tank 242 through line 239.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors.

The position of the spool 211 is influenced by spring 215 and the solenoid 207 controlled by the ECU 206. Further detail regarding control of the phaser is discussed in detail below. The position of the spool 211 controls the motion (e.g. to move towards the advance position, holding position, or the retard position) of the phaser as well as whether the lock pin circuit 223 and the hydraulic detent circuit 233 are open (on) or closed (off). In other words, the position of the spool 211 actively controls the pilot valve 230. The control valve 209 has an advance mode, a retard mode, a null mode (holding position), a detent mode.

In the advance mode, the spool 211 is moved to a position so that fluid may flow from the retard chamber 203 through the spool 211 and to sump or tank 242 via exhaust line 239 and line 241. Fluid is blocked from exiting the advance chamber 202, and the detent valve circuit 233 is off or closed. The lock pin 225 is in an unlocked position.

In the retard mode, the spool 211 is moved to a position so that fluid may flow from the advance chamber 202 through the spool 211 and to sump or tank 242 via exhaust line 239 and line 241. Fluid is blocked from exiting the retard chamber 203 and the detent valve circuit 233 is off. The lock pin 225 is in an unlocked position.

In null mode, the spool 211 is moved to a position that blocks the exit of fluid from the advance and retard chambers 202, 203 to the tank 242, and the detent valve circuit 233 is off. The lock pin 225 is in an unlocked position.

In the detent mode, as shown in FIG. 31, three functions occur simultaneously. The first function in the detent mode is that the spool 211 moves to a position in which spool land 211*b* blocks the flow of fluid from advance line 212 to tank 242, spool land 211*e* blocks the flow of fluid from retard line 213 to tank 242, spool lands 211*c* and 211*d* block fluid from exiting either advance line 212 and retard line 213 to each other, effectively removing control of the phaser from the control valve 209. At the same time, any fluid that does exit the advance chamber 202 can flow through advance line 212 to between spool lands 211*a* and 211*b*, to central passage 262 and through the retard recirculating check valve 208 to common line 214. Fluid which exits through the retard chamber 203 can flow through the retard line 213 to the control valve 209 between spool lands 211*d* and 211*e*, to central passage 262 and through the advance recirculating check valve 210. From common line 214, fluid can flow through the pilot valve 230 and enter the advance detent line 228 or the retard detent line 234.

The second function in detent mode is to open or turn on the detent valve circuit 233. The detent valve circuit 233 has complete control over the phaser moving to advance or retard, until the vane 204 reaches the intermediate phase angle position.

The third function in the detent mode is to vent the lock pin circuit 223, allowing the lock pin 225 to engage the recess 227. The intermediate phase angle position or mid-position is when the vane 204 is somewhere between the advance wall 202*a* and the retard wall 203*a* defining the chamber between the housing assembly 200 and the rotor assembly 205. The intermediate phase angle position can be anywhere between the advance wall 202*a* and retard wall 203*a* and is determined by where the advance and retard detent lines 228 and 234 are within the vane 204.

Based on the duty cycle of the pulse width modulated variable force solenoid 207, the spool 211 moves to a corresponding position along its stroke. When the duty cycle of the variable force solenoid 207 is approximately 40%, 60% or 80%, the spool 211 will be moved to positions that correspond with the retard mode, the null mode, and the advance mode, respectively and the pilot valve 230 will be pressurized and move to the second position, the hydraulic detent circuit 233 will be closed, and the lock pin 225 will be pressurized and released.

When the duty cycle of the variable force solenoid 207 is 0%, the spool 211 is moved to the detent mode such that the pilot valve 230 vents and moves to the second position, the hydraulic detent circuit 233 will be open. A duty cycle of 0% was chosen as the extreme position along the spool stroke to open the hydraulic detent circuit 233 and vent the pilot valve 230, since if power or control is lost, the phaser will default to a locked position. It should be noted that the duty cycle percentages listed above are an example and they may be altered. Furthermore, the hydraulic detent circuit 233 may be open, and the pilot valve 230 vented at 100% duty cycle, if desired.

When the duty cycle of the variable force solenoid 207 is just set to 0%, the force on the VFS on the spool 211 is decreased, and the spring 215 moves the spool 211 to the far left end of the spool's travel to a detent position as shown in FIG. 31. In this detent position, spool land 211*b* blocks the flow of fluid from advance line 212 from exhausting to tank 242 via line 239 and spool land 211*e* blocks the flow of fluid from retard line 213 from exhausting to tank 242 through exhaust line 239, spool lands 211*c* and 211*d* block fluid from exiting either advance line 212 and retard line 213 to each other, effectively removing control of the phaser from the control valve 209. At the same time, fluid from source may flow through line 236 and inlet check valve 218 to the common line 214 between spool lands 211*c* and 211*d*. Fluid from advance line 212 fluid flows into the central passage 262 of the control valve 209 and flows through the retard recirculating check valve 208 and enters the common line 214 between spool lands 211*c* and 211*d*. Fluid from the retard line 213 fluid passes into central passage 262 and flows through the advance recirculating check valve 210 to common line 214 between spool lands 211*c* and 211*d*.

Fluid is prevented from flowing through line 238 to the pilot valve 230 and the lock pin 225 by spool land 211*f*. The pilot valve 230 and lock pin 225 vent to exhaust orifice 243 at the end of the sleeve 216, opening passage between the advance detent line 228 and the retard detent line 234 through the pilot valve 230 to the common line 214, in other words opening the hydraulic detent circuit 233.

If the vane 204 was positioned within the housing assembly 200 near or in the retard position, fluid from the retard chamber 203 flows through retard line 213 to the control valve 209 through port 283. Within the control valve 209, fluid flows through central passage 262 and advance recirculating check valve 210 to common line 214 and flows through the pilot valve 230 to the advance detent line 228, which is exposed to the advance chamber 202. The fluid flowing to the advance chamber 202 moves the vane 204 relative to the housing assembly 200 to close off the advance detent line 228 to the advance chamber by the metered edge 204*a* being sealed by the arc 217*a* of the housing 200 and the vane 204 is moved to an intermediate phase angle position or a mid-position within the chamber formed between the housing assembly 200 and the rotor assembly 205. As soon as the lock pin 225 is aligned with the recess 227, the lock pin 225 engages the recess 227.

If the vane 204 was positioned within the housing assembly 200 near or in the advance position, fluid from the advance chamber 202 flows through advance line 212 to the control valve 209 through port 280. Within the control valve 209, fluid flows through central passage 262 and retard recirculating check valve 208 to common line 214 and flows through the pilot valve 230 to the retard detent line 234, which is exposed to the retard chamber 203. The fluid flowing to the retard chamber 203 moves the vane 204 relative to the housing assembly 200 to close off the retard detent line 234 to the retard chamber 203 by the metered edge 204*b* being sealed by the arc 217*a* of the housing assembly 200 and the vane 204 is moved to an intermediate phase angle position or a mid-position within the chamber formed between the housing assembly 200 and the rotor assembly 205. As soon as the lock pin 225 is aligned with the recess 227, the lock pin 225 engages the recess 227.

The advance detent line 228 and the retard detent line 234 are completely closed off or blocked by the rotor assembly 205 from the advance and retard chambers 202, 203 when phaser is in the mid-position or intermediate phase angle position by the metered edges 204*a*, 204*b*.

Figure 32:
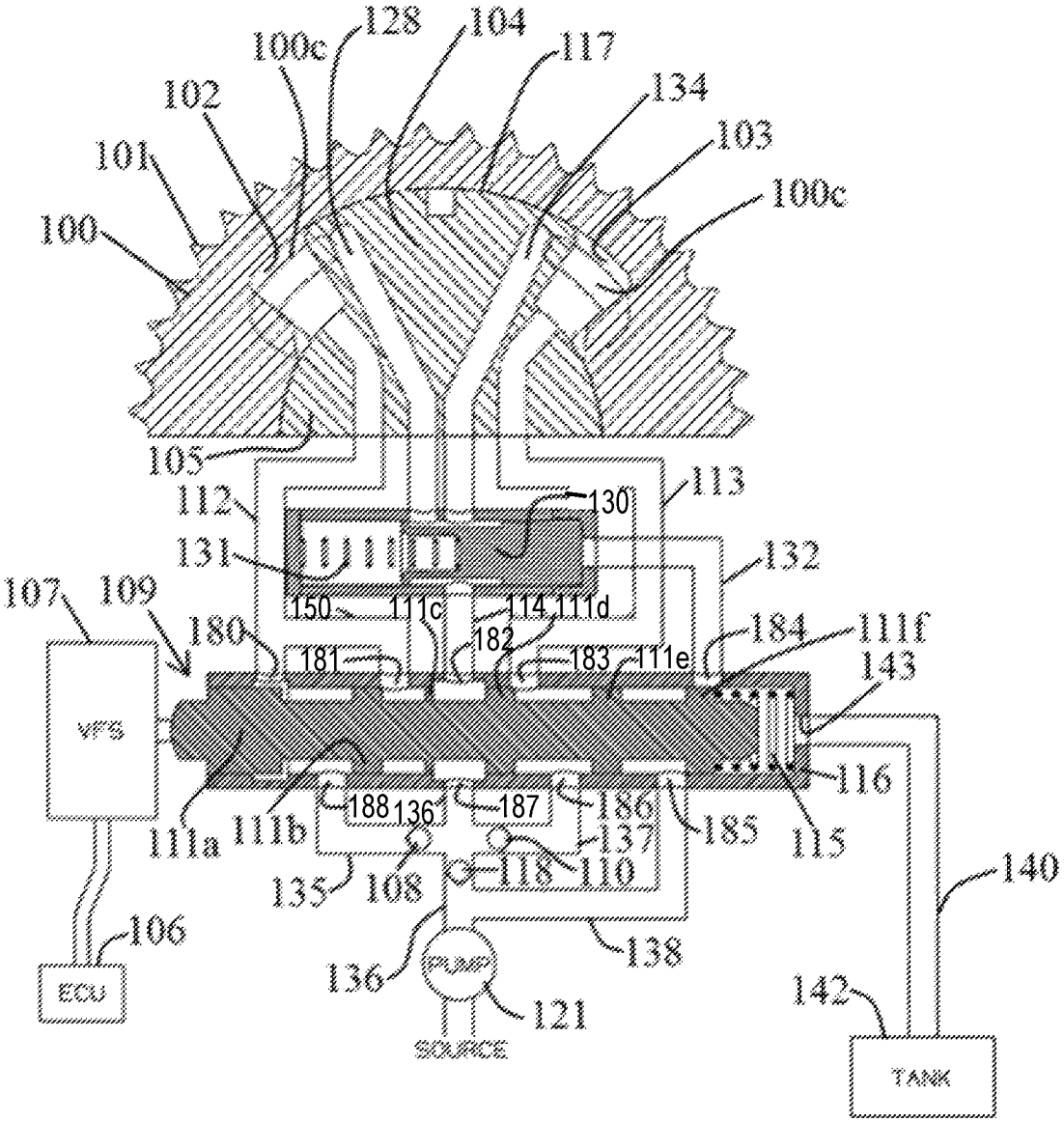
FIG. 32 shows a phaser of another alternate embodiment at the midlock or intermediate locking position with metered pockets on the rotor and the end plate with recirculation.

FIG. 32 shows a phaser of another alternate embodiment at the midlock or intermediate locking position with metered pockets on the rotor and the end plate.

This embodiment differs from the embodiment of FIGS. 1-18, in that the advance and retard check valves 108, 110 were moved out of the control valve 109 and the vent orifices 160, 161 were removed, along with associated exhaust lines 139 and 144. The same reference numbers of FIGS. 1-18 are used for this embodiment as applicable.

A hydraulic detent circuit 133 includes a spring 131 loaded pilot valve 130 and an advance detent line 128 that connects the advance chamber 102 to the pilot valve 130 and the common line 114 via a rotor advance metered pocket 102*b*, and a retard detent line 134 that connects the retard chamber 103 to the pilot valve 130 and the common line 114 via a rotor retard metered pocket 103*b*. The advance detent line 128 and the retard detent line 134 are present within the vane 104.

A control valve 109, preferably a spool valve, includes a spool 111 with cylindrical lands 111*a*, 111*b*, 111*c*, 111*d*, 111*e*, and 111*f* slidably received in a sleeve 116 within a bore in the rotor assembly 105 and pilots in the camshaft (not shown). The control valve 109 may be located remotely from the phaser, within a bore in the rotor assembly 105 which pilots in the camshaft, or in a center bolt of the phaser. One end of the spool 111 contacts spring 115 and the opposite end of the spool 111 contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-188. The port 180 is in fluid communication with the advance line 112. Port 181 is in fluid communication with line 150. Port 182 is in fluid communication with common line 114. Port 183 is in fluid communication with retard line 113. Port 184 is in fluid communication with the hydraulic detent circuit 133 and line 132. Port 185 is in communication with line 138. Port 186 is in fluid communication with line 137. Port 187 is communication with line 136. Port 188 is in fluid communication with line 136. Since no vent orifices are present in the spool except for vent 143, in communication with the pilot valve 130, this phaser operates solely as a cam torque actuated phaser.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 is open (on) or closed (off). In other words, the position of the spool 111 actively controls the pilot valve 130. The control valve 109 has an advance mode, a retard mode, a null mode (holding position), a detent mode.

In the advance mode, the spool 111 is moved to a position so that fluid may flow from the retard chamber 103 through the spool 111 and recirculate to the advance chamber 102 through the advance recirculating check valve 110. Fluid is blocked from exiting the advance chamber 102, and the detent valve circuit 133 is off or closed.

In the retard mode, the spool 111 is moved to a position so that fluid may flow from the advance chamber 102 through the spool 111 and recirculate to the retard chamber 103 through the retard recirculating check valve 108. Fluid is blocked from exiting the retard chamber 103 and the detent valve circuit 133 is off.

In null mode, the spool 111 is moved to a position that blocks the exit of fluid from the advance and retard chambers 102, 103, and the detent valve circuit 133 is off.

In the detent mode, as shown in FIG. 32, three functions occur simultaneously. The first function in the detent mode is that the spool 111 moves to a position in which spool land 111*c* blocks the flow of fluid from advance line 112 to retard line 113, spool land 111*d* blocks the flow of fluid from retard line 113 to advance line 112, effectively removing control of the phaser from the control valve 109. At the same time, any fluid that does exit the advance chamber 102 can flow through advance line 112 to between spool lands 111*a* and 111*b* to line 135. From 135, fluid flows through the retard recirculating check valve 108 to inlet line 136, between spool lands 111*c* and 111*d* to common line 114. From common line 114, fluid can flow through the pilot valve 130 and enter the advance detent line 128 or the retard detent line 134. Any fluid that does exit the retard chamber 103 can flow through retard line 113 to between spool lands 111*d* and 111*e* to line 137. From line 137, fluid flows through the advance recirculating check valve 110 to inlet line 136, between spool lands 111*c* and 111*d* and to common line 114. From common line 114, fluid can flow through the pilot valve 130 and enter the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function is the intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance detent passage 128 and end plate metering pocket 100*c* overlap and the retard detent passage 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133 and vent the pilot valve 130, since if power or control is lost, the phaser will default to a locked position. It should be noted that the duty cycle percentages listed above are an example and they may be altered. Furthermore, the hydraulic detent circuit 133 may be open and the pilot valve 130 vented at 100% duty cycle, if desired.

In order for the phaser to be in detent position the duty cycle of the VFS 107 is set to 0%. In the example of the figures, the stroke of the spool 111 or position of the spool 111 relative to the sleeve 116.

When the duty cycle of the variable force solenoid 107 is just set to 0%, the force on the VFS on the spool 111 is decreased, and the spring 115 moves the spool 111 to the far left end of the spool's travel to a detent position as shown in the FIG. 32. In this detent position, spool land 111*c* blocks the flow of fluid from advance line 112 in between spool lands 111*a* and 111*b* from exhausting to the retard chamber 103 and spool land 111*d* blocks the flow of fluid from retard line 113 exhausting to the advance chamber 102, effectively removing control of the phaser from the control valve 109. At the same time, fluid from source may flow through inlet line 136 and inlet check valve 118 to the common line 114 between spool lands 111*c* and 111*d*.

Fluid is prevented from flowing through line 138 to the pilot valve 130 by spool land 111*f*. The pilot valve 130 vents fluid to the exhaust orifice 143 at the end of the sleeve 116, opening passage between the advance detent line 128 and the retard detent line 134 through the pilot valve 130 to the common line 114, in other words opening the hydraulic detent circuit 133.

When the duty cycle of the variable force solenoid 107 is 0%, the spool is in detent mode, the pilot valve 130 is vented, the hydraulic detent circuit 133 is open or on, and the rotor assembly 105 is preferably in a mid-position or an intermediate phase angle position. Depending on where the vane 104 was prior to the duty cycle of the variable force solenoid 107 being changed to 0%, either the advance detent line 128 or the retard detent line 134 will be exposed to the advance or retard chamber 102, 103 by end plate advance and retard metering pocket 100*c*, 100*d* respectively.

If the vane 104 was positioned within the housing assembly 100 near or in the retard position fluid from the retard chamber 103 flows through retard line 113 to the control valve 109 through port 183. From the control valve 109, fluid flows to port 186 and to line 137 and through the advance recirculating check valve 110 to port 182 and into line 114. From line 114, fluid flows through the open pilot valve 130 and to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the end plate advance metering pocket 100*c* within the chamber formed between the housing assembly 100 and the rotor assembly 105.

If the vane 104 was positioned within the housing assembly 100 near or in the advance position fluid from the advance chamber 102 flows through advance line 112 to the control valve 109 through port 180. From the control valve 109, fluid flows to line 135 through port 188, through the retard recirculating check valve 108 through port 182 and into common line 114. From common line 114, fluid flows through open pilot valve 130 and the retard detent line 134 which is exposed to the retard chamber 103 through the aligned rotor retard metering pocket 103*b* and end plate metered pocket 100*d*. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are closed off by the end plate metered pockets 100*c*, 100*d* and rotor metering pockets 102*b* and 103*b*.

Figure 33:
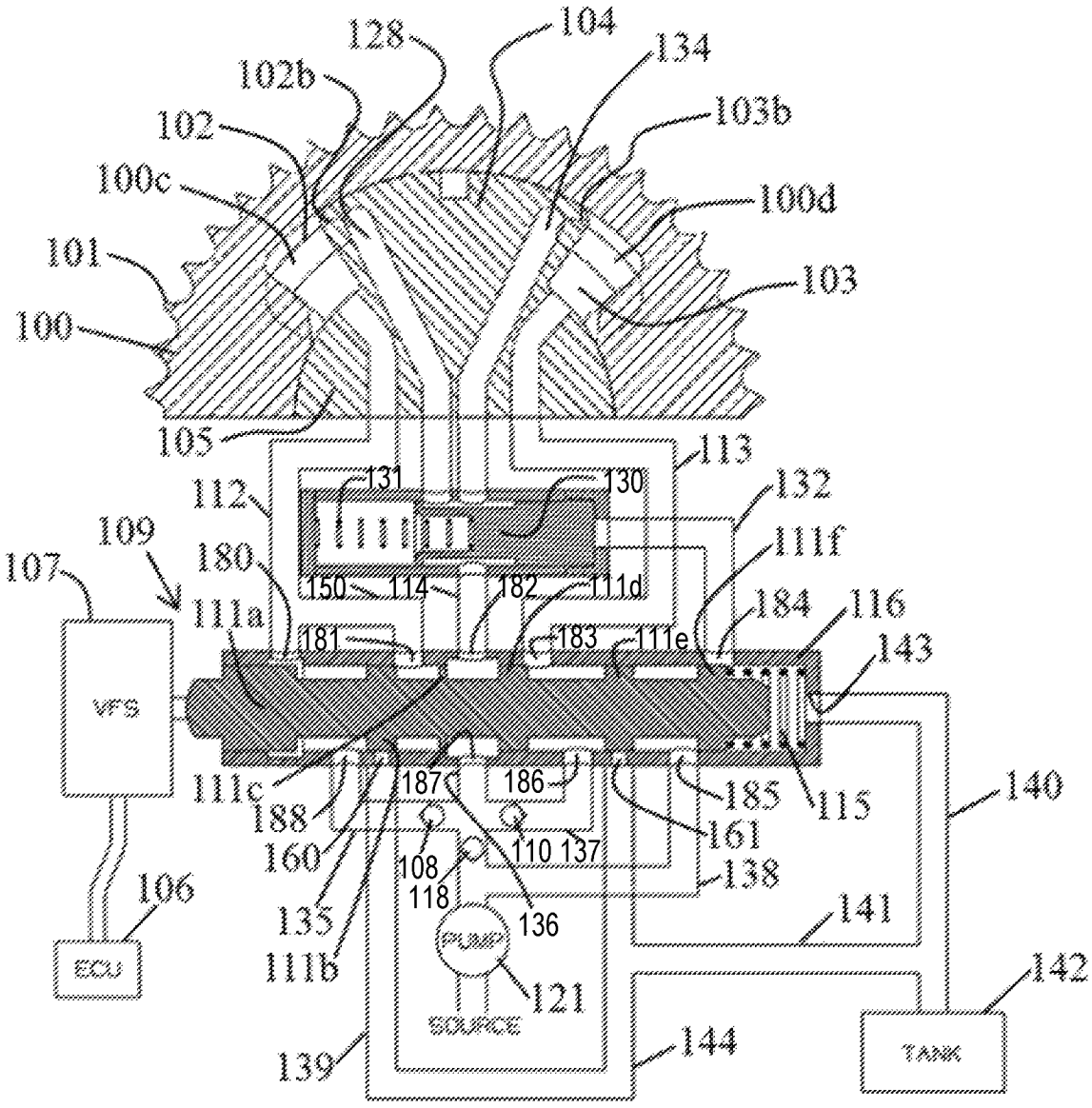
FIG. 33 shows a phaser of another alternate embodiment at the midlock or intermediate locking position with metered pockets on the rotor and the end plate and recirculation and vent.

FIG. 33 shows a phaser of another alternate embodiment at the midlock or intermediate locking position with metered pockets on the rotor and the end plate and recirculation.

This embodiment differs from the embodiment of FIGS. 1-18, in that the advance and retard check valves 108, 110 were moved out of the control valve 109. The same reference numbers of FIGS. 1-18 are used for this embodiment as applicable.

A hydraulic detent circuit 133 includes a spring 131 loaded pilot valve 130 and an advance detent line 128 that connects the advance chamber 102 to the pilot valve 130 and the common line 114 via the rotor advance metered pocket 102*b*, and a retard detent line 134 that connects the retard chamber 103 to the pilot valve 130 and the common line 114 via the rotor retard metered pocket 103*b*. The advance detent line 128 and the retard detent line 134 are present within the vane 104. The opening and closing of the hydraulic detent circuit 133 is controlled by the switching/movement of the oil control valve 109.

A control valve 109, preferably a spool valve, includes a spool 111 with cylindrical lands 111*a*, 111*b*, 111*c*, 111*d*, 111*e*, and 111*f* slidably received in a sleeve 116 within a bore in the rotor assembly 105 and pilots in the camshaft (not shown). The control valve 109 may be located remotely from the phaser, within a bore in the rotor assembly 105 which pilots in the camshaft, or in a center bolt of the phaser. One end of the spool 111 contacts spring 115 and the opposite end of the spool 111 contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-188 and vent orifices 160-161. The port 180 is in fluid communication with the advance line 112. Port 181 is in fluid communication with line 150. Port 182 is in fluid communication with common line 114. Port 183 is in fluid communication with retard line 113. Port 184 is in fluid communication with the hydraulic detent circuit 133. Port 185 is in communication with line 138. Vent orifice 161 is in communication with tank 142 through line 139. Port 186 is in fluid communication with line 137. Port 187 is communication with line 136. Port 188 is in fluid communication with line 135. Vent orifice 160 is in communication with tank 142 through line 139.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 are open (on) or closed (off). In other words, the position of the spool 111 actively controls the pilot valve 130. The control valve 109 has an advance mode, a retard mode, a null mode (holding position), a detent mode.

In the advance mode, the spool 111 is moved to a position so that fluid may flow from the retard chamber 103 through the spool 111 and to sump or tank 142 via exhaust line 144 and line 141. Fluid is blocked from exiting the advance chamber 102, and the detent valve circuit 133 is off or closed.

In the retard mode, the spool 111 is moved to a position so that fluid may flow from the advance chamber 102 through the spool 111 and to sump or tank 142 via exhaust line 139 and line 141. Fluid is blocked from exiting the retard chamber 103 and the detent valve circuit 133 is off.

In null mode, the spool 111 is moved to a position that blocks the exit of fluid from the advance and retard chambers 102, 103 to the tank 142, and the detent valve circuit 133 is off.

In the detent mode, as shown in FIG. 33, three functions occur simultaneously. The first function in the detent mode is that the spool 111 moves to a position in which spool land 111*b* blocks the flow of fluid from advance line 112 to tank 142, spool land 111*e* blocks the flow of fluid from retard line 113 to tank 142, spool lands 111*c* and 111*d* block fluid from exiting either advance line 112 and retard line 113 to each other, effectively removing control of the phaser from the control valve 109. At the same time, any fluid that does exit the advance chamber 102 can flow through advance line 112 to between spool lands 111*a* and 111*b*, to line 135. From line 135, fluid flows through retard recirculating check valve 108 to line 136, between spool lands 111*c* and 111*d* to common line 114. Fluid that exits the retard chamber 103 can flow through the retard line 113 between spool lands 111*d* and 111*e*, to line 137. From line 137, fluid flows through advance recirculating check valve 110 to line 136 and to common line 114. From common line 114, fluid can flow through the pilot valve 130 and enter the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function is that the vane is moved to an intermediate phase angle position or mid-position. This position of the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance detent line 128 and end plate metering pocket 100*c* and the retard detent line 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133 and vent the pilot valve 130, since if power or control is lost, the phaser will default to an intermediate position. It should be noted that the duty cycle percentages listed above are an example and they may be altered. Furthermore, the hydraulic detent circuit 133 may be open, and the pilot valve 130 vented at 100% duty cycle, if desired.

When the duty cycle of the variable force solenoid 107 is just set to 0%, the force on the VFS on the spool 111 is decreased, and the spring 115 moves the spool 111 to the far left end of the spool's travel to a detent position as shown in FIG. 33. In this detent position, spool land 111*b* blocks the flow of fluid from advance line 112 in between spool lands 111*a* and 111*b* from exhausting to tank 142 through exhaust line 139 and spool land 111*e* blocks the flow of fluid from retard line 113 from exhausting to tank 142 through exhaust line 139, spool lands 111*c* and 111*d* block fluid from exiting either advance line 112 and retard line 113 to each other, effectively removing control of the phaser from the control valve 109. At the same time, fluid from source may flow through line 136 and inlet check valve 118 to the common line 114 between spool lands 111*c* and 111*d*. Fluid from advance line 112 can however pass through line 135, retard recirculating check valve 108 and enter line 135 and to the common line 114 between spool lands 111*c* and 111*d*. Fluid from retard line 113 can also pass through line 137, advance recirculating check valve 110 and enter line 135 to the common line 114 between spool lands 111*c* and 111*d*.

Fluid is prevented from flowing through line 138 to the pilot valve 130 by spool land 111*f*. The pilot valve 130 vents to exhaust orifice 143 at the end of the sleeve 116, opening passage between the advance detent line 128 and the retard detent line 134 through the pilot valve 130 to the common line 114, in other words opening the hydraulic detent circuit 133.

If the vane 104 was positioned within the housing assembly 100 near or in the retard position fluid from the retard chamber 103 flows through retard line 113 to the control valve 109 through port 183. From the control valve 109, fluid flows to port 186 and to line 137 and through the advance recirculating check valve 110 to port 182 and into the common line 114. From line 114, fluid flows through the open pilot valve 130 and to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the end plate advance metering pocket 100*c* within the chamber formed between the housing assembly 100 and the rotor assembly 105.

If the vane 104 was positioned within the housing assembly 100 near or in the advance position fluid from the advance chamber 102 flows through advance line 112 to the control valve 109 through port 180. From the control valve 109, fluid flows to line 135 through port 188, through the retard recirculating check valve 108 to common line 114 through port 187. Fluid flows from the control valve 109 to port 182 and the common line 114. From common line 114, fluid flows through open pilot valve 130 and the retard detent line 134 which is exposed to the retard chamber 103. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are partially open by the end plate metered pockets 100*c*, 100*d* and rotor metering pockets 102*b*, 103*b*.

Figure 34:
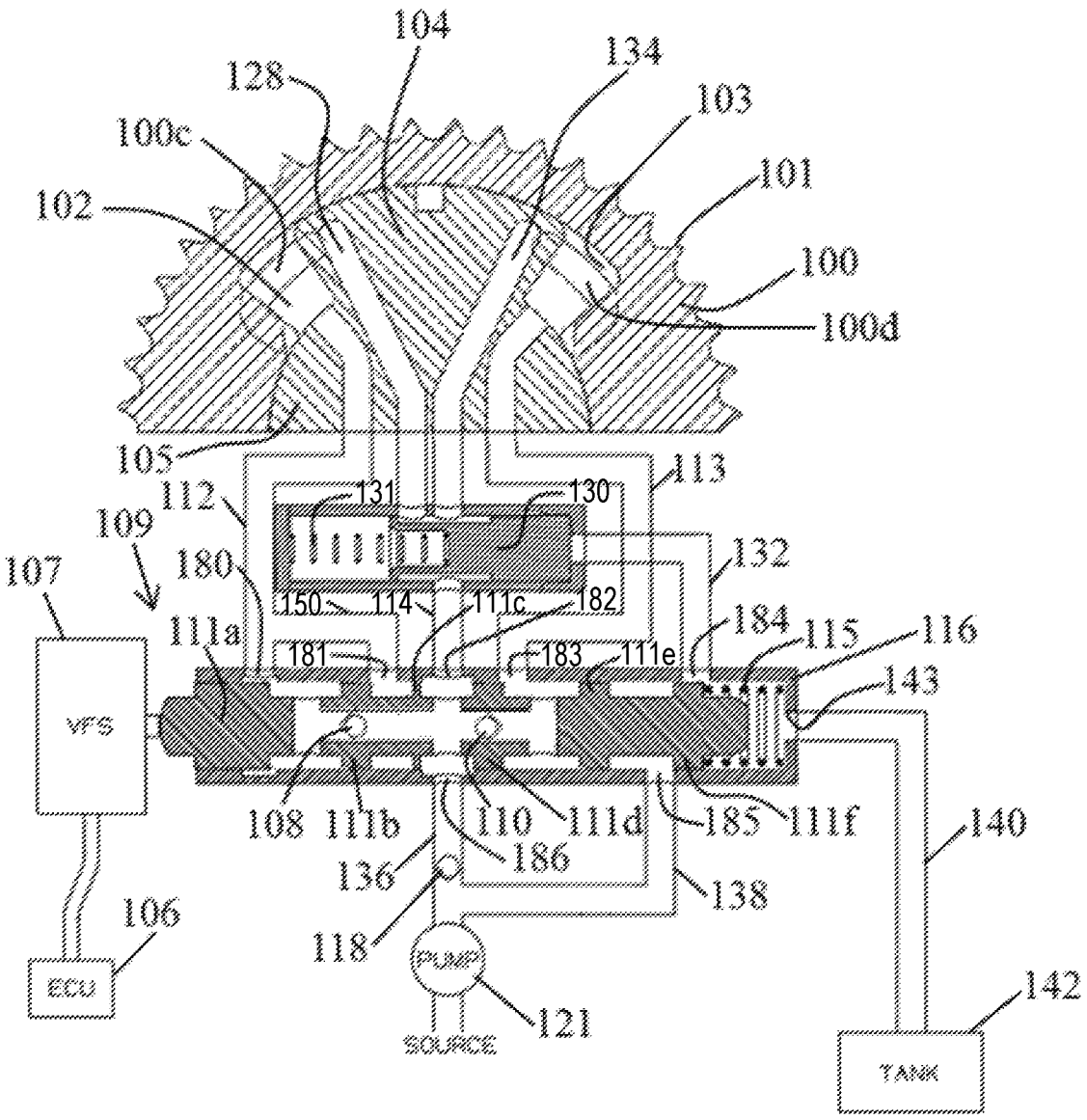
FIG. 34 shows a phaser of another alternate embodiment at the midlock or intermediate locking position with metered pockets on the rotor and the end plate with check valves present in the spool of the control valve with recirculation.

FIG. 34 shows a phaser of another alternate embodiment at the midlock or intermediate locking position with metered pockets on the rotor and the end plate with check valves present in the spool of the control valve.

This embodiment differs from the embodiment of FIGS. 1-18, in that the vent orifices 160, 161 were removed, along with associated exhaust lines 139, 141 and 144. The same reference numbers of FIGS. 1-18 are used for this embodiment as applicable.

A hydraulic detent circuit 133 includes a spring 131 loaded pilot valve 130 and an advance detent line 128 that connects the advance chamber 102 to the pilot valve 130 and the common line 114, and a retard detent line 134 that connects the retard chamber 103 to the pilot valve 130 and the common line 114. The advance and retard detent lines 128, 134 within the vane 104 are the advance detent line 128 and the retard detent line 134. The opening and closing of the hydraulic detent circuit 133 is controlled by the switching/movement of the oil control valve 109.

A control valve 109, preferably a spool valve, includes a spool 111 with cylindrical lands 111*a*, 111*b*, 111*c*, 111*d*, 111*e*, and 111*f* slidably received in a sleeve 116 within a bore in the rotor assembly 105 and pilots in the camshaft (not shown). The spool 111 also includes a retard recirculating check valve 108 and an advance recirculating check valve 110 within a central passage 162 of the spool 111. The control valve 109 may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-186. The port 180 is in fluid communication with the advance line 112. Port 181 is in fluid communication with line 150. Port 182 is in fluid communication with common line 114. Port 183 is in fluid communication with retard line 113. Port 184 is in fluid communication with the hydraulic detent circuit 133 and line 132. Port 185 is in communication with line 138. Port 186 is in fluid communication with line 136. Since no vent orifices are present in the spool 111 except for vent 143, in communication with the pilot valve 130, this phaser operates solely as a cam torque actuated phaser.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 are open (on) or closed (off). In other words, the position of the spool 111 actively controls the pilot valve 130. The control valve 109 has an advance mode, a retard mode, a null mode (holding position), and a detent mode.

In the advance mode, the spool 111 is moved to a position so that fluid may flow from the retard chamber 103 through the spool 111 and recirculate to the advance chamber 102 through the advance recirculating check valve 110 within the control valve 109. Fluid is blocked from exiting the advance chamber 102, and the detent valve circuit 133 is off or closed.

In the retard mode, the spool 111 is moved to a position so that fluid may flow from the advance chamber 102 through the spool 111 and recirculate to the retard chamber 103 through the retard recirculating check valve 108 within the control valve 109. Fluid is blocked from exiting the retard chamber 103 and the detent valve circuit 133 is off.

In null mode, the spool 111 is moved to a position that blocks the exit of fluid from the advance and retard chambers 102, 103, and the detent valve circuit 133 is off.

In the detent mode, as shown in FIG. 34, three functions occur simultaneously. The first function in the detent mode is that the spool 111 moves to a position in which spool land 111*c* blocks the flow of fluid directly from advance line 112 to retard line 113, spool land 111*d* blocks the flow of fluid directly from retard line 113 to advance line 112, effectively removing control of the phaser from the control valve 109. At the same time, any fluid that does exit the advance chamber 102 can flow through advance line 112 to between spool lands 111*a* and 111*b*, to central passage 162, through retard recirculating check valve 108 to common line 114. From common line 114, fluid can flow through the pilot valve 130 and enter the advance detent line 128 or the retard detent line 134. Any fluid that does exit the retard chamber 103 can flow through retard line 113 to between spool lands 111*d* and 111*e* to central passage 162, through the advance recirculating check valve 110 to common line 114. From common line 114, fluid can flow through the pilot valve 130 and enter the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function is that the vane is moved to an intermediate phase angle position or mid-position. This position of the vane 104 is somewhere between the advance wall 102*a* and the retard wall 103*a* defining the chamber 117 between the housing assembly 100 and the rotor assembly 105. The intermediate phase angle position can be anywhere between the advance wall 102*a* and retard wall 103*a* and is determined by where the advance detent line 128 and end plate metering pocket 100*d* overlap and the retard detent line 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133, vent the pilot valve 130, since if power or control is lost, the phaser will default to an intermediate position. It should be noted that the duty cycle percentages listed above are an example and they may be altered. Furthermore, the hydraulic detent circuit 133 may be open, and the pilot valve 130 vented at 100% duty cycle, if desired.

When the duty cycle of the variable force solenoid 107 is just set to 0%, the force on the VFS on the spool 111 is decreased, and the spring 115 moves the spool 111 to the far left end of the spool's travel to a detent position as shown in FIG. 34. In this detent position, spool land 111*c* blocks most of the flow of fluid from advance line 112 in between spool lands 111*a* and 111*b* from exhausting to the retard chamber 103 and spool land 111*d* blocks most of the flow of fluid from retard line 113 from exhausting to the advance chamber 102, effectively removing control of the phaser from the control valve 109. At the same time, fluid from source may flow through line 136 and inlet check valve 118 to the common line 114 between spool lands 111*c* and 111*d*. Fluid from advance line 112 can however pass to central passage 162, through the retard recirculating check valve 108 and enter the common line 114 between spool lands 111*c* and 111*d*. Fluid from retard line 113 can also pass to central passage 162, through the advance recirculating check valve 110 and enter the common line 114 between spool lands 111*c* and 111*d*.

Fluid is prevented from flowing through line 138 to the pilot valve 130 by spool land 111*f*. The pilot valve 130 vents to exhaust orifice 143 at the end of the sleeve 116, opening passage between the advance detent line 128 and the retard detent line 134 through the pilot valve 130 to the common line 114, in other words opening the hydraulic detent circuit 133.

If the vane 104 was positioned within the housing assembly 100 near or in the retard position fluid from the retard chamber 103 flows through retard line 113 to the control valve 109 through port 183. From the control valve 109, fluid flows through the central passage 162 and the advance recirculating check valve 110 to common line 114 through port 183. From common line 114, fluid flows through the open pilot valve 130 and to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the end plate advance metering pocket 100*c* within the chamber formed between the housing assembly 100 and the rotor assembly 105.

If the vane 104 was positioned within the housing assembly 100 near or in the advance position fluid from the advance chamber 102 flows through advance line 112 to the control valve 109 through port 180. From the control valve 109, fluid flows through the central passage 162 and the retard recirculating check valve 108 to common line 114 through port 183. From line 114, fluid flows through open pilot valve 130 and the retard detent line 134 which is exposed to the retard chamber 103 through the aligned rotor retard metering pocket 103*b* and end plate metering pocket 100*d*. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are partially open to the end plate metered pockets 100*c*, 100*d* and rotor metering pockets 102*b* and 103*b*.

Figure 35:
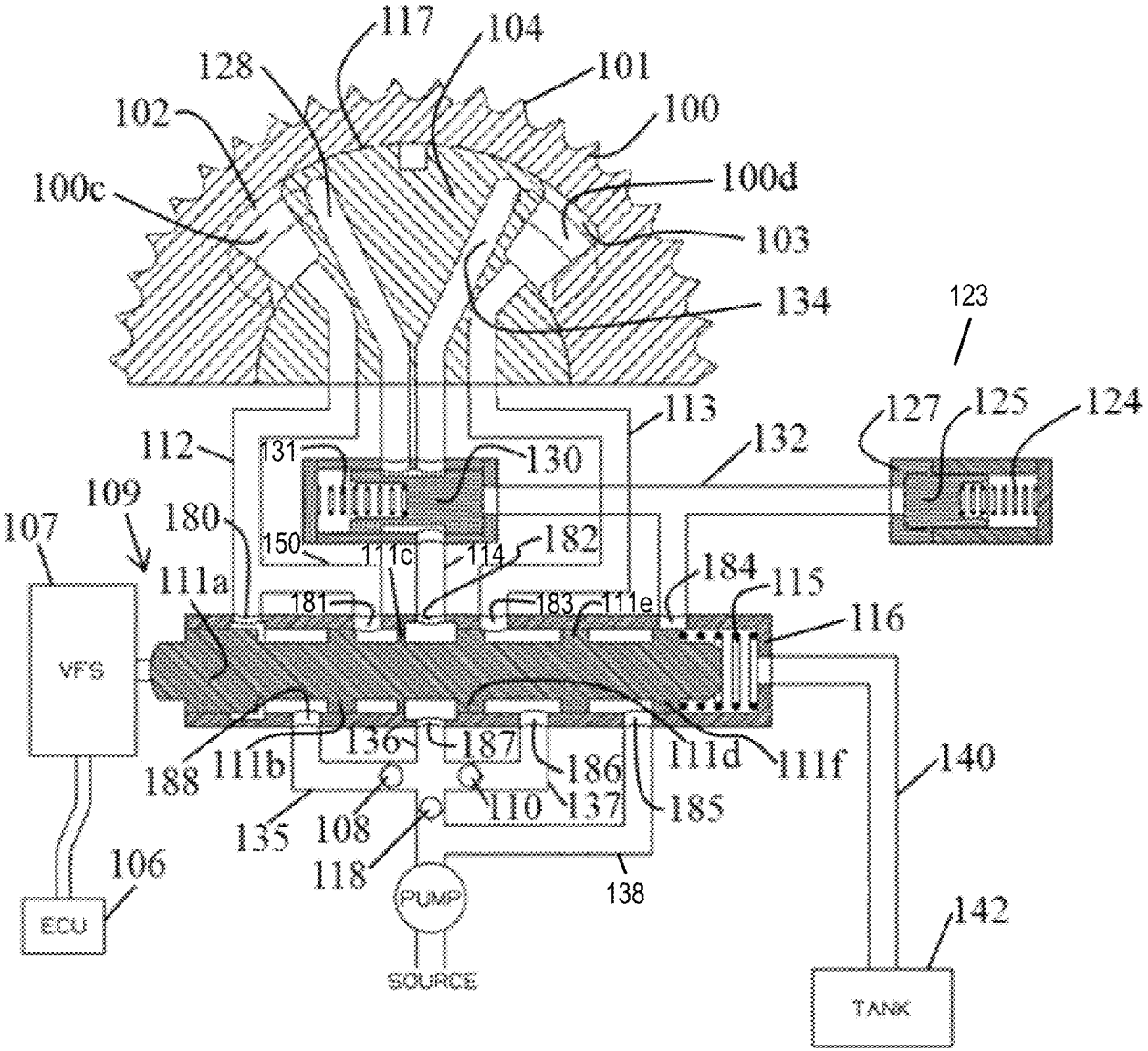
FIG. 35 shows a phaser of another alternate embodiment at the midlock or intermediate locking position with metered pockets on the rotor and the end plate and a lock pin with recirculation.

FIG. 35 shows a phaser of another alternate embodiment at the midlock or intermediate locking position with metered pockets on the rotor and the end plate and a lock pin.

This embodiment differs from the embodiment of FIGS. 1-18, in that the advance and retard check valves 108, 110 were moved out of the control valve 109 and the vent orifices 160, 161 were removed, along with associated exhaust lines 139 and 144. A lock pin 125 has also been added. The same reference numbers of FIGS. 1-18 are used for this embodiment as applicable.

A hydraulic detent circuit 133 includes a spring 131 loaded pilot valve 130 and an advance detent line 128 that connects the advance chamber 102 to the pilot valve 130 and the common line 114, and a retard detent line 134 that connects the retard chamber 103 to the pilot valve 130 and the common line 114. The passages 128, 134 within the vane 104 are the advance detent line 128 and the retard detent line 134. The opening and closing of the hydraulic detent circuit 133 is controlled by the switching/movement of the oil control valve 109.

A lock pin 125 is slidably housed in a bore in the rotor assembly 105 and has an end portion 125*a* that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The opening and closing of the hydraulic detent circuit 133 and pressurization of the lock pin circuit 123 are both controlled by the switching/movement of the oil control valve 109.

A control valve 109, preferably a spool valve, includes a spool 111 with cylindrical lands 111*a*, 111*b*, 111*c*, 111*d*, 111*e*, and 111*f* slidably received in a sleeve 116 within a bore in the rotor assembly 105 and pilots in the camshaft (not shown). The control valve 109 may be located remotely from the phaser, within a bore in the rotor assembly 105 which pilots in the camshaft, or in a center bolt of the phaser. One end of the spool 111 contacts spring 115 and the opposite end of the spool 111 contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-188. The port 180 is in fluid communication with the advance line 112. Port 181 is in fluid communication with line 150. Port 182 is in fluid communication with common line 114. Port 183 is in fluid communication with retard line 113. Port 184 is in fluid communication with the hydraulic detent circuit 133 and the lock pin circuit 123 via line 132. Port 185 is in communication with line 138. Port 186 is in fluid communication with line 137. Port 187 is communication with line 136. Port 188 is in fluid communication with line 136. Since no vent orifices are present in the spool except for vent 143, in communication with the pilot valve, this phaser operates solely as a cam torque actuated phaser.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 are open (on) or closed (off). In other words, the position of the spool 111 actively controls the pilot valve 130. The control valve 109 has an advance mode, a retard mode, a null mode (holding position), a detent mode.

In the advance mode, the spool 111 is moved to a position so that fluid may flow from the retard chamber 103 through the spool 111 and recirculate to the advance chamber 102 through the advance recirculating check valve 110. Fluid is blocked from exiting the advance chamber 102, and the detent valve circuit 133 is off or closed. The lock pin 125 is the unlocked position.

In the retard mode, the spool 111 is moved to a position so that fluid may flow from the advance chamber 102 through the spool 111 and recirculate to the retard chamber 103 through the retard recirculating check valve 108. Fluid is blocked from exiting the retard chamber 103 and the detent valve circuit 133 is off. The lock pin 125 is the unlocked position.

In null mode, the spool 111 is moved to a position that blocks the exit of fluid from the advance and retard chambers 102, 103, and the detent valve circuit 133 is off. The lock pin 125 is the unlocked position.

In the detent mode, as shown in FIG. 35, three functions occur simultaneously. The first function in the detent mode is that the spool 111 moves to a position in which spool land 111*c* blocks the flow of fluid from advance line 112 to retard line 113, spool land 111*d* blocks the flow of fluid from retard line 113 to advance line 112, effectively removing control of the phaser from the control valve 109. At the same time, any fluid that does exit the advance chamber 102 can flow through advance line 112 to between spool lands 111*a* and 111*b* to line 135. From 135, fluid flows through the retard recirculating check valve 108 to inlet line 136, between spool lands 111*c* and 111*d* to common line 114. From common line 114, fluid can flow through the pilot valve 130 and enter the advance detent line 128 or the retard detent line 134. Any fluid that does exit the retard chamber 103 can flow through retard line 113 to between spool lands 111*d* and 111*e* to line 137. From line 137, fluid flows through the advance recirculating check valve 110 to inlet line 136, between spool lands 111*c* and 111*d* and to common line 114. From common line 114, fluid can flow through the pilot valve 130 and enter the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function is that the vane is moved to an intermediate phase angle position or mid-position. This position of the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance detent line 128 and end plate metering pocket 100*c* overlap and the retard detent line 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed, and the lock pin 125 will be pressurized and released.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133, vent the pilot valve 130, since if power or control is lost, the phaser will default to a locked position. It should be noted that the duty cycle percentages listed above are an example and they may be altered. Furthermore, the hydraulic detent circuit 133 may be open, and the pilot valve 130 vented at 100% duty cycle, if desired. The lock pin circuit 123 is additionally vented, moving the lock pin 125 to an unlocked position.

When the duty cycle of the variable force solenoid 107 is just set to 0%, the force on the VFS on the spool 111 is decreased, and the spring 115 moves the spool 111 to the far left end of the spool's travel to a detent position as shown in the FIG. 35. In this detent position, spool land 111*c* blocks the flow of fluid from advance line 112 in between spool lands 111*a* and 111*b* from exhausting to the retard chamber 103 and spool land 111*d* blocks the flow of fluid from retard line 113 exhausting to the advance chamber 102, effectively removing control of the phaser from the control valve 109. At the same time, fluid from source may flow through inlet line 136 and inlet check valve 118 to the common line 114 between spool lands 111*c* and 111*d*.

Fluid is prevented from flowing through line 132 by spool land 111*f* to the pilot valve 130 and the lock pin 125. The pilot valve 130 and lock pin 125 vents to exhaust orifice 143 at the end of the sleeve 116, opening passage between the advance detent line 128 and the retard detent line 134 through the pilot valve 130 to the common line 114, in other words opening the hydraulic detent circuit 133. The lock pin 125 is moved to a locked position by spring 124 to engage recess 127.

If the vane 104 was positioned within the housing assembly 100 near or in the retard position fluid from the retard chamber 103 flows through retard line 113 to the control valve 109 through port 183. From the control valve 109, fluid flows to port 186 and to line 137 and through the advance recirculating check valve 110 to port 186 of the control valve 109. Fluid flows from the control valve 109 to port 182 and the common line 114. From line 114, fluid flows through the open pilot valve 130 and to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the end plate advance metering pocket 100*c* within the chamber 117 formed between the housing assembly 100 and the rotor assembly 105. As soon as the lock pin 125 is aligned with the recess 127, the lock pin 125 engages the recess 127.

If the vane 104 was positioned within the housing assembly 100 near or in the advance position fluid from the advance chamber 102 flows through advance line 112 to the control valve 109 through port 180. From the control valve 109, fluid flows to line 135 through port 188, through the retard recirculating check valve 108 to common line 114 through port 187. Fluid flows from the control valve 109 to port 182 and the common line 114. From line 114, fluid flows through open pilot valve 130 and the retard detent line 134 which is exposed to the retard chamber 103 through the aligned rotor retard metering pocket 103*b* and end plate metering pocket 100*d*. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105. As soon as the lock pin 125 is aligned with the recess 127, the lock pin engages the recess 127.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are partially open to the end plate metered pockets 100*c*, 100*d* and rotor metering pockets 102*b* and 103*b*.

Figure 36:
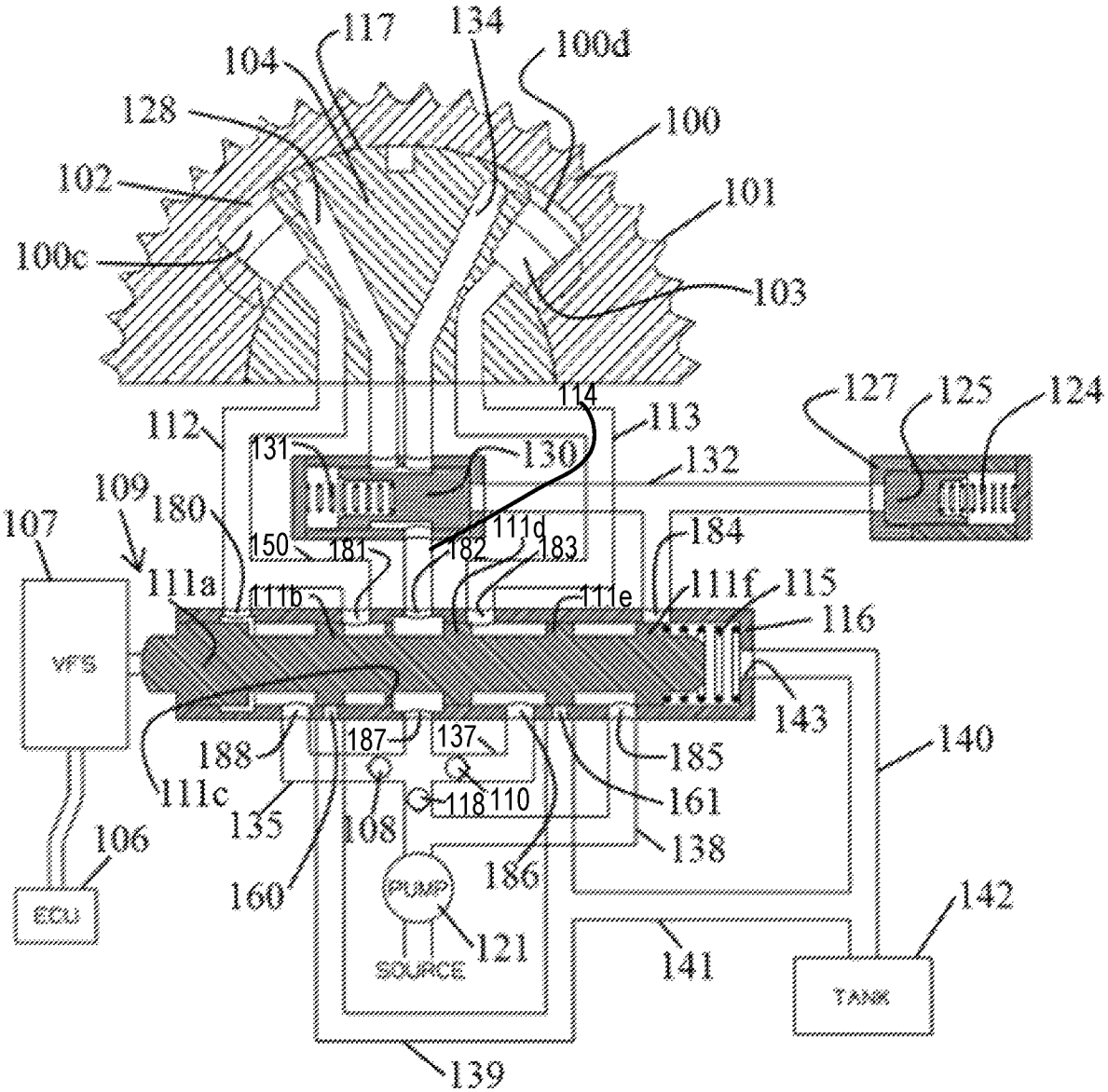
FIG. 36 shows a phaser of another alternate embodiment at the midlock or intermediate locking position with metered pockets on the rotor and the end plate and recirculation and a lock pin with recirculation and vent.

FIG. 36 shows a phaser of another alternate embodiment at the midlock or intermediate locking position with metered pockets on the rotor and the end plate and recirculation and a lock pin.

This embodiment differs from the embodiment of FIGS. 1-18, in that the advance and retard check valves 108, 110 were moved out of the control valve 109. The same reference numbers of FIGS. 1-18 are used for this embodiment as applicable.

A hydraulic detent circuit 133 includes a spring 131 loaded pilot valve 130 and an advance detent line 128 that connects the advance chamber 102 to the pilot valve 130 and the common line 114 via the rotor advance metered pocket 102*b*, and a retard detent line 134 that connects the retard chamber 103 to the pilot valve 130 and the common line 114 via the rotor retard metered pocket 103*b*. The advance detent line 128 and the retard detent line 134 are present within the vane 104. The opening and closing of the hydraulic detent circuit 133 is controlled by the switching/movement of the oil control valve 109.

A lock pin 125 is slidably housed in a bore in the rotor assembly 105 and has an end portion 125*a* that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The opening and closing of the hydraulic detent circuit 133 and pressurization of the lock pin circuit 123 are both controlled by the switching/movement of the oil control valve 109.

A control valve 109, preferably a spool valve, includes a spool 111 with cylindrical lands 111*a*, 111*b*, 111*c*, 111*d*, 111*e*, and 111*f* slidably received in a sleeve 116 within a bore in the rotor assembly 105 and pilots in the camshaft (not shown). The control valve 109 may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-188 and vent orifices 160-161. The port 180 is in fluid communication with the advance line 112. Port 181 is in fluid communication with line 150. Port 182 is in fluid communication with common line 114. Port 183 is in fluid communication with retard line 113. Port 184 is in fluid communication with the hydraulic detent circuit 133 and the lock pin circuit 123 via line 132. Port 185 is in communication with line 138. Vent orifice 161 is in communication with tank 142 through line 139. Port 186 is in fluid communication with line 137. Port 187 is communication with line 136. Port 188 is in fluid communication with line 135. Vent orifice 160 is in communication with tank 142 through line 139.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 are open (on) or closed (off). In other words, the position of the spool 111 actively controls the pilot valve 130. The control valve 109 has an advance mode, a retard mode, a null mode (holding position), a detent mode.

In the advance mode, the spool 111 is moved to a position so that fluid may flow from the retard chamber 103 through the spool 111 and to sump or tank 142 via exhaust line 144 and line 141. Fluid is blocked from exiting the advance chamber 102, and the detent valve circuit 133 is off or closed. The lock pin 125 is the unlocked position.

In the retard mode, the spool 111 is moved to a position so that fluid may flow from the advance chamber 102 through the spool 111 and to sump or tank 142 via exhaust line 139 and line 141. Fluid is blocked from exiting the retard chamber 103 and the detent valve circuit 133 is off. The lock pin 125 is the unlocked position.

In null mode, the spool 111 is moved to a position that blocks the exit of fluid from the advance and retard chambers 102, 103 to the tank 142, and the detent valve circuit 133 is off. The lock pin 125 is the unlocked position.

In the detent mode, as shown in FIG. 36, three functions occur simultaneously. The first function in the detent mode is that the spool 111 moves to a position in which spool land 111*b* blocks the flow of fluid from advance line 112 to tank 142, spool land 111*d* blocks the flow of fluid from retard line 113 to tank 142, spool lands 111*c* and 111*d* block fluid from exiting either advance line 112 and retard line 113 to each other, effectively removing control of the phaser from the control valve 109. At the same time, any fluid that does exit the advance chamber 102 can flow through advance line 112 to between spool lands 111*a* and 111*b*, to line 135. From line 135, fluid flows through retard recirculating check valve 108 to line 136, between spool lands 111*c* and 111*d* to common line 114. Fluid that exits the retard chamber 103 can flow through the retard line 113 between spool lands 111*d* and 111*e*, to line 137. From line 137, fluid flows through advance recirculating check valve 110 to line 136 and to common line 114. From common line 114, fluid can flow through the pilot valve 130 and enter the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function is that the vane is moved to an intermediate phase angle position or mid-position. This position of the vane 104 is somewhere between the advance wall 102*a* and the retard wall 103*a* defining the chamber 117 between the housing assembly 100 and the rotor assembly 105. The intermediate phase angle position can be anywhere between the advance wall 102*a* and retard wall 103*a* and is determined by where the advance detent line 128 and end plate metering pocket 100*c* overlap and the retard detent line 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed and the lock pin 125 will be pressurized and released.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133, vent the pilot valve 130, since if power or control is lost, the phaser will default to an intermediate position. It should be noted that the duty cycle percentages listed above are an example and they may be altered. Furthermore, the hydraulic detent circuit 133 may be open, and the pilot valve 130 vented at 100% duty cycle, if desired. The lock pin circuit 123 is additionally vented, moving the lock pin 125 to an unlocked position.

When the duty cycle of the variable force solenoid 107 is just set to 0%, the force on the VFS on the spool 111 is decreased, and the spring 115 moves the spool 111 to the far left end of the spool's travel to a detent position as shown in FIG. 36. In this detent position, spool land 111*b* blocks the flow of fluid from advance line 112 in between spool lands 111*a* and 111*b* from exhausting to tank 142 through exhaust line 139 and spool land 111*d* blocks the flow of fluid from retard line 113 from exhausting to tank 142 through exhaust line 139, spool lands 111*c* and 111*d* block fluid from exiting either advance line 112 and retard line 113 to each other, effectively removing control of the phaser from the control valve 109. At the same time, fluid from source may flow through line 136 and inlet check valve 118 to the common line 114 between spool lands 111*c* and 111*d*. Fluid from advance line 112 can however pass through line 135, retard recirculating check valve 108 and enter line 135 and to the common line 114 between spool lands 111*c* and 111*d*. Fluid from retard line 113 can also pass through line 137, advance recirculating check valve 110 and enter line 135 to the common line 114 between spool lands 111*c* and 111*d*.

Fluid is prevented from flowing through line 138 to the pilot valve 130 and the lock pin 125 by spool land 111*f*. The pilot valve 130 and the lock pin 125 vent to exhaust orifice 143 at the end of the sleeve 116, opening passage between the advance detent line 128 and the retard detent line 134 through the pilot valve 130 to the common line 114, in other words opening the hydraulic detent circuit 133.

If the vane 104 was positioned within the housing assembly 100 near or in the retard position fluid from the retard chamber 103 flows through retard line 113 to the control valve 109 through port 183. From the control valve 109, fluid flows to port 186 and to line 137 and through the advance recirculating check valve 110 to port 186 of the control valve 109. Fluid flows from the control valve 109 to port 182 and the common line 114. From line 114, fluid flows through the open pilot valve 130 and to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the end plate advance metering pocket 100*c* within the chamber formed between the housing assembly 100 and the rotor assembly 105. As soon as the lock pin 125 is aligned with the recess 127, the lock pin 125 engages the recess 127.

If the vane 104 was positioned within the housing assembly 100 near or in the advance position fluid from the advance chamber 102 flows through advance line 112 to the control valve 109 through port 180. From the control valve 109, fluid flows to line 135 through port 188, through the retard recirculating check valve 108 to common line 114 through port 187. Fluid flows from the control valve 109 to port 182 and the common line 114. From line 114, fluid flows through open pilot valve 130 and the retard detent line 134 which is exposed to the retard chamber 103 through the aligned rotor retard metering pocket 103*b* and end plate metering pocket 100*d*. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105. As soon as the lock pin 125 is aligned with the recess 127, the lock pin engages the recess 127.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are partially open to the end plate metered pockets 100*c*, 100*d* and rotor metering pockets 102*b* and 103*b*.

Figure 37:
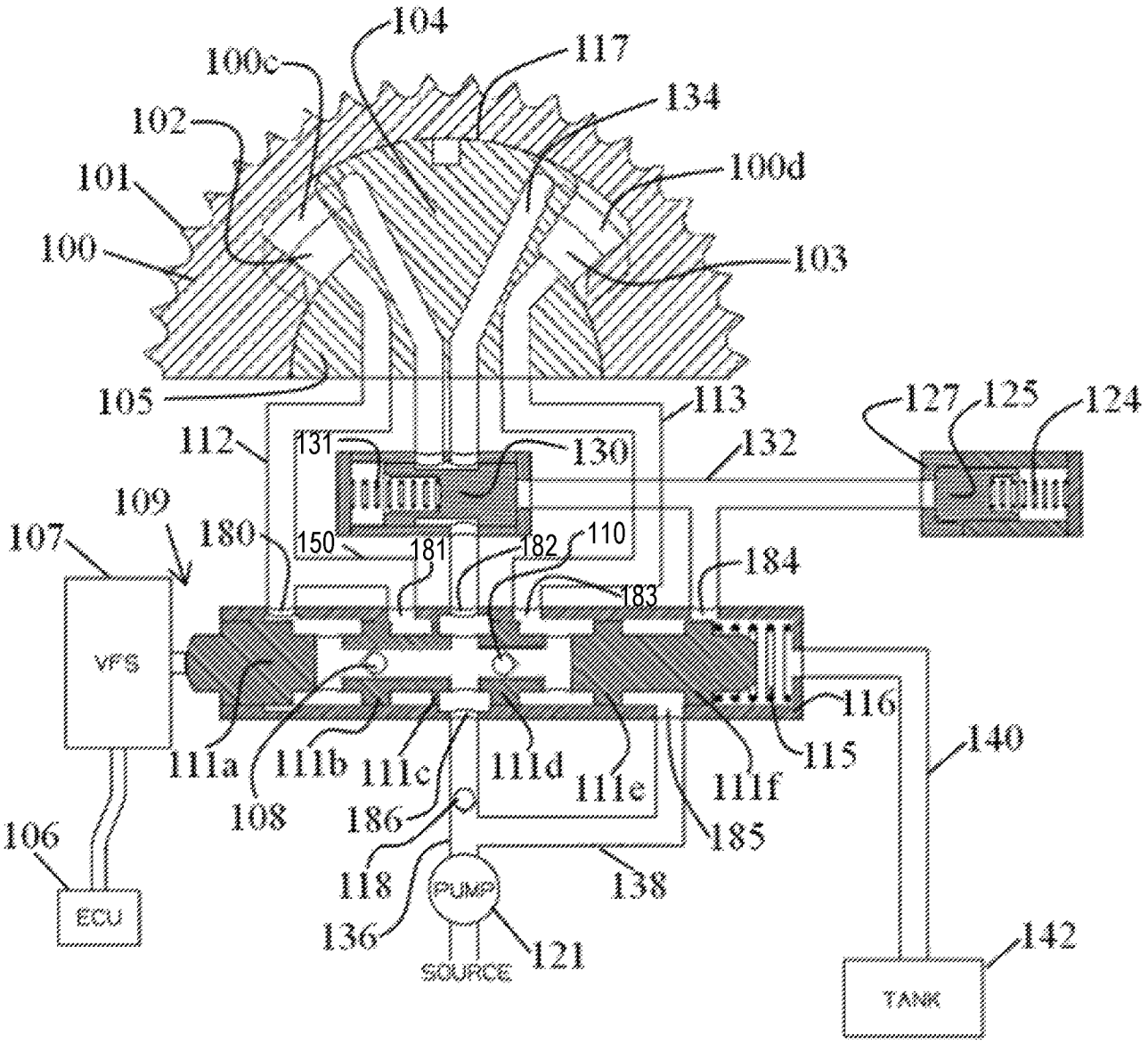
FIG. 37 shows a phaser of another alternate embodiment at the midlock or intermediate locking position with metered pockets on the rotor and the end plate with check valves present in the spool of the control valve and a lock pin with recirculation.

FIG. 37 shows a phaser of another alternate embodiment at the midlock or intermediate locking position with metered pockets on the rotor and the end plate with check valves present in the spool of the control valve and a lock pin.

This embodiment differs from the embodiment of FIGS. 1-18, in that the vent orifices 160, 161 were removed, along with associated exhaust lines 139, 141 and 144. A lock pin 125 has been added to the phaser. The same reference numbers of FIGS. 1-18 are used for this embodiment as applicable.

A hydraulic detent circuit 133 includes a spring 131 loaded pilot valve 130 and an advance detent line 128 that connects the advance chamber 102 to the pilot valve 130 and the common line 114, and a retard detent line 134 that connects the retard chamber 103 to the pilot valve 130 and the common line 114. The advance and retard detent lines 128, 134 within the vane 104 are the advance detent line 128 and the retard detent line 134. The opening and closing of the hydraulic detent circuit 133 is controlled by the switching/movement of the oil control valve 109.

A lock pin 125 is slidably housed in a bore in the rotor assembly 105 and has an end portion 125*a* that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The opening and closing of the hydraulic detent circuit 133 and pressurization of the lock pin circuit 123 are both controlled by the switching/movement of the oil control valve 109.

A control valve 109, preferably a spool valve, includes a spool 111 with cylindrical lands 111*a*, 111*b*, 111*c*, 111*d*, 111*e*, and 111*f* slidably received in a sleeve 116 within a bore in the rotor assembly 105 and pilots in the camshaft (not shown). The spool 111 also includes a retard recirculating check valve 108 and an advance recirculating check valve 110 within a central passage 162 of the spool 111. The control valve 109 may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-186. The port 180 is in fluid communication with the advance line 112. Port 181 is in fluid communication with line 150. Port 182 is in fluid communication with common line 114. Port 183 is in fluid communication with retard line 113. Port 184 is in fluid communication with the hydraulic detent circuit 133 and line 132. Port 185 is in communication with line 138. Port 186 is in fluid communication with line 136. Since no vent orifices are present in the spool except for vent 143, in communication with the pilot valve, this phaser operates solely as a cam torque actuated phaser.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the hydraulic detent circuit 133 are open (on) or closed (off). In other words, the position of the spool 111 actively controls the pilot valve 130. The control valve 109 has an advance mode, a retard mode, a null mode (holding position), a detent mode.

In the advance mode, the spool 111 is moved to a position so that fluid may flow from the retard chamber 103 through the spool 111 and recirculate to the advance chamber 102 through the advance recirculating check valve 110 within the control valve 109. Fluid is blocked from exiting the advance chamber 102, and the detent valve circuit 133 is off or closed. The lock pin 125 is the unlocked position.

In the retard mode, the spool 111 is moved to a position so that fluid may flow from the advance chamber 102 through the spool 111 and recirculate to the retard chamber 103 through the retard recirculating check valve 108 within the control valve 109. Fluid is blocked from exiting the retard chamber 103 and the detent valve circuit 133 is off. The lock pin 125 is the unlocked position.

In null mode, the spool 111 is moved to a position that blocks the exit of fluid from the advance and retard chambers 102, 103, and the detent valve circuit 133 is off. The lock pin 125 is the unlocked position.

In the detent mode, as shown in FIG. 37, three functions occur simultaneously. The first function in the detent mode is that the spool 111 moves to a position in which spool land 111*c* blocks the flow of fluid directly from advance line 112 to retard line 113, spool land 111*d* blocks the flow of fluid directly from retard line 113 to advance line 112, effectively removing control of the phaser from the control valve 109. At the same time, any fluid that does exit the advance chamber 102 can flow through advance line 112 to between spool lands 111*a* and 111*b*, to central passage 162, through retard recirculating check valve 108 to common line 114. From common line 114, fluid can flow through the pilot valve 130 and enter the advance detent line 128 or the retard detent line 134. Any fluid that does exit the retard chamber 103 can flow through retard line 113 to between spool lands 111*d* and 111*e* to central passage 162, through the advance recirculating check valve 110 to common line 114. From common line 114, fluid can flow through the pilot valve 130 and enter the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function is that the vane is moved to an intermediate phase angle position or mid-position. This position of the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance detent line 128 and end plate metering pocket 100*c* overlap and the retard detent line 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed, and the lock pin 125 will be pressurized and released.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133, vent the pilot valve 130, since if power or control is lost, the phaser will default to a locked position. It should be noted that the duty cycle percentages listed above are an example and they may be altered. Furthermore, the hydraulic detent circuit 133 may be open, and the pilot valve 130 vented at 100% duty cycle, if desired. The lock pin circuit 123 is additionally vented, moving the lock pin 125 to an unlocked position.

When the duty cycle of the variable force solenoid 107 is just set to 0%, the force on the VFS on the spool 111 is decreased, and the spring 115 moves the spool 111 to the far left end of the spool's travel to a detent position as shown in FIG. 37. In this detent position, spool land 111*c* blocks most of the flow of fluid from advance line 112 in between spool lands 111*a* and 111*b* from exhausting to the retard chamber 103 and spool land 111*d* blocks most of the flow of fluid from retard line 113 from exhausting to the advance chamber 102, effectively removing control of the phaser from the control valve 109. At the same time, fluid from source may flow through line 136 and inlet check valve 118 to the common line 114 between spool lands 111*c* and 111*d*. Fluid from advance line 112 can however pass to central passage 162, through the retard recirculating check valve 108 and enter the common line 114 between spool lands 111*c* and 111*d*. Fluid from retard line 113 can also pass to central passage 162, through the advance recirculating check valve 110 and enter the common line 114 between spool lands 111*c* and 111*d*.

Fluid is prevented from flowing through line 138 to the pilot valve 130 by spool land 111*f*. The pilot valve 130 vents to exhaust orifice 143 at the end of the sleeve 116, opening passage between the advance detent line 128 and the retard detent line 134 through the pilot valve 130 to the common line 114, in other words opening the hydraulic detent circuit 133. The lock pin 125 is moved to a locked position by spring 124 to engage recess 127.

If the vane 104 was positioned within the housing assembly 100 near or in the retard position fluid from the retard chamber 103 flows through retard line 113 to the control valve 109 through port 183. From the control valve 109, fluid flows through the central passage 162 and the advance recirculating check valve 110 to common line 114 through port 183. From line 114, fluid flows through the open pilot valve 130 and to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the end plate advance metering pocket 100*c* within the chamber formed between the housing assembly 100 and the rotor assembly 105. As soon as the lock pin 125 is aligned with the recess 127, the lock pin engages the recess 127.

If the vane 104 was positioned within the housing assembly 100 near or in the advance position fluid from the advance chamber 102 flows through advance line 112 to the control valve 109 through port 180. From the control valve 109, fluid flows through the central passage 162 and the retard recirculating check valve 108 to common line 114 through port 183. From line 114, fluid flows through open pilot valve 130 and the retard detent line 134 which is exposed to the retard chamber 103 through the aligned rotor retard metering pocket 103*b* and end plate metering pocket 100*d*. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105. As soon as the lock pin 125 is aligned with the recess 127, the lock pin engages the recess 127.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are partially open to the end plate metered pockets 100*c*, 100*d* and rotor metering pockets 102*b* and 103*b*.

Figure 38:
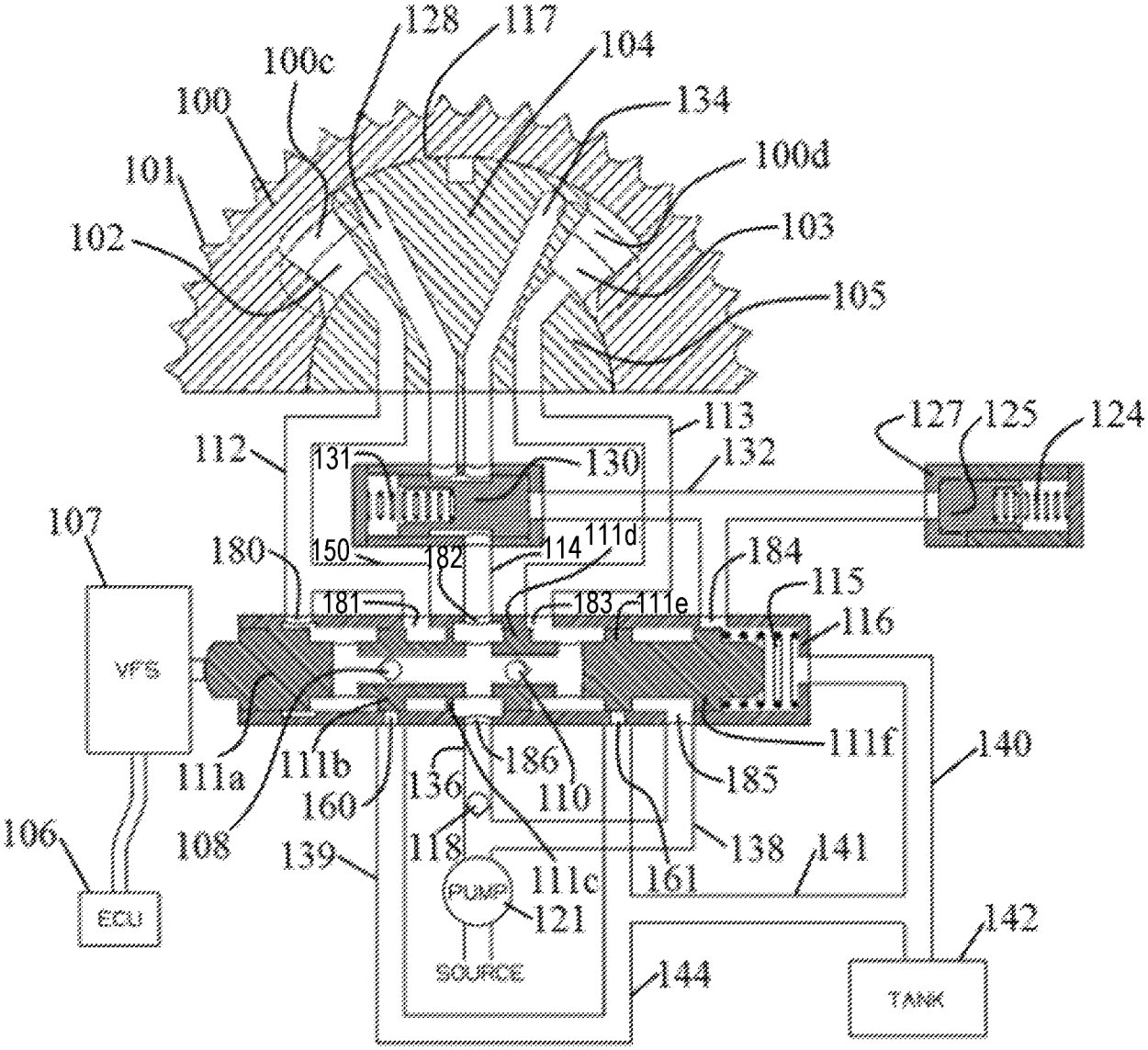
FIG. 38 shows a phaser of another alternate embodiment at the midlock or intermediate locking position with metered pockets on the rotor and the end plate with check valves present in the spool of the control valve, a lock pin, and recirculation and vent.

FIG. 38 shows a phaser of another alternate embodiment at the midlock or intermediate locking position with metered pockets on the rotor and the end plate with check valves present in the spool of the control valve, a lock pin, and recirculation.

This embodiment differs from the embodiment of FIGS. 1-18, in that a lock pin 125 has been added to the phaser. The same reference numbers of FIGS. 1-18 are used for this embodiment as applicable.

A hydraulic detent circuit 133 and a lock pin circuit 123 are present. The hydraulic detent circuit 133 and the lock pin circuit 123 are essentially one circuit, but will be discussed separately for simplicity.

The hydraulic detent circuit 133 includes a spring 131 loaded pilot valve 130 and an advance detent line 128 that connects the advance chamber 102 to the pilot valve 130 and the common line 114, and a retard detent line 134 that connects the retard chamber 103 to the pilot valve 130 and the common line 114. The passages 128, 134 within the vane 104 are the advance detent line 128 and the retard detent line 134. The opening and closing of the hydraulic detent circuit 133 is controlled by the switching/movement of the oil control valve 109.

The lock pin 125 is slidably housed in a bore in the rotor assembly 105 and has an end portion 125*a* that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The opening and closing of the hydraulic detent circuit 133 and pressurization of the lock pin circuit 123 are both controlled by the switching/movement of the oil control valve 109.

A control valve 109, preferably a spool valve, includes a spool 111 with cylindrical lands 111*a*, 111*b*, 111*c*, 111*d*, 111*e*, and 111*f* slidably received in a sleeve 116 within a bore in the rotor assembly 105 and pilots in the camshaft (not shown). The spool 111 also includes a retard recirculating check valve 108 and an advance recirculating check valve 110 within a central passage 162 of the spool 111. The control valve 109 may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 180-186 and vent orifices 160-161. The port 180 is in fluid communication with the advance line 112. Port 181 is in fluid communication with line 150. Port 182 is in fluid communication with common line 114. Port 183 is in fluid communication with retard line 113. Port 184 is in fluid communication with the hydraulic detent circuit 133 and the lock pin circuit 123 via line 132. Port 185 is in communication with line 138. Vent orifice 161 is in communication with tank 142 through line 139. Port 186 is in fluid communication with line 137. Port 187 is communication with line 136. Vent orifice 160 is in communication with tank 142 through line 139.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the lock pin circuit 123 and the hydraulic detent circuit 133 are open (on) or closed (off). In other words, the position of the spool 111 actively controls the pilot valve 130. The control valve 109 has an advance mode, a retard mode, a null mode (holding position), a detent mode.

In the advance mode, the spool 111 is moved to a position so that fluid may flow from the retard chamber 103 through the spool 111 and to sump or tank 142 via exhaust line 139 and line 141. Fluid is blocked from exiting the advance chamber 102, and the detent valve circuit 133 is off or closed. The lock pin 125 is in an unlocked position.

In the retard mode, the spool 111 is moved to a position so that fluid may flow from the advance chamber 102 through the spool 111 and to sump or tank 142 via exhaust line 139 and line 141. Fluid is blocked from exiting the retard chamber 103 and the detent valve circuit 133 is off. The lock pin 125 is in an unlocked position.

In null mode, the spool 111 is moved to a position that blocks the exit of fluid from the advance and retard chambers 102, 103 to the tank 142, and the detent valve circuit 133 is off. The lock pin 125 is in an unlocked position.

In the detent mode, as shown in FIG. 38, three functions occur simultaneously. The first function in the detent mode is that the spool 111 moves to a position in which spool land 111*b* blocks the flow of fluid from advance line 112 to tank 142, spool lands 111*c* and 111*d* block fluid from exiting either advance line 112 and retard line 113 to each other, effectively removing control of the phaser from the control valve 109. At the same time, any fluid that does exit the advance chamber 102 can flow through advance line 112 to between spool lands 111*a* and 111*b*, to central passage 162 and through the retard recirculating check valve 108 to common line 114. Fluid which exits through the retard chamber 103 can flow through the retard line 113 to the control valve 109 between spool lands 111*d* and 111*e*, to central passage 162 and through the advance recirculating check valve 110. From common line 114, fluid can flow through the pilot valve 130 and enter the advance detent line 128 or the retard detent line 134.

The second function in detent mode is to open or turn on the detent valve circuit 133. The detent valve circuit 133 has complete control over the phaser moving to advance or retard, until the vane 104 reaches the intermediate phase angle position.

The third function in the detent mode is to vent the lock pin circuit 123, allowing the lock pin 125 to engage the recess 127. The intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance detent line 128 and end plate metering pocket 100*c* overlap and the retard detent line 134 and end plate metering pocket 100*d* overlap within the vane 104.

Based on the duty cycle of the pulse width modulated variable force solenoid 107, the spool 111 moves to a corresponding position along its stroke. When the duty cycle of the variable force solenoid 107 is approximately 40%, 60% or 80%, the spool 111 will be moved to positions that correspond with the retard mode, the null mode, and the advance mode, respectively and the pilot valve 130 will be pressurized and move to the second position, the hydraulic detent circuit 133 will be closed, and the lock pin 125 will be pressurized and released.

When the duty cycle of the variable force solenoid 107 is 0%, the spool 111 is moved to the detent mode such that the pilot valve 130 vents and moves to the second position, the hydraulic detent circuit 133 will be open. A duty cycle of 0% was chosen as the extreme position along the spool stroke to open the hydraulic detent circuit 133, vent the pilot valve 130, since if power or control is lost, the phaser will default to a locked position. It should be noted that the duty cycle percentages listed above are an example and they may be altered. Furthermore, the hydraulic detent circuit 133 may be open, and the pilot valve 130 vented at 100% duty cycle, if desired.

When the duty cycle of the variable force solenoid 107 is just set to 0%, the force on the VFS on the spool 111 is decreased, and the spring 115 moves the spool 111 to the far left end of the spool's travel to a detent position as shown in FIG. 38. In this detent position, spool land 111*b* blocks the flow of fluid from advance line 112 from exhausting to tank 142 via line 139 and spool land 111*e* blocks the flow of fluid from retard line 113 from exhausting to tank 142 through exhaust line 139, spool lands 111*c* and 111*d* block fluid from exiting either advance line 112 and retard line 113 to each other, effectively removing control of the phaser from the control valve 109. At the same time, fluid from source may flow through line 136 and inlet check valve 118 to the common line 114 between spool lands 111*c* and 111*d*. Fluid from advance line 112 fluid flows into the central passage 162 of the control valve and flows through the retard recirculating check valve 108 and enters the common line 114 between spool lands 111*c* and 111*d*. Fluid from the retard line 113 fluid passes into central passage 162 and flows through the advance recirculating check valve 110 to common line 114 between spool lands 111*c* and 111*d*.

Fluid is prevented from flowing through line 138 to the pilot valve 130 and the lock pin 125 by spool land 111*f*. The pilot valve 130 and lock pin 125 vent to exhaust orifice 143 at the end of the sleeve 116, opening passage between the advance detent line 128 and the retard detent line 134 through the pilot valve 130 to the common line 114, in other words opening the hydraulic detent circuit 133.

If the vane 104 was positioned within the housing assembly 100 near or in the retard position, fluid from the retard chamber 103 flows through retard line 113 to the control valve 109 through port 183. Within the control valve 109, fluid flows through central passage 162 and advance recirculating check valve 110 to common line 114 and flows through the pilot valve 130 to the advance detent line 128, which is exposed to the advance chamber 102 through the aligned rotor advance metering pocket 102*b* and end plate metering pocket 100*c*. The fluid flowing to the advance chamber 102 moves the vane 104 relative to the housing assembly 100 to an intermediate phase angle position or a mid-position until the rotor advance metering pocket 102*b* misaligns with the advance metering pocket 100*c* within the chamber formed between the housing assembly 100 and the rotor assembly 105. As soon as the lock pin 125 is aligned with the recess 127, the lock pin engages the recess 127.

If the vane 104 was positioned within the housing assembly 100 near or in the advance position, fluid from the advance chamber 102 flows through advance line 112 to the control valve 109 through port 180. Within the control valve 109, fluid flows through central passage 162 and retard recirculating check valve 108 to common line 114 and flows through the pilot valve 130 to the retard detent line 134, which is exposed to the retard chamber 103 through the aligned rotor retard metering pocket 103*b* and end plate metering pocket 100*d*. The fluid flowing to the retard chamber 103 moves the vane 104 relative to the housing assembly 100 to an intermediate phase angle position or a mid-position until the rotor retard metering pocket 103*b* misaligns with the end plate retard metering pocket 100*d* within the chamber 117 formed between the housing assembly 100 and the rotor assembly 105. As soon as the lock pin 125 is aligned with the recess 127, the lock pin engages the recess 127.

The advance detent line 128 and the retard detent line 134 are partially open by the rotor assembly 105 from the advance and retard chambers 102, 103 when phaser is in the mid-position or intermediate phase angle position at the precise time in which the advance detent line 128 or the retard detent line 134 are partially open to the end plate metered pockets 100*c*, 100*d* and rotor metering pockets 102*b* and 103*b*.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser comprising:

a housing assembly having an outer circumference for accepting drive force, the housing assembly comprising a first end plate and a second end plate, the first end plate or the second end plate having a pair of end plate metered pockets;

a rotor assembly to connect to a camshaft, the rotor assembly coaxially located within the housing assembly, the rotor assembly having a rotor body with at least one vane extending therefrom, a rotor advance metered pocket and a rotor retard metered pocket, wherein the housing assembly and the rotor assembly define at least one chamber separated by the at least one vane into an advance chamber and a retard chamber, the at least one chamber defined by an advance wall and a retard wall, the at least one vane within the at least one chamber acting to shift relative angular position of the housing assembly, the rotor assembly, and the at least one vane;

a control valve for directing fluid from a fluid input to and from the advance chamber and the retard chamber through an advance line, a retard line, a supply line coupled to the fluid input, at least two tunable exhaust ports in communication with a tank, an advance detent line and a retard detent line, the control valve being moveable through multiple modes comprising:

an advance mode in which fluid is routed from the fluid input to the advance chamber, and fluid is routed from the retard chamber to one of the at least two tunable exhaust ports and to the advance chamber through a retard recirculation check valve;

a retard mode in which fluid is routed from the fluid input to the retard chamber, and fluid is routed from the advance chamber to one of the at least two tunable exhaust ports and to the retard chamber through an advance recirculation check valve;

a holding position in which fluid is routed to the advance chamber and the retard chamber from the supply line; and a detent mode in which the control valve blocks fluid from exiting the retard chamber through the control valve, retaining fluid within the retard chamber, and blocks fluid from exiting the advance chamber through the control valve, retaining fluid within the advance chamber; and a pilot valve in fluid communication with the control valve, the rotor advance metered pocket via the advance detent line, and the rotor retard metered pocket via the retard detent line, the pilot valve moveable between a first position in which fluid from the control valve can flow through the pilot valve to the rotor advance metered pocket and the rotor retard metered pocket and a second position in which fluid is prevented from flowing from the control valve through the pilot valve to the rotor advance metered pocket and the rotor retard metered pocket, wherein when the control valve is in the detent mode, the pilot valve is in the first position, the at least one vane is positioned within the housing assembly near or in an advance position, fluid from the advance chamber flows to the control valve, through the retard recirculation check valve, through the pilot valve, and into the retard detent line, fluid from the retard detent line flows into the rotor retard metered pocket aligned with the end plate metered pockets and into the retard chamber, moving the at least one vane until the rotor retard metered pocket and the end plate metered pockets are misaligned and the variable cam timing phaser is in a mid-position between the advance wall and the retard wall within the at least one chamber, wherein when the control valve is in the detent mode, the pilot valve is in the first position, the at least one vane is positioned within the housing assembly near or in a retard position, fluid from the retard chamber flows to the control valve, through the advance recirculation check valve, through the pilot valve, and into the advance detent line, fluid from the advance detent line flows into the rotor advance metered pocket aligned with the end plate metered pockets and into the advance chamber, moving the at least one vane until the rotor advance metered pocket and the end plate metered pockets are misaligned and the variable cam timing phaser is in the mid-position between the advance wall and the retard wall within the at least one chamber.

2. The variable cam timing phaser of claim 1, wherein the rotor advance metered pocket and the rotor retard metered pocket are located within the at least one vane.

3. The variable cam timing phaser of claim 1, wherein the rotor advance metered pocket and the rotor retard metered pocket are located within the rotor body of the rotor assembly.

4. The variable cam timing phaser of claim 1, wherein the control valve is located within the rotor assembly.

5. The variable cam timing phaser of claim 1, wherein the control valve further comprises:

a hollow sleeve with a plurality of ports and the at least two tunable exhaust ports; and a spool received within the hollow sleeve comprising:

a plurality of lands for selectively blocking the plurality of ports and the at least two tunable exhaust ports of the hollow sleeve; and a working central passage located within the spool receiving the advance recirculation check valve and the retard recirculation check valve, limiting a flow of fluid between the advance chamber and the retard chamber through the working central passage.

6. The variable cam timing phaser of claim 1, further comprising a locking pin slidably located in a bore of the rotor assembly, the locking pin being moveable within the rotor assembly from a locked position in which an end portion of the locking pin engages a recess of the housing assembly, to an unlocked position in which the end portion does not engage the recess of the housing assembly, the recess being in fluid communication with the pilot valve and in fluid communication with the supply line via the control valve.

7. The variable cam timing phaser of claim 1, wherein the advance recirculation check valve and the retard recirculation check valve are located outside of the control valve.

8. The variable cam timing phaser of claim 1, wherein the at least two tunable exhaust ports are sized to alter fluid flow from the retard chamber to the tank and from the advance chamber to the tank when the control valve is in the advance mode and in the retard mode, and to alter an amount of fluid recirculating between the advance chamber and the retard chamber.

9. A variable cam timing phaser comprising:

a housing assembly having an outer circumference for accepting drive force, the housing assembly comprising a first end plate and a second end plate, the first end plate or the second end plate having a pair of end plate metered pockets;

a rotor assembly to connect to a camshaft, the rotor assembly coaxially located within the housing assembly, the rotor assembly having a rotor body with at least one vane extending therefrom and a rotor advance metered pocket and a rotor retard metered pocket, wherein the housing assembly and the rotor assembly define at least one chamber separated by the at least one vane into an advance chamber and a retard chamber, the at least one chamber defined by an advance wall and a retard wall, the at least one vane within the at least one chamber acting to shift relative angular position of the housing assembly and the rotor assembly and the at least one vane;

a control valve for directing fluid from a fluid input to and from the advance chamber and the retard chamber through an advance line, a retard line, a supply line coupled to the fluid input, an exhaust port in communication with a tank, an advance detent line and a retard detent line, the control valve being moveable through multiple modes comprising:

an advance mode in which fluid is routed from the fluid input to the advance chamber and fluid is routed from the retard chamber to the advance chamber through a retard recirculation check valve;

a retard mode in which fluid is routed from the fluid input to the retard chamber and fluid is routed from the advance chamber to the retard chamber through an advance recirculation check valve;

a holding position in which fluid is routed to the advance chamber and the retard chamber from the supply line; and a detent mode in which the control valve blocks fluid from exiting from the retard chamber through the control valve, retaining fluid within the retard chamber, blocks fluid from exiting from the advance chamber through the control valve, retaining fluid within the advance chamber; and a pilot valve in fluid communication with the control valve, the rotor advance metered pocket via the advance detent line, and the rotor retard metered pocket via the retard detent line, the pilot valve moveable between a first position in which fluid from the control valve can flow through the pilot valve to the rotor advance metered pocket and the rotor retard metered pocket and a second position in which fluid is preventing from flowing from the control valve through the pilot valve to the rotor advance metered pocket and the rotor retard metered pocket, wherein when the control valve is in the detent mode, the pilot valve is in the first position, and the at least one vane is positioned within the housing assembly near or in an advance position, fluid from the advance chamber flows to the control valve and through the retard recirculation check valve, through the pilot valve and into the retard detent line, fluid from the retard detent line flows into the rotor retard metered pocket aligned with the end plate metered pockets and into the retard chamber, moving the at least one vane until the rotor retard metered pocket and the end plate metered pockets are misaligned and the variable cam timing phaser is in a mid-position between the advance wall and the retard wall within the at least one chamber, wherein when the control valve is in the detent mode, the pilot valve is in the first position, and the at least one vane is positioned within the housing assembly near or in a retard position, fluid from the retard chamber flows to the control valve and through the advance recirculation check valve, through the pilot valve and into the advance detent line, fluid from the advance detent line flows into the rotor advance metered pocket aligned with the end plate metered pockets and into the advance chamber, moving the at least one vane until the rotor advance metered pocket and the end plate metered pockets are misaligned and the variable cam timing phaser is in the mid-position between the advance wall and the retard wall within the at least one chamber.

10. The variable cam timing phaser of claim 9, wherein the rotor advance metered pocket and the rotor retard metered pocket are located within the at least one vane.

11. The variable cam timing phaser of claim 9, wherein the rotor advance metered pocket and the rotor retard metered pocket are located within the rotor body of the rotor assembly.

12. The variable cam timing phaser of claim 9, wherein the control valve further comprises:

a hollow sleeve with a plurality of ports; and a spool received within the hollow sleeve comprising:

a plurality of lands for selectively blocking the plurality of ports of the hollow sleeve; and a working central passage located within the spool receiving the advance recirculation check valve and the retard recirculation check valve, limiting a flow of fluid between the advance chamber and the retard chamber through the working central passage.

13. The variable cam timing phaser of claim 9, further comprising a locking pin slidably located in a bore of the rotor assembly, the locking pin being moveable within the rotor assembly from a locked position in which an end portion of the locking pin engages a recess of the housing assembly, to an unlocked position in which the end portion does not engage the recess of the housing assembly, the recess being in fluid communication with the pilot valve and in fluid communication with the supply line via the control valve.

14. The variable cam timing phaser of claim 9, wherein the advance recirculation check valve and the retard recirculation check valve are located outside of the control valve.

15. A variable cam timing phaser comprising:

a housing assembly having an outer circumference for accepting drive force;

a rotor assembly to connect to a camshaft, the rotor assembly coaxially located within the housing assembly, the rotor assembly having a rotor body with at least one vane extending therefrom having metered edges at an end, wherein the housing assembly and the rotor assembly define at least one chamber separated by the at least one vane into an advance chamber and a retard chamber in which at least a portion of the at least one chamber seals the metered edges on the end of the at least one vane in specific positions, the at least one chamber defined by an advance wall and a retard wall, the at least one vane within the at least one chamber acting to shift relative angular position of the housing assembly and the rotor assembly;

a control valve for directing fluid from a fluid input to and from the advance chamber and the retard chamber through an advance line, a retard line, a supply line coupled to the fluid input, at least two tunable exhaust ports in communication with a tank, an advance detent line and a retard detent line, the control valve being moveable through multiple modes comprising:

an advance mode in which fluid is routed from the fluid input to the advance chamber and fluid is routed from the retard chamber to one of the at least two tunable exhaust ports and to the advance chamber through a retard recirculation check valve;

a retard mode in which fluid is routed from the fluid input to the retard chamber and fluid is routed from the advance chamber to one of the at least two tunable exhaust ports and to the retard chamber through an advance recirculation check valve;

a holding position in which fluid is routed to the advance chamber and the retard chamber from the supply line; and a detent mode in which the control valve blocks fluid from exiting from the retard chamber through the control valve, retaining fluid within the retard chamber, blocks fluid from exiting from the advance chamber through the control valve, retaining fluid within the advance chamber; and a pilot valve in fluid communication with the control valve, the advance detent line, and the retard detent line, the pilot valve moveable between a first position in which fluid from the control valve can flow through the pilot valve to the advance chamber and retard chambers via the advance detent line and the retard detent line through the metered edges of the at least one vane and a second position in which fluid is preventing from flowing from the control valve through the pilot valve to the advance chamber and the retard chamber, wherein when the control valve is in the detent mode, the pilot valve is in the first position, and the at least one vane is positioned within the housing assembly near or in an advance position, fluid from the advance chamber flows to the control valve and through the retard recirculation check valve, through the pilot valve and into the retard detent line, fluid from the retard detent line flows into the retard chamber via the metered edges of the at least one vane, moving the at least one vane until the metered edges of the at least one vane are sealed by the portion of the at least one chamber and the variable cam timing phaser is in a mid-position between the advance wall and the retard wall within the at least one chamber, wherein when the control valve is in the detent mode, the pilot valve is in the first position, and the at least one vane is positioned within the housing assembly near or in a retard position, fluid from the retard chamber flows to the control valve and through the advance recirculation check valve, through the pilot valve and into the advance detent line, fluid from the advance detent line flows into the advance chamber via the metered edges of the at least one vane, moving the at least one vane until the metered edges of the at least one vane are sealed by the portion of the at least one chamber and the variable cam timing phaser is in the mid-position between the advance wall and the retard wall within the at least one chamber.

16. The variable cam timing phaser of claim 15, wherein the control valve is located within the rotor assembly.

17. The variable cam timing phaser of claim 15, wherein the control valve further comprises:

a hollow sleeve with a plurality of ports and the at least two tunable exhaust ports; and a spool received within the hollow sleeve comprising:

a plurality of lands for selectively blocking the plurality of ports and the at least two tunable exhaust ports of the hollow sleeve; and a working central passage located within the spool receiving the advance recirculation check valve and the retard recirculation check valve, limiting a flow of fluid between the advance chamber and the retard chamber through the working central passage.

18. The variable cam timing phaser of claim 15, further comprising a locking pin slidably located in a bore of the rotor assembly, first locking pin being moveable within the rotor assembly from a locked position in which an end portion of the locking pin engages a recess of the housing assembly, to an unlocked position in which the end portion does not engage the recess of the housing assembly, the recess being in fluid communication with the pilot valve and in fluid communication with the supply line via the control valve.

19. The variable cam timing phaser of claim 15, wherein the advance recirculation check valve and the retard recirculation check valve are located outside of the control valve.

20. The variable cam timing phaser of claim 15, wherein the at least two tunable exhaust ports are sized to alter fluid flow from the retard chamber to the tank and the advance chamber to the tank when the control valve is in the advance mode and the retard mode and alter an amount of fluid recirculating between the advance chamber and the retard chamber.

21. A variable cam timing phaser comprising:

a housing assembly having an outer circumference for accepting drive force;

a rotor assembly to connected to a camshaft, the rotor assembly coaxially located within the housing assembly, the rotor assembly having a rotor body with at least one vane extending therefrom having metered edges at an end, wherein the housing assembly and the rotor assembly define at least one chamber separated by the at least one vane into an advance chamber and a retard chamber in which at least a portion of the at least one chamber seals the metered edges on the end of the at least one vane in specific positions, the at least one chamber defined by an advance wall and a retard wall, the at least one vane within the at least one chamber acting to shift relative angular position of the housing assembly and the rotor assembly;

a control valve for directing fluid from a fluid input to and from the advance chamber and the retard chamber through an advance line, a retard line, a supply line coupled to the fluid input, an exhaust port in communication with a tank, an advance detent line and a retard detent line, the control valve being moveable through multiple modes comprising:

an advance mode in which fluid is routed from the fluid input to the advance chamber and fluid is routed from the retard chamber to the advance chamber through a retard recirculation check valve;

a retard mode in which fluid is routed from the fluid input to the retard chamber and fluid is routed from the advance chamber to the retard chamber through an advance recirculation check valve;

a holding position in which fluid is routed to the advance chamber and the retard chamber from the supply line; and a detent mode in which the control valve blocks fluid from exiting from the retard chamber through the control valve, retaining fluid within the retard chamber, blocks fluid from exiting from the advance chamber through the control valve, retaining fluid within the advance chamber; and a pilot valve in fluid communication with the control valve, the advance detent line, and the retard detent line, the pilot valve moveable between a first position in which fluid from the control valve can flow through the pilot valve to the advance chamber and retard chambers via the advance detent line and the retard detent line through the metered edges of the at least one vane and a second position in which fluid is preventing from flowing from the control valve through the pilot valve to the advance chamber and the retard chamber, wherein when the control valve is in the detent mode, the pilot valve is in the first position, and the at least one vane is positioned within the housing assembly near or in an advance position, fluid from the advance chamber flows to the control valve and through the retard recirculation check valve, through the pilot valve and into the retard detent line, fluid from the retard detent line flows into the retard chamber via the metered edges of the at least one vane, moving the at least one vane until the metered edges of the at least one vane are sealed by the portion of the at least one chamber and the variable cam timing phaser is in a mid-position between the advance wall and the retard wall within the at least one chamber, wherein when the control valve is in the detent mode, the pilot valve is in the first position, and the at least one vane is positioned within the housing assembly near or in a retard position, fluid from the retard chamber flows to the control valve and through the advance recirculation check valve, through the pilot valve and into the advance detent line, fluid from the advance detent line flows into the advance chamber via the metered edges of the at least one vane, moving the at least one vane until the metered edges of the at least one vane are sealed by the portion of the at least one chamber and the variable cam timing phaser is in the mid-position between the advance wall and the retard wall within the at least one chamber.

22. The variable cam timing phaser of claim 21, wherein the control valve further comprises:

a hollow sleeve with a plurality of ports; and a spool received within the hollow sleeve comprising:

a plurality of lands for selectively blocking the plurality of ports of the hollow sleeve; and a working central passage located within the spool receiving the advance recirculation check valve and the retard recirculation check valve, limiting a flow of fluid between the advance chamber and the retard chamber through the working central passage.

23. The variable cam timing phaser of claim 21, further comprising a locking pin slidably located in a bore of the rotor assembly, the locking pin being moveable within the rotor assembly from a locked position in which an end portion of the locking pin engages a recess of the housing assembly, to an unlocked position in which the end portion does not engage the recess of the housing assembly, the recess being in fluid communication with the pilot valve and in fluid communication with the supply line via the control valve.

24. The variable cam timing phaser of claim 21, wherein the advance recirculation check valve and the retard recirculation check valve are located outside of the control valve.

* * * * *